US007455535B2

(12) United States Patent
Insalaco et al.

(10) Patent No.: US 7,455,535 B2
(45) Date of Patent: Nov. 25, 2008

(54) RAIL SYSTEM

(75) Inventors: Robert W. Insalaco, Holland, MI (US); Russel Howe, Glendale, CA (US); James B. Long, Kentwood, MI (US); W. Daniel Millis, Encino, CA (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 10/526,654

(22) PCT Filed: Sep. 4, 2003

(86) PCT No.: PCT/US03/27584

§ 371 (c)(1),
(2), (4) Date: Nov. 14, 2006

(87) PCT Pub. No.: WO2004/022458

PCT Pub. Date: Mar. 18, 2004

(65) Prior Publication Data

US 2007/0077795 A1 Apr. 5, 2007

Related U.S. Application Data

(60) Provisional application No. 60/408,149, filed on Sep. 4, 2002.

(51) Int. Cl.
*H01R 25/00* (2006.01)

(52) U.S. Cl. ..... 439/121; 439/110

(58) Field of Classification Search ..... 439/110, 439/115–119, 121
See application file for complete search history.

(56) References Cited

U.S. PATENT DOCUMENTS

| | | | | |
|---|---|---|---|---|
| 4,591,764 | A | 5/1986 | Nilssen | |
| 5,618,192 | A * | 4/1997 | Drury | 439/110 |
| 6,059,582 | A | 5/2000 | Tsai | |
| 6,133,845 | A * | 10/2000 | Toms et al. | 340/310.18 |
| 6,716,042 | B2 | 4/2004 | Lin | |

* cited by examiner

*Primary Examiner*—Tho D. Ta
*Assistant Examiner*—Travis Chambers
(74) *Attorney, Agent, or Firm*—Varnum, Riddering, Schmidt & Howlett LLP

(57) ABSTRACT

A rail system (100) is disclosed which may be employed within a commercial interior (102). The rail system (100) comprises a series of primary-tracks (130) in a spaced apart configuration. The rail system (100) also comprises a series of cross rails (132) releasably interconnectable to the primary tracks (130). The rail system (100) permits electrical and mechanical interconnections and reconfiguration of electrical and mechanical interconnections, for various functional accessories and communications.

44 Claims, 24 Drawing Sheets

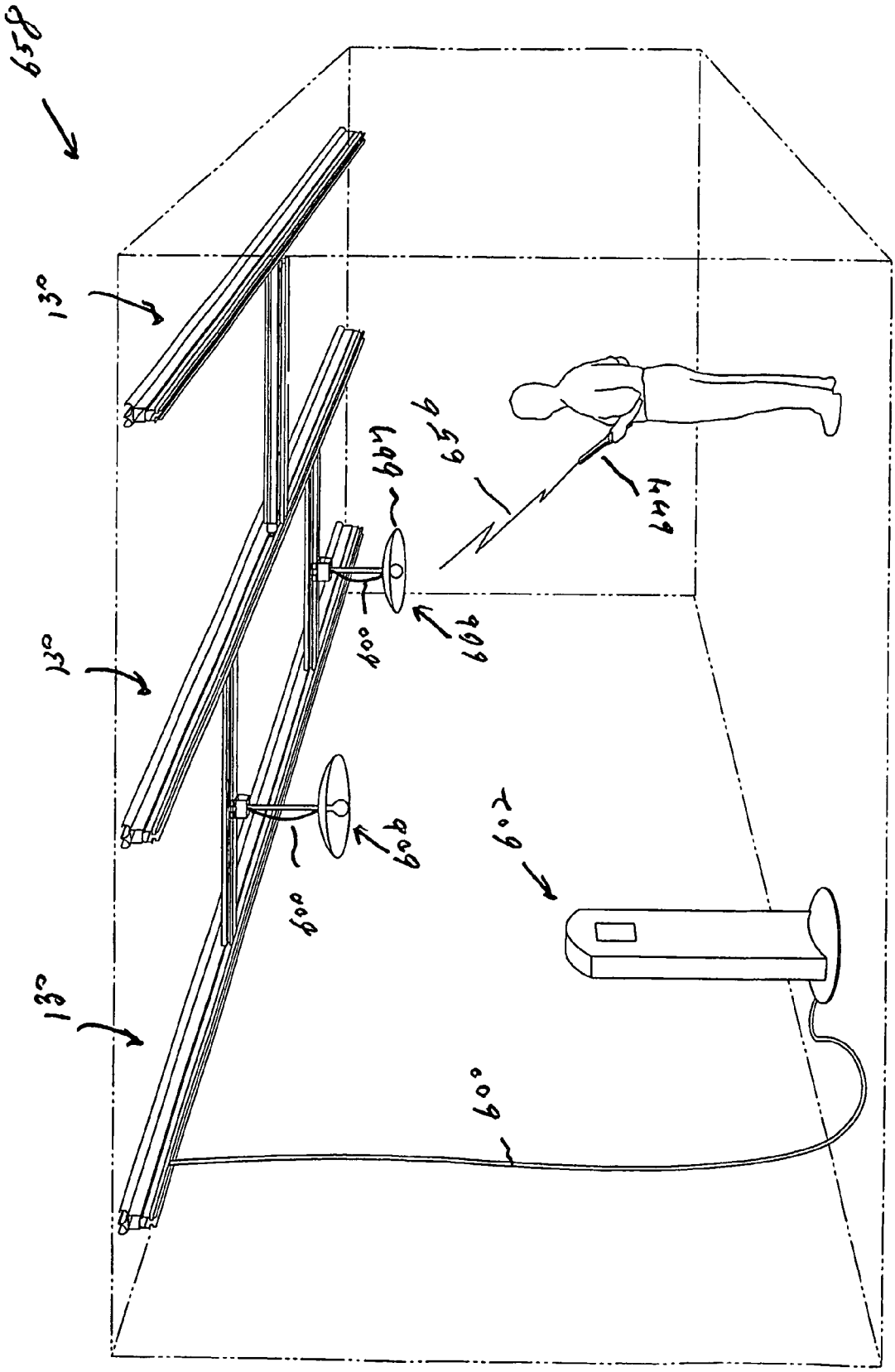
658
130
130
130
660
660
660

RAIL SYSTEM

CROSS-REFERENCE TO RELATED APPLICATIONS

This international application is based upon and claims priority of U.S. Provisional Patent Application Ser. No. 60/408,149 filed Sep. 4, 2002.

STATEMENT REGARDING FEDERALLY SPONSORED RESEARCH OR DEVELOPMENT

Not applicable.

REFERENCE TO A MICROFISHE APPENDIX

Not applicable.

BACKGROUND OF THE INVENTION

1. Field of the Invention

The invention relates to an overhead infrastructure for commercial interiors (i.e. commercial, industrial, residential and office environments) requiring power and cable access and, more particularly, to a rail system which permits electrical and mechanical interconnections (and reconfiguration of electrical and mechanical interconnections) of various functional accessories, and communications (including reconfiguration of controlled/controlling relationships) among the accessories.

2. Background Art

Building infrastructure continue to evolve in today's commercial, industrial and office environments. For purposes of description in this specification, the term "commercial interiors" shall be used to collectively designate commercial, industrial, residential and office environments. Historically, and particularly beginning with the industrial revolution, infrastructure often consisted of large rooms with fixed walls and doors. Commercial interiors would often include large and heavy desks, work tables, machinery, assembly lines or the like, depending upon the particular environment. Lighting, heating and cooling (if any) functions were often centrally controlled. With the exception of executive offices, privacy for face-to-face or telephone conversations, meetings or other commercial interior activities was difficult to achieve. Of course, until the past several decades, and with the exception of telephones and typewriters, there was no need to configure infrastructures or furniture to facilitate usage of other office equipment, such as computers, copying and facsimile machines. In general, occupants of such commercial interiors had no significant control over their environments. Also, given the use of stationary walls and heavy office and industrial equipment, any reconfiguration of a commercial interior was a significant undertaking.

During the middle of the twentieth century, commercial interiors began to acquire somewhat of a more "sophisticated" design, particularly with respect to office environments. In part, this was caused by office "automation" with the advent of electronic copying machines, teletypes, electric typewriters and the like. The office "layout" needed to take into account greater needs for electrical power and configurations for supplying power to appropriate locations. Also, "shared" equipment, such as copy machines and teletypes, required consideration of centralized locations (and "common space") and high voltage power supply. During this time, thought was also given to environmental concerns in commercial interiors, such as appropriate air ventilation.

Although building owners and tenants began to concern themselves with the foregoing, commercial interiors still typically involved very heavy and relatively "stationary" furniture. Also, partitions in the form of load bearing and non-load-bearing walls still formed the divisions among spacial areas. Lighting, heating and the early forms of air conditioning also continued to be controlled through central (and often remote) locations.

The next advance in building infrastructure and commercial interiors began in the 1960's. Several furniture makers (including the assignee of this invention) began work on "modular" systems. These systems presented an advance in commercial interior design. Instead of providing row upon row of individual and bulky desks within a completely open area, partitions were provided to achieve at least a minimum level of individual privacy, and to define an individual's "workspace." Some of the partitions were designed to provide embedded electrical power (interconnected to the building's common power supplies) conveniently located, at an occupant's workspace. Common hanging and supporting bracket structures were developed to provide convenient means for interconnecting furniture accessories (such as shelving, cabinets and work surfaces) to stationary walls or to the partitions themselves. As these systems evolved, they included arrangements for use with specific utilitarian elements. Such accessories included computer stands, keyboard drawers and the like. Throughout the past several decades, a significant amount of work has been undertaken to increase the scope of functionality of these modular systems. Significant work has also been undertaken with respect to enhancing the systems' aesthetics.

In general, systems as developed over the past several decades can be somewhat characterized as providing a "compendium of parts" for the occupants or users. These parts provide commonality in hanging, supporting and connecting structures, and also provide for interchangeability. Ongoing development of these systems involves not only the previously described functional accessories, but also other considerations for the occupant, such as the use of acoustical materials within partitions.

Although modular systems present an advance in the architectural arts, there are still a number of considerations which are not met by these systems. For example, although these systems are sometimes characterized as "modular," they do not necessarily lend themselves to rapid reconfiguration. For example, partitions (although described as "movable") often require a significant amount of work to reconfigure. Any reconfiguration of movable partitions may also involve requirements of additional physical wiring or substantial rewiring. Further, although these systems employ interchangeability of hanging and supporting components, assembly and disassembly of these systems (even beyond the movable partitions) require a substantial amount of work, and usually involve maintenance personnel with particular expertise. Still further, although these systems may involve lighting controllable by the workspace user, most environmental functions remain centrally controlled, often at a location substantially remote from the commercial interior being controlled.

In the past, problems associated with difficulty in reconfiguration of commercial interior, and lack of in situ control of a location's environmental conditions may not have been of primary concern. However, today's business climate often involves relatively "fast changing" commercial interior needs. Commercial interiors may be structurally designed by designers, architects and engineers, and initially laid out in a desired format with respect to building walls, lighting fixtures, switches, data lines and other functional accessories and infrastructure, including those associated with modular systems. However, when these structures, which can be characterized as somewhat "permanent" in most buildings (as described in previous paragraphs herein), are designed, the actual occupants may not move into the building for several years. Designers almost need to "anticipate" the needs of future occupants of the building being designed. Needless to say, in situations where the building will not be commissioned for several years after the design phase, the infrastructure of the building may not be appropriately laid out for the actual occupants. That, is, the prospective tenants' needs may be substantially different from the designers' ideas and concepts. However, as previously described herein, most commercial interiors permit little reconfiguration after completion of the initial design. Reconfiguring a structure for the needs of a particular tenant can be extremely expensive and time consuming. During structural modifications, the commercial interior is essentially "down" and provides no positive cash flow to the buildings' owners.

Essentially, it would be advantageous to always have the occupants' activities and needs "drive" the structure and function of the infrastructure layout. Today, however, many relatively "stationary" (in function and structure) infrastructures essentially operate in reverse. That is, it is not uncommon for prospective tenants to evaluate a building's infrastructure and determine how to "fit" their needs (workspaces, conference rooms, lighting, HVAC, and the like) into the existing infrastructure.

Still further, and again in today's business climate, a prospective occupant may have had an opportunity to be involved in the design of a building's commercial interior, so that the commercial interior is advantageously "set up" for the occupant. However, many business organizations today experience relatively rapid changes in growth, both positively and negatively. When these changes occur, again it may be difficult to appropriately modify the commercial interior so as to permit the occupant to expand beyond its original commercial interior or, alternatively, be reduced in size such that unused space can then be occupied by another tenant.

Other problems also exist with respect to the layout and organization of today's commercial interiors. For example, accessories such as switches and lights may be relatively "set" with regard to locations and particular controlling relationships between such switches and lights. That is, one or more particular switches may control one or more particular lights. To modify these control relationships in most commercial interiors requires significant efforts. In this regard, a commercial interior can be characterized as being "delivered" to original occupants in a particular "initial state." This initial state is defined by not only the physical locations of functional accessories, but also the control relationships among switches, lights and the like. It would be advantageous to provide means for essentially "changing" the commercial interior in a relatively rapid manner, without requiring physical rewiring or similar activities. In addition, it would also be advantageous to have the capability of modifying physical locations of various functional accessories, without requiring additional electrical wiring, substantial assembly or disassembly of component parts, or the like. Also, and of primary importance, it would be advantageous to provide a commercial interior which permits not only physical relocation or reconfiguration of functional accessories, but also permits and facilitates reconfiguring control among functional accessories. Still further, it would be advantageous if users of a particular commercial interior could effect control relationships among functional accessories and other utilitarian elements at the location of the commercial interior itself.

A significant amount of work is currently being performed in technologies associated with control of what can be characterized as "environmental" systems. The systems may be utilized in commercial and industrial buildings, residential facilities, and other environments. Control functions may vary from relatively conventional thermostat/temperature control to extremely sophisticated systems. Development is also being undertaken in the field of network technologies for controlling environmental systems. References are often currently made to "smart" buildings or rooms having automated functionality. This technology provides for networks controlling a number of separate and independent functions, including temperature, lighting and the like.

In this regard, it would be advantageous for certain functions associated with environmental control to be readily usable by the occupants, without requiring technical expertise or any substantial training. Also, as previously described, it would be advantageous for the capability of initial configuration or reconfiguration of environmental control to occur within the proximity of the controlled and controlling apparatus, rather than at a centralized or other remote location.

A number of systems have been developed which are directed to one or more of the aforedescribed issues. For example, Jones et al., U.S. Pat. No. 3,996,458, issued Dec. 7, 1976, is primarily directed to an illuminated ceiling structure and associated components, with the components being adapted to varying requirements of structure and appearance. Jones et al. disclose the concept that the use of inverted T-bar grids for supporting pluralities of pre-formed integral panels is well known. Jones et al. further disclose the use of T-bar runners having a vertical orientation, with T-bar cross members. The cross members are supported by hangers, in a manner so as to provide an open space or plenum thereabove in which lighting fixtures may be provided. An acrylic horizontal sheet is opaque and light transmitting areas are provided within cells, adding a cube-like configuration. Edges of the acrylic sheet are carried by the horizontal portions of the T-bar runners and cross runners.

Balinski, U.S. Pat. No. 4,034,531, issued Jul. 12, 1977 is directed to a suspended ceiling system having a particular support arrangement. The support arrangement is disclosed as overcoming a deficiency in prior art systems, whereby exposure to heat causes T-runners to expand and deform, with ceiling tiles thus falling from the T-runners as a result of the deformation.

The Balinski ceiling system employs support wires attached to its supporting structure. The support wires hold inverted-T-runners, which may employ enlarged upper portions for stiffening the runners. An exposed flange provides a decorative surface underneath the T-runners. A particular flange disclosed by Balinski includes a longitudinally extending groove on the underneath portion, so as to create a shadow effect. Ceiling tiles are supported on the inverted-T-runners and may include a cut up portion, so as to enable the bottom surface to be flush with the bottom surface of the exposed flange. The inverted-T-runners are connected to one another through the use of flanges. The flanges provide for one end of one inverted-T-runner to engage a slot in a second T-runner. The inverted-T-runners are connected to the decorative flanges through the use of slots within the tops of the decorative flanges, with the slots having a generally triangular cross-section and with the inverted-T-runner having its bottom cross member comprising opposing ends formed over the exposed flange. In this manner, the inverted-T-runner engages the top of the exposed flange in a supporting configuration.

Balinski also shows the decorative exposed flange as being hollow and comprising a U-shaped member, with opposing ends bent outwardly and upwardly, and then inwardly and outwardly of the extreme end portions. In this manner, engagement is provided by the ends of the inverted-T-runner cross members. A particular feature of the Balinski arrangement is that when the system is subjected to extreme heat, and the decorative trim drops away due to the heat, the inverted-T-configuration separates and helps to hold the ceiling tiles in place. In general, Balinski discloses inverted-T-runners supporting ceiling structures.

Balinski et al., U.S. Pat. No. 4,063,391 shows the use of support runners for suspended grid systems. The support runner includes a spline member. An inverted T-runner is engaged with the spline, in a manner so that when the ceiling system is exposed to heat, the inverted T-runner continues to hold the ceiling panels even, although the spline loses structural integrity and may disengage from the trim.

Csenky, U.S. Pat. No. 4,074,092 issued Feb. 14, 1978, discloses a power track system for carrying light fixtures and a light source. The system includes a U-shaped supporting rail, with the limbs of the same being inwardly bent. An insulating lining fits into the rail, and includes at least one current conductor. A grounding member is connected to the ends of the rail limbs, and a second current conductor is mounted on an externally inaccessible portion of the lining that faces inwardly of the rail.

Botty, U.S. Pat. No. 4,533,190 issued Aug. 6, 1985, describes an electrical power track system having an elongated track with a series of longitudinal slots opening outwardly. The slots provide access to a series of offset electrical conductors or bus bars. The slots are shaped in a manner so as to prevent straight-in access to the conductors carried by the track.

Greenberg, U.S. Pat. No. 4,475,226 describes a sound and light track system, with each of the sound or light fixtures being independently mounted for movement on the track. A bus bar assembly includes audio bus bar conductors and power bus bar conductors.

BRIEF DESCRIPTION OF THE SEVERAL VIEWS OF THE DRAWING

The invention will now be described with reference to the drawings, in which:

FIG. 21 A illustrates a rail system in accordance with the invention in use within a particular commercial interior, and illustrating the interconnection of a non-powered cross rail in an angled configuration below two supporting primary tracks, the view being similar in scope to FIGS. 14 and 17;

FIG. 28 illustrates the use of a rail system in accordance with the invention configured somewhat similar to the rail systems illustrated in FIGS. 26 and 27, and further illustrating the use of the rail system with manual manipulation of a wand for purposes of controlling lighting fixtures and the like;

FIG. 29 illustrates the further programming of a second light fixture associated with the rail system in FIG. 28;

DETAILED DESCRIPTION OF THE INVENTION

Figure 1:
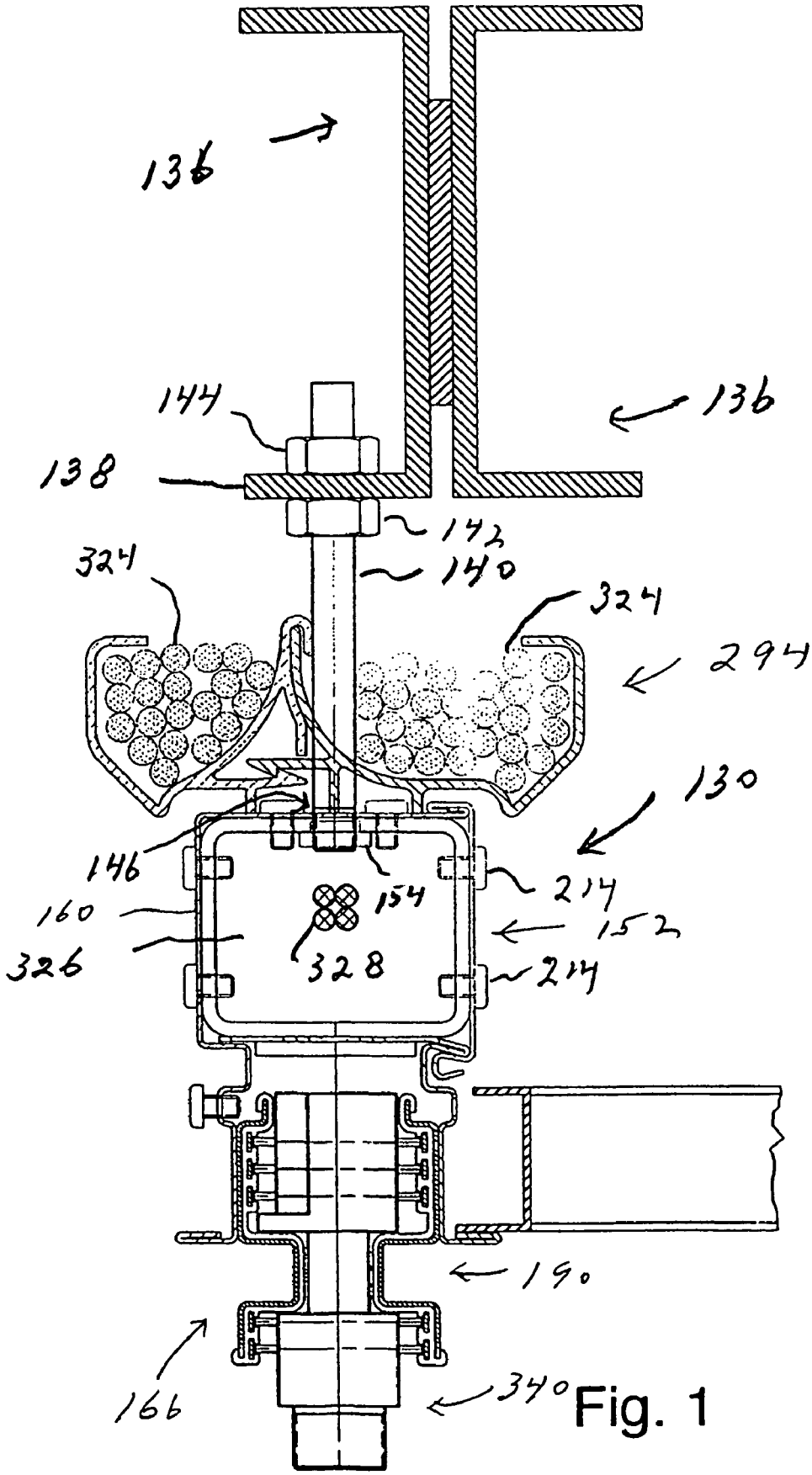
FIG. 1 is a cross-sectional view of an exemplary embodiment of a rail system in accordance with the invention.

The principles of the invention are disclosed, by way of example, within a rail system 100 illustrated in FIGS. 1-32. A general layout of the rail system 100 as used within a series of reconfigurable commercial interiors s is illustrated in FIG. 3. Structural layouts of the rail system employing certain of its principal components are also illustrated in FIGS. 14, 17, 21A, 26, 27, 28, 29 and 29A. The rail system 100 comprises an overhead structure providing significant advantages in environmental workspaces. As examples, the rail system 100 in accordance with the invention facilitates access to locations where a commercial interior designer may wish to locate various functional elements, including electrical power receptacles and the like. In addition, the rail system 100 facilitates flexibility and reconfiguration in the location of various functional elements which may be supported and mounted in a releasable and reconfigurable manner with the rail system. Still further, the rail system in accordance with the invention may carry not only AC electrical power (of varying voltages), but also may carry DC/low voltage or communication signals. The communication signals can be used for purposes of relatively well-known communication functions. However, and in accordance with the invention, the rail system 100 may include a communication bus structure which permits the "programming" of controlled relationships among various commercial interior components. For example, with a bus structure as incorporated within the rail system 100, "control relationships" may be "reprogrammed" among components such as switches and lights.

More specifically, with the rail system 100 in accordance with the invention, reconfiguration is facilitated, both with respect to expense, time and functionality. Essentially, the commercial interior can be reconfigured in "real time." In this regard, not only is it important that various functional components can be quickly relocated from a "physical" sense, but relationships among functional components can also be altered. As a relatively simple example, and as described in subsequent paragraphs herein with respect to FIGS. 28-32, functional or "control" relationships can be readily modified among various switch and lighting components. In part, it is the "totality" of the differing aspects of a commercial interior which are readily reconfigurable, and which provide some of the inventive concepts of the rail system 100.

With reference first to FIG. 3, the rail system 100 may be employed within a commercial interior structure 102. The commercial interior structure 102 includes a number of workspaces which have been defined in a reconfigurable manner through the use of a series of vertically disposed partitions 104, an example of which is shown with respect to another exemplary commercial interior in FIG. 26. The vertically disposed partitions 104 are utilized to reconfigurably separate the commercial interior structure 102 into workspaces. For example, in the lower left-hand portion of FIG. 3, a workspace 106 is defined which may be employed as a conference room having a conference table 108 and chairs 110. The conference room workspace 106 may also be somewhat partially open, as also illustrated in FIG. 3.

The commercial interior structure 102 may include other workspaces, such as the workspace 112. The workspace 112 may comprise, for example, a series of computer workstations 114 which are reconfigurably segregated from each other through one of the vertically disposed partitions 116, which is configured in a continuous S-shaped configuration. The commercial interior structure 102 may have other work areas. For example, the area indicated as room 118 may be a library reading room. Correspondingly, the area designated as area 120 may be a teleconferencing area. Continuing with a library concept, the commercial interior structure 102 may include book stacks 122. For purposes of providing additional lighting, a skylight 124 may also be provided. Still further, the structure 102 may include shared offices 126 and collaborative work areas 128. These are merely some examples of areas which may be formed and partitioned within a commercial interior structure 102.

The rail system 100 as illustrated in FIG. 3 comprises an overhead rail structure having a series of primary tracks 130 which are shown as extending horizontally in the view illustrated in FIG. 3. The primary tracks 130 are shown in FIG. 3 as being spaced apart in a parallel manner and each equidistant from adjacent ones of the primary tracks 130. The primary tracks 130 comprise a principal component of the rail system 100. In part, and as described in subsequent paragraphs herein, the primary tracks 130 are employed to releasably and reconfigurably support, in an overhead manner, the vertically disposed partitions 104.

Also in accordance with the invention, the rail system 100 as illustrated in FIG. 3 comprises a series of cross rails 132. The cross rails 132, as described in subsequent paragraphs herein, are releasably interconnectable to the primary tracks 130. Further, as shown in FIG. 3, the cross rails 132 extend in perpendicular configurations relative to the primary tracks 130. However, as also described in subsequent paragraphs herein with respect to FIG. 21 A, a cross rail 132 may be interconnected to adjacent primary tracks 132 at an angular configuration, relative to the longitudinal configurations of the interconnected primary tracks 130.

The work place structure 102 may also include ceiling panels 134 or similar types of ceiling structures which may be supported by the primary tracks 130 and cross rails 132 of the rail system 100. The ceiling panels 134 are shown, for purposes of clarity, in phantom line format in FIG. 3.

In summary, FIG. 3 illustrates an exemplary rail system 100 in accordance with the invention, as may be applied as an overhead structure to a commercial interior structure 102 having a series of reconfigurable and partitioned workspaces 106. In this regard, one aspect of the rail systems in accordance with the invention relates to increased structural rigidity. In part, this is provided by a staggering relationship for rail system components, as described in subsequent paragraphs herein. This rigidity reduces the probability of inadvertent dislodgment of components and connected items, such as ceiling covers and the like. In addition, the rigidity provides for superior egress for occupants during fires and seismic events.

Turning more specifically to the details of the rail system 100, a primary track 130 in accordance with the invention will now be described with respect to FIGS. 1, 2, 4-7, 10 and 10A. Turning specifically to FIG. 1, which illustrates an assembled one of the primary tracks 130, the primary tracks 130 may be supported by interconnection to a steel or other metallic overhead support beam 136. The overhead support beam 136 is illustrated in cross-sectional configuration in FIG. 1. The overhead support beam 136 may be load or non-load bearing. The support beam 136 includes a lower and horizontally extending flange 138 extending in a substantially horizontal plane. For purposes of supporting the primary track 130 illustrated in FIG. 1, a series of co-threaded bolts 140 may be employed. One of the co-threaded bolts 140 is illustrated in FIG. 1. The co-threaded bolt 140 extends at its upper end through an aperture (not shown) extending through the lower flange 138 of the support beam 136. The co-threaded bolt 140 is threaded adjacent its upper end and is secured at a desired vertical disposition through the use of a lower hex-nut 142 and an upper hex-nut 144. The hex-nuts 142, 144 are threaded onto the co-threaded bolt 140 on opposing sides of the lower flange 138. In this manner, the primary track 130 may be secured to the overhead support beams 136, in a manner which provides for rigidity, yet also provides for adjustability with respect to vertical positioning relative to the support beam 136. In addition to the overhead supporting arrangements as described herein, it may also be possible to interconnect the rail systems to other structure, such as connection to structures like concrete floors above the rail system, with the connections occurring through cables and the like.

It should be emphasized that other supporting arrangements may be employed, without departing from the spirit and scope of the novel concept of the invention. For example, in place of the co-threaded bolt 140 and the support beam 136 configuration, the bolt 140 could be replaced by a threaded hangar or similar means, with a threaded rod having a metallic hangar threadably received at an upper end of the threaded rod. The hangar may then be hung on or otherwise releasably interconnected to other overhead supporting components. In any event, it is advantageous to utilize a supporting arrangement which facilitates relocation and vertical adjustability of the interconnected primary track 130.

Figure 2:
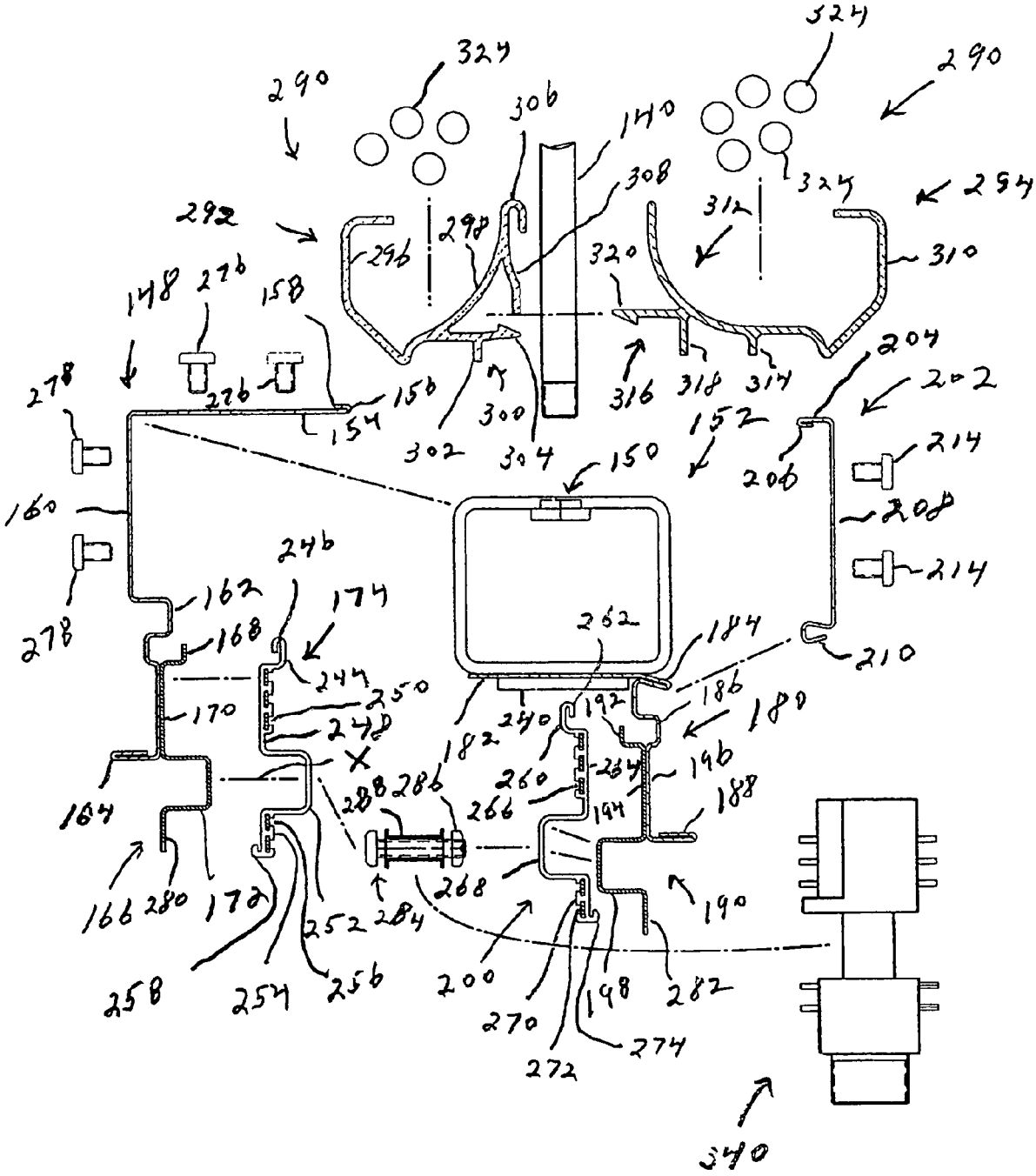
FIG. 2 is a two dimensional exploded view of certain of the elements of the rail system in accordance with the invention, with the principal elements also shown in FIG. 1.
Figure 3:
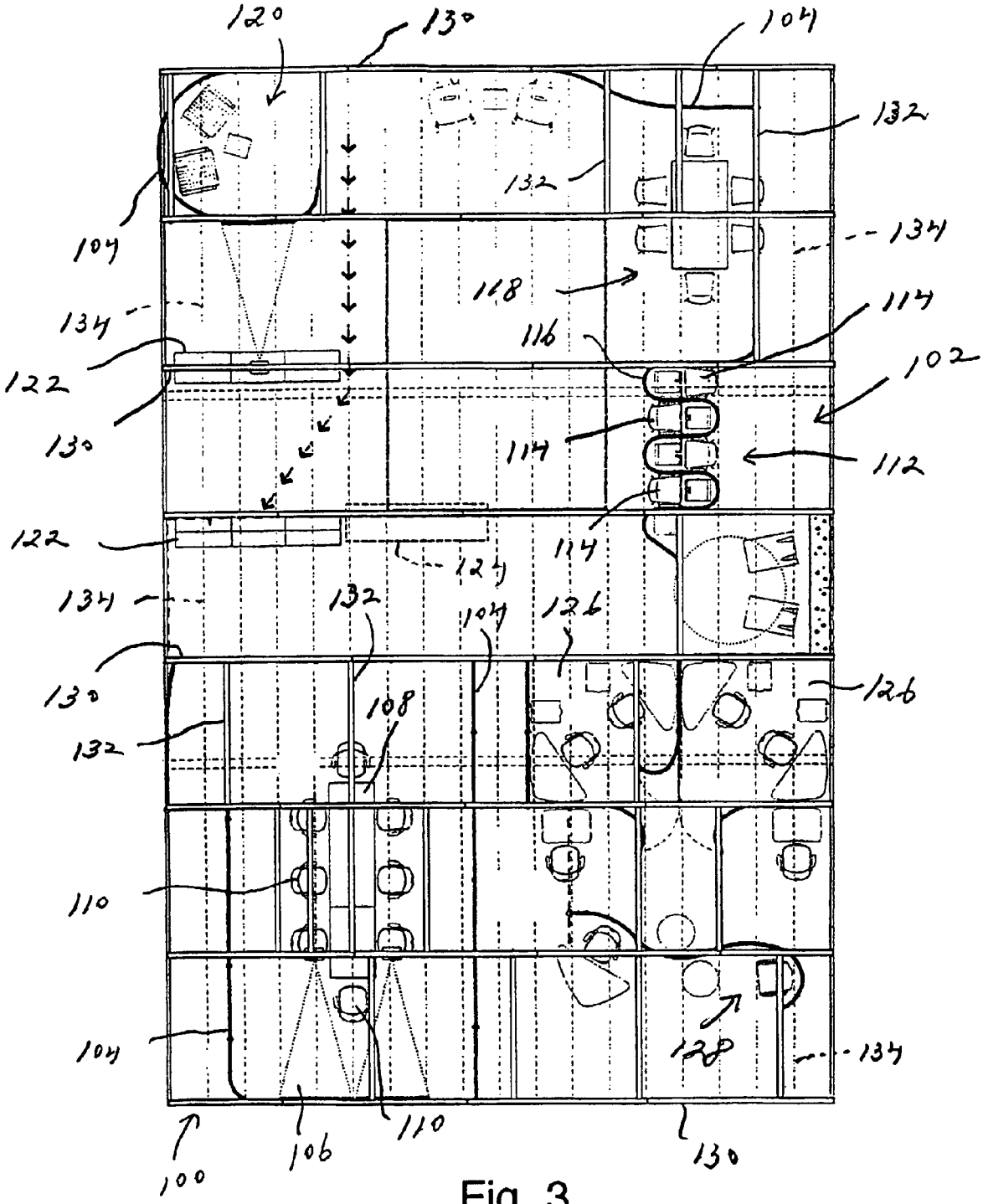
FIG. 3 is a plan view of a series of commercial interiors, illustrating an exemplary use of the rail system with the commercial interiors, in accordance with the invention.

The lower end of the co-threaded bolt 140 is threaded and extends downwardly through an aperture 146 which, correspondingly, extends vertically through the upper portion of a back half assembly 148 or "back half" (illustrated in a clarifying manner in FIG. 2). The back half 148 will be described in greater detail in subsequent paragraphs herein. The co-threaded bolt 140 is further extended through a threaded bore 150 of a track connector 152. The threaded bore 150 and track connector 152 are illustrated in a clarifying manner in FIG. 5. Associated with the underside of the threaded bore 150 is a stationary and self-locking hex nut 154. For purposes of interconnection of the primary track 130 to the support beam 136, the co-threaded bolt 140 can first be threadably received within the threaded bore 150 of the track connector 152, with the co-threaded bolt 140 also extending through the aperture 146 of the back half 148. After being threadably received within the threaded bore 150 an appropriate distance, the hex nuts 142, 144 can be appropriately tightened and positioned at a desired vertical orientation, so as to provide the appropriate vertical disposition of the primary track 130 relative to the support beam 136. As apparent from the nature and scope of the invention, a series of bolts 140 and associated components are utilized along the longitudinal axis of the primary track 130, for purposes of appropriate and releasable interconnection to the support beam 136. In addition to the overhead supporting arrangements as described herein, it may also be possible to interconnect the rail systems to other structure, such as connection to concrete floors above the rail system, with the connections occurring through cables and the like.

The primary track 130 includes a series of individual elements which form the track itself. More specifically, the primary track 130 includes a previously referenced back half 148. The back half 148 is primarily illustrated in FIGS. 2 and 6, and may preferably be constructed as a steel roll formed section. With reference primarily to FIG. 2, the back half 148 includes an upper member 154 having a normal horizontally disposed configuration, and extending in an elongated manner so as to form part of the longitudinal structure of the primary track 130. The end 156 of the upper member 154 is turned inwardly so as to form somewhat of a tongue 158. The tongue 158 is utilized so as to assist in securing a cover 202 of the primary track 130 to the back half 148, as described in subsequent paragraphs herein.

The upper member 154 is integral at one side with a downwardly disposed side member 160, again as primarily shown in FIG. 2. The side member 160 extends downwardly a certain distance, and then projects inwardly so as to form a supporting pedestal 162. As described in subsequent paragraphs herein, the supporting pedestal 162 acts so as to support one end of the front half assembly 180 of the primary track 130, as described in subsequent paragraphs herein. The side member 160 continues to extend downwardly from the supporting pedestal 162, and terminates in an elongated tongue 164, again as primarily illustrated in FIG. 2. Although not shown in either FIG. 2 or FIG. 6, the elongated tongue 164 acts as a support for interconnection of one or more cross rails to the primary track 130, and for support for ceiling decorative coverings and the like.

The back half assembly 148 also includes, as illustrated in FIG. 2, a secondary bracket 166. The secondary bracket 166 includes an upper member 168 which curves outwardly and is integral with a vertical member 170. The secondary bracket 166 and upper member 168 also prevent screws or the like from being driven into electrical components. The vertical member 170 is preferably secured (by weldment or other securing/connecting means) to the side member 160 of the back half assembly 148. The secondary bracket 166 then includes a supporting pedestal 172A which extends inwardly, and acts so as to facilitate support of the power connector 340 as described in subsequent paragraphs herein. Further, the support pedestal 172B extends inwardly, and acts so as to facilitate support of cross rails, vertical partitions, lighting and other accessories. In addition, the cross-sectional configuration of the secondary bracket 166, as illustrated in FIG. 2, mates with the cross-sectional configuration of the bus strip 174, as further described in subsequent paragraphs herein.

Figure 6:
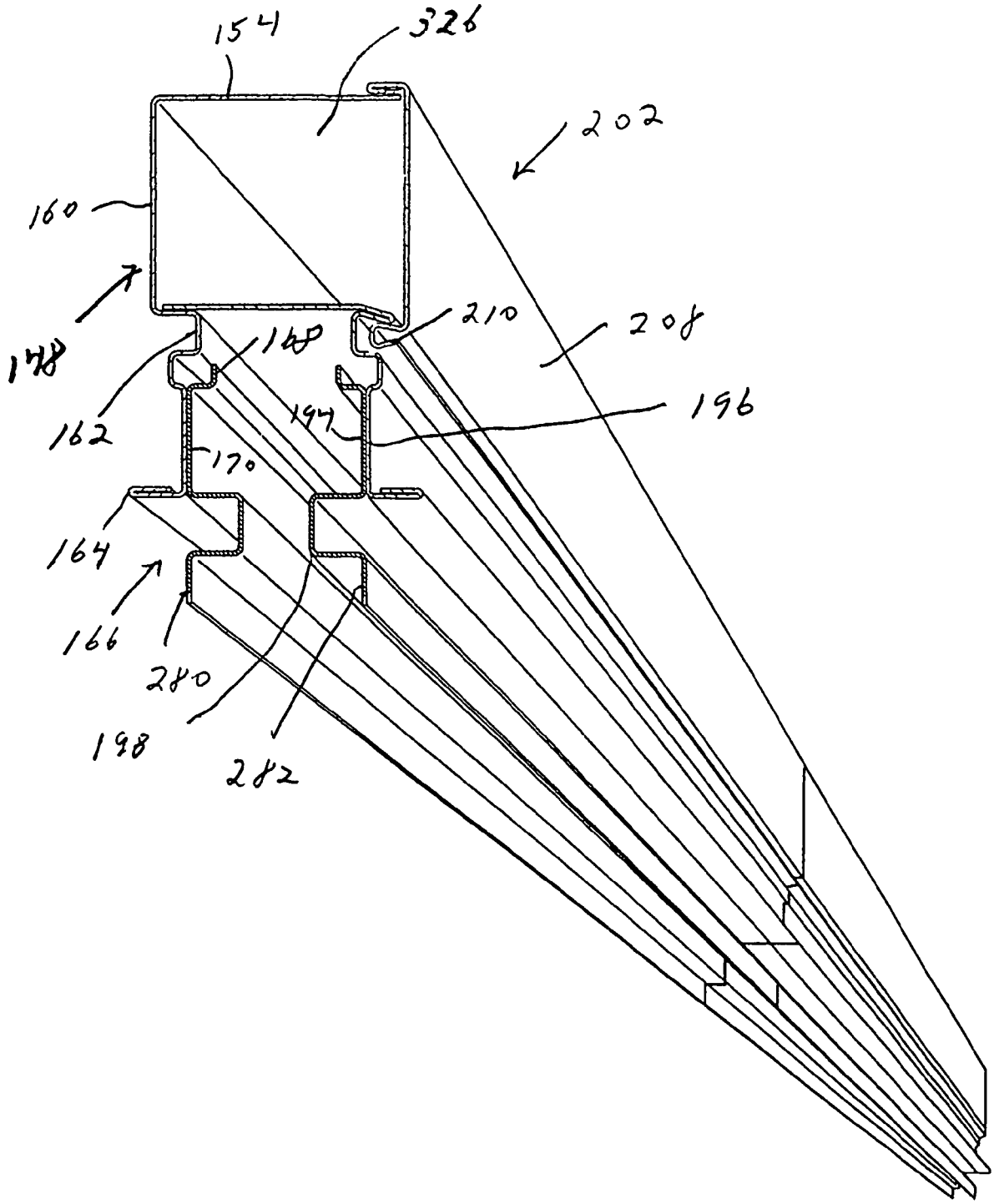
FIG. 6 is a perspective illustration of a primary track which may be employed as a component of the rail system in accordance with the invention.
Figure 7:
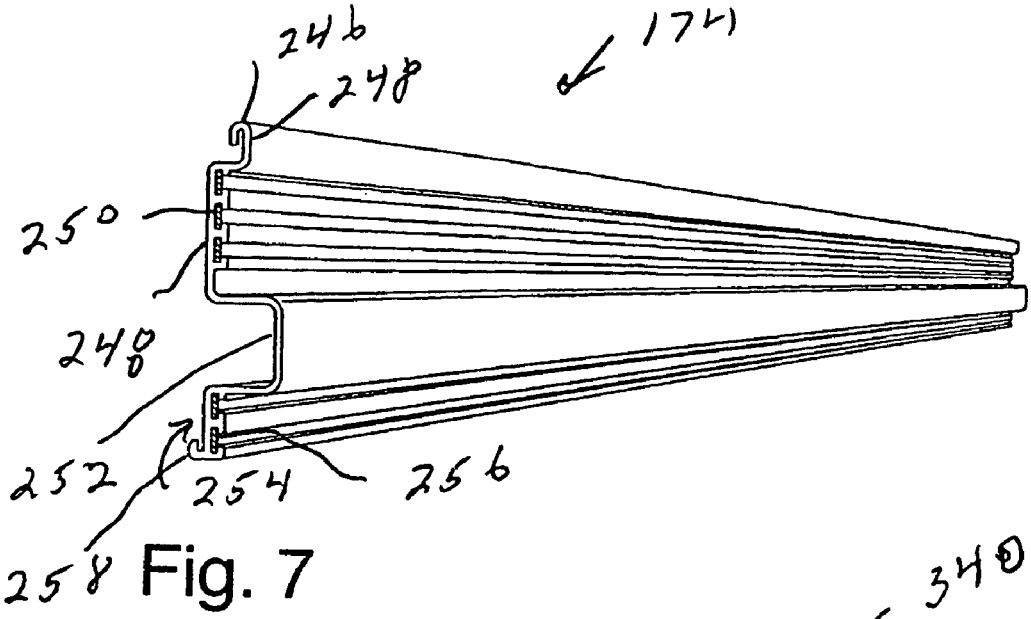
FIG. 7 is a perspective view of a power and communication bus strip which may be employed with the rail system in accordance with the invention.
Figure 8:
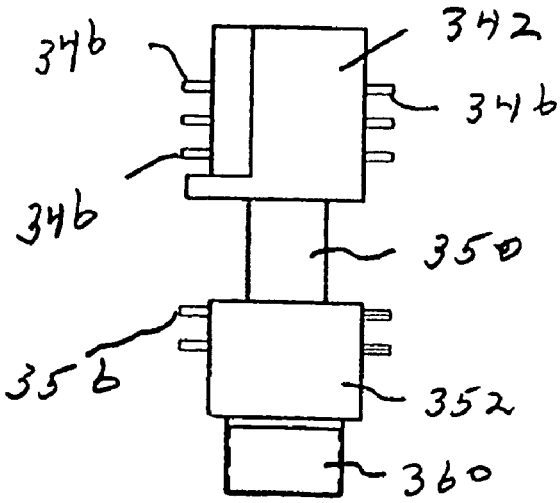
FIG. 8 is an elevation view of a power connector which may be utilized through coupling with the power and communication bus strips, for purposes of providing electrical power and communication signals to components selectively interconnected to the rail system through the power connector in accordance with the invention.
Figure 8A:
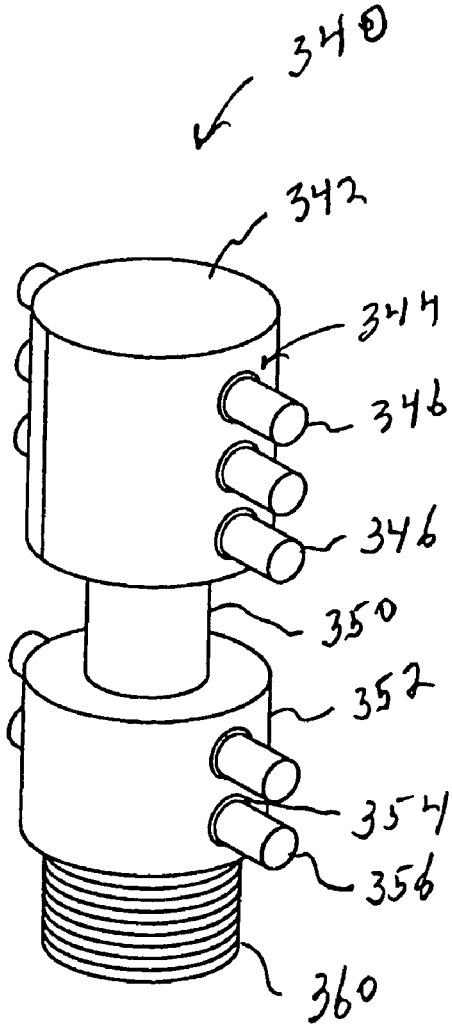

Continuing primarily with respect to FIGS. 2 and 6, the primary track 130 also includes a front half assembly 180, also preferably constructed as a steel roll formed section. The front half assembly 180 includes an upper member 182 having a normally horizontally disposed configuration, and extending in an elongated manner so as to form part of the longitudinal structure of the primary track 130. The upper member 182 is also utilized to support and secure, in part, the rail connector, as described in subsequent paragraphs herein.

With reference specifically to FIGS. 2 and 6, the right side of the upper member 182 projects somewhat downwardly and curves back upon itself so as to form a lip 184. As described in subsequent paragraphs herein, the lip 184 is utilized, in part, so as to secure the track cover to the assemblage of the primary track 130. From the lip 184, the front half assembly 180 projects downwardly and then outwardly so as to form a projection 186. From the projection 186, the front half assembly 180 continues downwardly and then terminates in a laterally projecting and elongated tongue 188. As partially shown in FIG. 1, and as described in subsequent paragraphs herein, the elongated tongue 188 acts as a support for interconnection of one or more cross rails to the primary track 130 and ceiling decorative coverings.

The front half assembly 180 further includes, as also illustrated in FIGS. 2 and 6, a secondary bracket 190. The secondary bracket 190 includes an upper member 192 which curves outwardly and is integral with a vertical member 194. The secondary bracket 190 and upper member 192 also prevent screws or similar elements from being driven into electrical components. The vertical member 194 is preferably secured (by weldment or other securing/connecting means) to a side member 196 of the front half assembly 180. The secondary bracket 190 further includes a supporting pedestal 198A positioned below the vertical member 194 and projecting inwardly, so as to facilitate support of a power connector 340, as described in subsequent paragraphs herein. Correspondingly, support pedestal 198B extends inwardly, and acts so as to facilitate support of cross rails, vertical partitions, lighting and other accessories. In addition, the secondary bracket 190 mates with a front bus strip 200, as further described in subsequent paragraphs herein.

Figure 9:
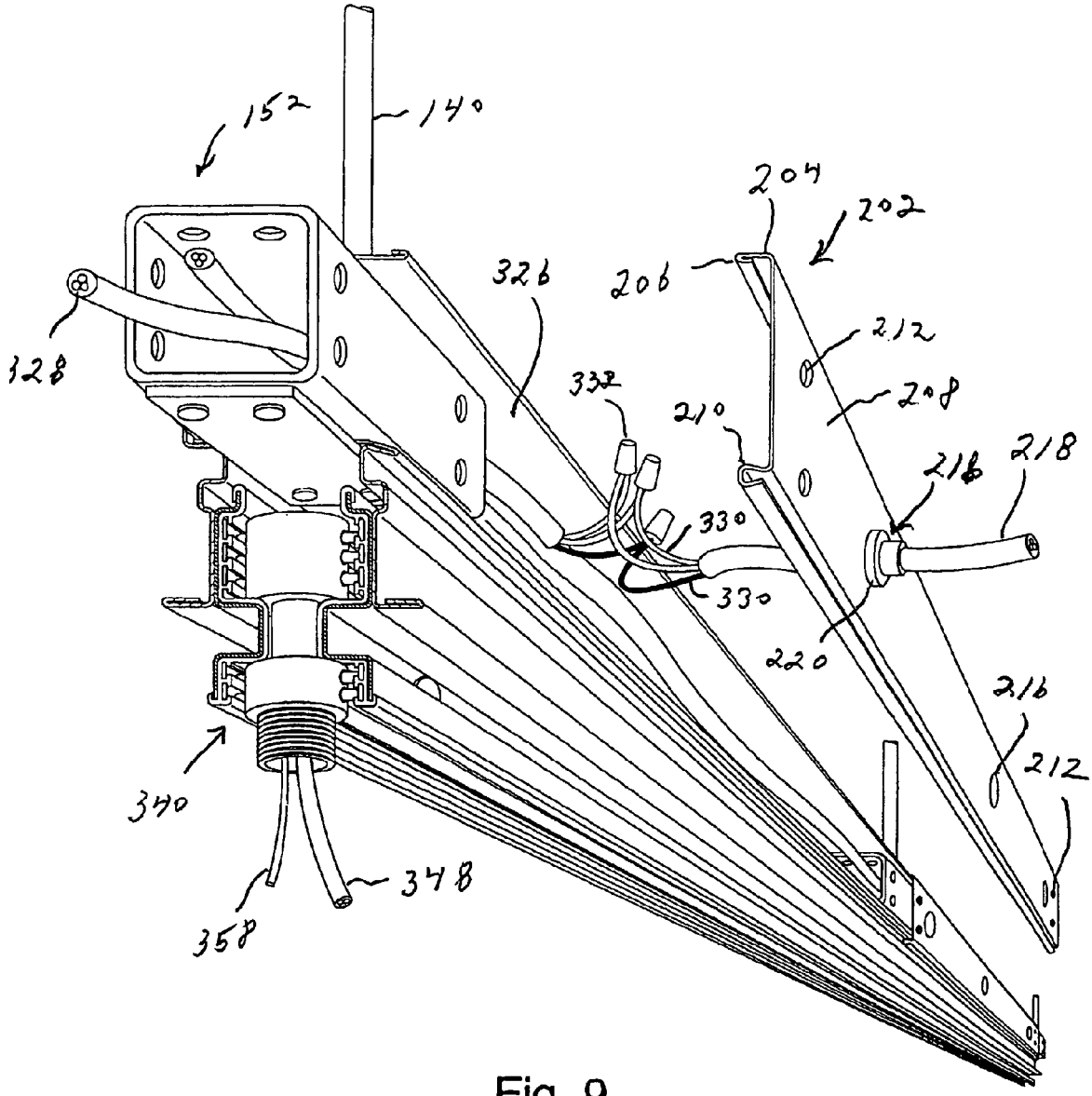
FIG. 9 is an underside perspective view of a primary track interconnected at its end to a rail connector in accordance with the invention, and further showing the primary track partially exploded away from a primary track cover, in addition to illustrating certain power and communication elements of the rail system in an exposed state.

The primary track 130 further includes a cover assembly 202 which is utilized to enclose what is characterized as the front side of the primary track 130. The cover assembly 202 is primarily shown in FIGS. 2, 6 and 9. With reference primarily to FIG. 2, the cover assembly 202 includes an upper portion 204 having an inwardly directed tongue 206 formed by the upper portion curving back against itself. The upper portion 204 is integral with a front portion 208 having a vertical orientation, and shaped so as to enclose a central portion of the primary track 130. Extending downwardly from and integral with the front portion 208 is an inwardly projecting shoe 210 shown in cross sectional configuration in FIG. 2. As illustrated in FIG. 9, the cover assembly 202 may also include apertures 212. The apertures 212 are adapted to receive connectors (such as screws) 214 illustrated in exploded view in FIG. 2. The screws 214 (or similar connecting means) are received through the apertures 212 and through corresponding apertures in the support bracket (as described in subsequent paragraphs herein) for purposes of tightly securing opposing ends of the cover assembly 202 to the primary track 130. In addition to the apertures 212, the cover assembly 202 may also incorporate knock-outs 216 spaced at desired intervals along the longitudinal axis of the cover assembly 202. The knock-outs 216 are adapted to receive electrical cables and the like, such as the electrical cables 218 illustrated in FIG. 9. A cable 218 may be secured through a knock-out 216 by means of a bushing and collar 220 (as also shown in FIG. 9) or a similar connecting and securing means.

Figure 5:
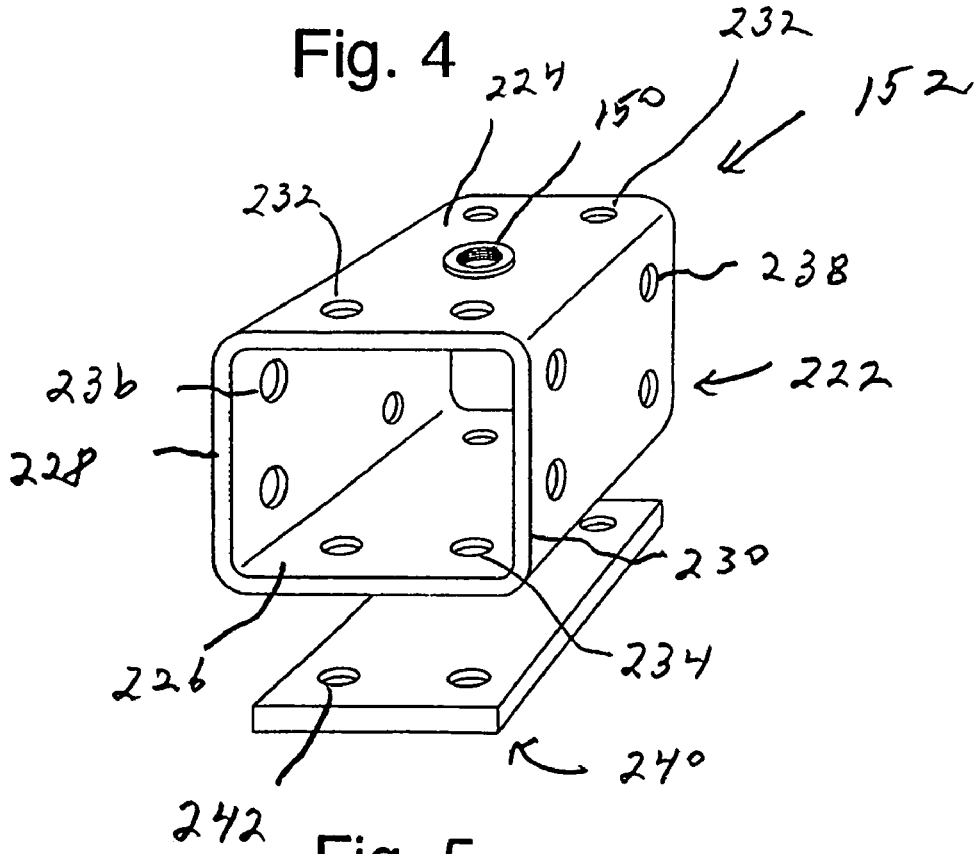
FIG. 5 is a perspective and partially exploded view of a rail connector which may be utilized in accordance with the invention, for purposes of interconnecting adjacent primary tracks and providing intermediate support of the rail system in accordance with the invention.

For purposes of providing releasable interconnection and rigidity for the primary tracks 130, the assemblage of the primary track 130 also includes the support bracket or track connector 152. The structural configuration of the support bracket 152 is primarily shown in FIG. 5. With reference thereto, the support bracket 152 includes a primary structure 222 having, as illustrated in FIG. 5, a substantially rectangular cross sectional configuration and a relatively short length. The primary structure 222 includes an upper wall 224, lower wall 226, back wall 228 (conforming to the directional naming convention used with the front and back half assemblies 180 and 148, respectively) and front wall 230. Each of the walls 224, 226, 228 and 230 are preferably integral with adjacent other ones of the walls. As further shown in FIG. 5, the upper wall 224 includes a threaded bore 150 previously described herein, and adapted to threadably receive the co-threaded bolt 140 illustrated in FIGS. 1 and 2. Also situated within the upper wall 224 are a series of four apertures 232. As described in subsequent paragraphs herein, the apertures 232 are adapted to receive securing means for purposes of securing the support bracket to elements of the primary track 130. As with the upper wall 224, the lower wall 226 also includes a series of four apertures 234 adapted to receive securing means for further securing the support bracket 152 to other elements of the primary track 130. Similarly, the back wall 228 includes a series of four apertures 236, while the front wall 230 incorporates a series of four apertures 238. In addition to the primary structure 222, the support bracket 152 also includes a lower plate 240. The lower plate 240, as with each of the walls of the primary structure 222, includes a series of four apertures 242. When the lower plate 240 is appropriately positioned below the lower wall 226 of the primary structure 222, the apertures 234 of the lower wall 226 are substantially concentric with the apertures 242 of the lower plate 240. The wall 182 of the tongue 188 is squeezed between the primary structure 222 and lower plate 240 through the use of pop rivets.

In addition to the aforedescribed elements of the primary track 130, each of the main tracks 130 also includes a back bus strip 174 and a front bus strip 200, as primarily illustrated in an exploded format in FIG. 2. The bus strips 174, 200 are fabricated from extruded PVC plastic, with inserted copper strips. With reference primarily to FIG. 2, the back bus strip 174 includes an upper member 244 which terminates in a hook 246 formed by an arcuate portion of the upper member 244. Integral with and disposed downwardly from the upper member 244 is a side member 248. Longitudinally disposed along the side member 248 are a series of three spaced apart AC buses 250. The AC buses 250 are utilized to provide a continuum of electrical power along the length of the primary track 130. The AC buses 250 may carry, for example, 120 volt AC power. In accordance with the invention, the bus configuration employing the AC buses 250 permits interconnection of functional components to be electrically energized along the continuum of the primary track 130. Of course, the buses 250 may carry other voltages, or electrical power other than AC.

From the side member 248, the back bus strip 174 projects downwardly to an inwardly projecting supporting pedestal 252. The supporting pedestal 252 mates with the corresponding supporting pedestal 172 of the secondary bracket 166 of back half assembly 148. However, the structural design also provides functionality in that the inward projection of the supporting pedestal 252 provides a physical separation barrier for insuring isolation among buses carrying different voltages or circuits.

In accordance with another aspect of the invention, the back bus strip 174 may also incorporate low voltage DC/communication buses. More specifically, depending outwardly and downwardly from the supporting pedestal 252 is a lower member 254. The lower member 254 is integral with the supporting pedestal 252 and carries a pair of low voltage, DC/communication buses 256 longitudinally along the length of the back bus strip 174. In accordance with one aspect of the invention, the low voltage, DC/communication buses 256 may be employed to provide low voltage, DC power and/or communication signals to a variety of functional components. In this regard, it should be emphasized that the rail system 100 in accordance with the invention may be employed to provide not only electrical power to conventional, electrically energized devices such as lights and the like, but may also be employed to provide communication signals to apparatus associated with the same devices. As an example, and as described in the commonly assigned U.S. Provisional Patent Application Ser. No. 60/374,012, filed Apr. 19, 2002, control relationships between switches and lights may be reconfigured in a "real time" fashion. In this regard, lighting devices may have programmable controllers, memories or other associated apparatus controlled by communication signals. The rail system 100 in accordance with the invention provides a convenient means for transmitting and receiving these communication signals from devices which may be physically located along a continuum of the primary tracks 130 of the rail system 100.

Returning to the structure of the back bus strip 174, the lower member 254 terminates in an upwardly projecting hook 258. In addition to the back bus strip 174, the primary track 130 also includes the front bus strip 200, again as shown primarily in FIG. 2. The front bus strip 200 has a structural configuration substantially conforming to a "mirror image" of the back bus strip 174. More specifically, and with reference primarily to FIG. 2, the front bus strip 200 includes an upper member 260, terminating in a downwardly projecting hook 262. The upper member 260 is integral with a downwardly projecting side member 264. As with the back bus strip 174, the front bus strip 200 includes a series of three AC buses 266 extending longitudinally along the length of the side member 264. As with the AC buses 250, the AC buses 266 may, for example, carry 120 volt AC.

Extending downwardly from the side member 264 and integral therewith is an inwardly projecting supporting pedestal 268. The supporting pedestal 268 is a mirror image of and functions the same as the supporting pedestal 252. Extending downwardly from the side member 264 and integral therewith is a downwardly projecting lower member 270. As with the lower member 254 of the back bus strip 174, the lower member 270 of the front bus strip 200 may carry a pair of low voltage, DC and/or communication buses 272. The low voltage, DC/communication buses 272 may be operable to carry low voltage or DC signals for purposes of energizing certain functional components or, alternatively, may also carry communication signals for purposes of facilitating control of various functional components. The lower member 270 terminates in an upwardly projecting hook 274, similar in structure to the hook 258 of the back bus strip 174.

In accordance with the foregoing description, the assembly of certain components of a primary track 130 of the rail system 100 will now be described. Referring primarily to FIGS. 2, 5, 6, and 9, the back half assembly 148 and the front half assembly 180 may be brought together correspondingly with a support bracket 152. The support bracket 152 can be positioned at one end of a front half assembly 180, primarily as shown in FIG. 9. In this configuration, the upper member 182 of the front half assembly 180 can be positioned intermediate the lower wall 226 of the primary structure and the lower plate 240. This configuration is also illustrated in FIGS. 1 and 2. With this configuration, pop rivets (not shown) or the like may be inserted through apertures (also not shown) in the upper member 182, and extended through apertures 234 of the lower wall 226 and the apertures 242 of the lower plate 240. In this manner, the front half assembly 180 is secured to the support bracket 152 at one of its ends. A similar interconnection may be utilized at an opposing end of the front half assembly 180. As an example of a physical realization, the interconnections may be spaced along the front half assembly 180 at, for example, no more than 60 inches apart. As illustrated in FIG. 9, the support bracket 152 is positioned so that only two of the apertures 242 and 234 are utilized with the support bracket 152 for interconnection to the upper member 182 of one section of the front half assembly 180. The remaining apertures 234 and 242 of the same support bracket 152 will be utilized for interconnection to an adjacent section of the front half assembly 180.

With the front half assembly 180 in place, the back half assembly 148 can be positioned so that it extends around at least a portion of the support bracket 152 in a configuration as primarily shown in FIG. 1. In this configuration, apertures (not shown) in the upper member 154 of the back half assembly 148 may be positioned so as to be concentric with at least a pair of the apertures 232 associated with the upper wall 224 of the primary structure 222. The upper member 154 can be secured through pop rivets 276 (as shown in FIG. 2) or similar connecting or securing means, for purposes of rigidly securing the back half assembly 148 to a support bracket 152. As shown in FIG. 1, with this configuration, the supporting pedestal 162 of the back half assembly 148 is positioned at one end and below the upper member 182 of the front half assembly 180. For purposes of further securing the back half assembly 148 to the support bracket 152, pop rivets 278 may be received through apertures (not shown) in the side member 160 of the back half assembly 148, and then further through apertures 236 (as shown in FIG. 5) of the back wall 228. With the foregoing interconnection, the back half assembly 148 is rigidly secured to a support bracket 152.

As shown in FIG. 9, when a support bracket 152 is utilized at the end of one section of the back half assembly 148, pop rivets 278 are received through only two of the apertures 236 in the back wall 228 of the support bracket 152. The other two apertures 236 are utilized to receive pop rivets which will secure an adjacent section of the back half assembly 148 to the support bracket 152.

The back bus strip 174 and the front bus strip 200 can then be secured to the back half assembly 148 and the front half assembly 180, respectively. In fact, however, for purposes of facilitation of assembly, the bus strips 174 and 200 may be positioned and secured to the assemblies 148 and 180, respectively, before the assemblies 148 and 180 are actually assembled More specifically, and primarily with reference to FIGS. 1, 2, and 9, the back bus strip 174 can be positioned so as to structurally "mate" with the vertical member 170 of the back half assembly 148. With this structural mating, the hook 246 at the upper end of the back bus strip 174 is positioned so as to engage the upper member 168 of the secondary bracket 166 associated with the back half assembly 148. Correspondingly, the hook 258 which is located at the terminating lower end of the back bus strip 174 is made to engage a downwardly depending lower member 280 of the secondary bracket 166 of the back half assembly 148. To provide for this interconnection, the secondary bracket 166 and the back bus strip 174 are manufactured with at least some minimal resiliency so as to appropriately engage the bracket 166 with the bus strip 174. This structural interconnection is shown in several views of the drawings, including FIGS. I and 9.

As with the back bus strip 174, the front bus strip 200 is structurally "mated" with the secondary bracket 190 of the front half assembly 180. Also as with the back bus strip 174, the front bus strip 200 includes a hook 262 which is made to engage an upper end of the upper member 192 of the secondary bracket 190 associated with the front half assembly 180. Correspondingly, the hook 274 located at the terminating lower end of the front bus strip 200 hooks around and engages the terminating end of a lower member 282 of the secondary bracket 190 associated with the front half assembly 180. In this manner, the front bus strip 200 is secured to the front half assembly 180.

For purposes of further securing together the elements of the primary track 130, the supporting pedestals 172 and 252 of the secondary bracket 166 of the back half assembly 148 and the back bus strip 174, respectively, may include apertures (not shown) extending there-through, so as to be concentric with one another when the secondary bracket 166 is structurally mated with the back bus strip 174. Although the apertures are not shown, the axis line X in FIG. 2 represents the general location of a central axis for the apertures. Correspondingly, a set of apertures (not shown) may extend through the central portions of the supporting pedestals 268 and 198 of the front bus strip 200 and the secondary bracket 190 of the front half assembly 180, respectively.

To more rigidly secure together the elements of the primary track 130, a bolt 284, with a conventional hex nut 286, may be received within the apertures of the supporting pedestals 172, 252, 268 and 198. These bolts 284 and nuts 286 may be spaced periodically along the length of the back half assembly 148 and front half assembly 180. To insure separation between these supporting pedestals 252 and 268, and so as to further insure that the back half assembly 148 and front half assembly 180 are not too tightly secured together so as to cause damage, a sleeve 288 (as also shown in FIG. 2) may be received on the threaded shaft of the bolt 284. In addition to securing the back half assembly 148 to the front half assembly 180, the bolt 284 and nut 286 can also be utilized to removably secure power connectors 340 to the primary track 130. This concept is described in subsequent paragraphs herein.

After the back half assembly 148 and front half assembly 180 are appropriately interconnected, the cover assembly 202 may be set in place. More specifically, and as primarily shown in FIG. 1, the cover assembly 202 may be mounted to the front side of the primary track 130 so that the tongue 206 of the upper portion 204 will engage the tongue 158 of the end 156 of upper member 154 associated with the back half assembly 148. Correspondingly, the lower shoe 210 of the cover assembly 202 may be resiliently secured under the lip 184 of the front half assembly 180. Again, this configuration is primarily shown in FIG. 1. In this manner, the cover, assembly 202 may be flexibly and removably secured to the back half assembly 148 and the front half assembly 180. This structural interconnection is primarily shown in FIGS. 1 and 6. To more rigidly secure the cover assembly 202 to the back half assembly 148 and front half assembly 180, and as previously described with respect to FIG. 9, the cover assembly 202 includes a series of apertures 212 spaced apart along the length of the front portion 208 of the cover assembly 202. The screws or other threaded fasteners 214 can be received through the apertures 212 and then through the apertures 238 and the front wall 230 of support bracket 152, for purposes of securing the cover assembly 202 to the support bracket 152. It should also be noted that, with partial reference to FIG. 9, an elongated section of the cover assembly 202 may have one end connected through only two of the apertures 238 of the front wall 222 of support bracket 252. The remaining two apertures in front wall 222 may be utilized to receive screws received through apertures 212 of an adjacent section of the cover assembly 202. The enclosure formed when cover assembly 202 is assembled creates a wireway for AC wires to be passed through, as described in subsequent paragraphs herein.

As previously described primarily with respect to FIGS. 1, 2 and 5, the co-threaded bolt 140 may be interconnected to the primary track 130 by threadably receiving the lower end of the co-threaded bolt 140 through the threaded bore 150 associated with the support bracket 152. In addition to being received through the threaded bore 150, apertures (not shown) may be appropriately spaced apart along the length of the upper member 154 of the back half assembly 148. The back half assembly 148 can be positioned so that these apertures in the upper member 154 are positioned concentric with at least a pair of the apertures 232 located in the upper wall of the support bracket 152, as shown in FIG. 5. The pop rivets 276 can then be received through the apertures of the upper member 154 and the apertures 232 of the support bracket 152.

With the foregoing assembly, the primary track 130 provides a means for supplying electrical power and for receiving/transmitting communication signals along a continuum of an overhead infrastructure. Positioning of functional components requiring electrical power or otherwise operating through the use of data communications and signaling may therefore be physically reconfigured and repositioned throughout a commercial interior, without the need of substantial disassembly and reassembly of an infrastructure.

Figure 4:
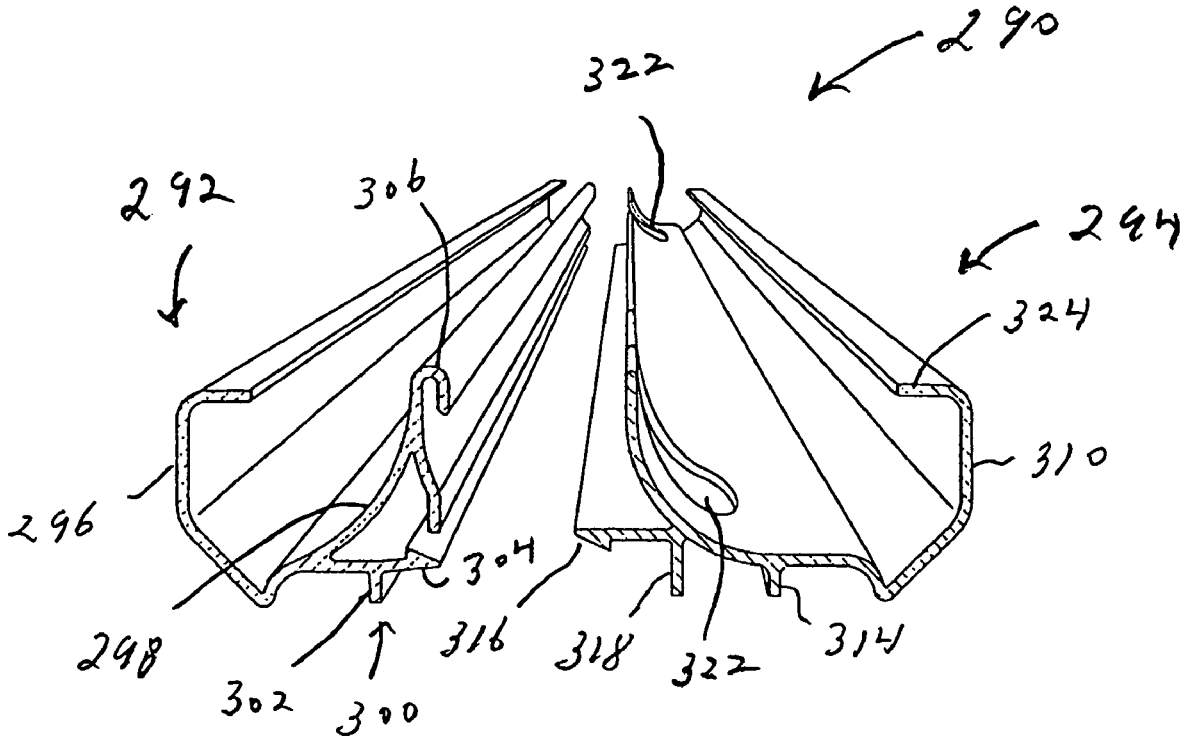
FIG. 4 is a perspective view of one embodiment of cable trays which may be utilized with the rail system in accordance with the invention.

Other infrastructure components may be employed with the rail system 100 in accordance with the invention. As an example, and with reference primarily to FIGS. 1, 2 and 4, the rail system 100 may include a pair of cable trays 290. The cable trays 290 can comprise a back cable tray 292 and a front cable tray 294. The back cable tray 292 can include a rear portion 296 having an arcuate shape as shown in FIGS. 1, 2 and 4. The rear portion 296 can extend downwardly and is integral with a forward portion 298 having a curved configuration, as also shown in FIGS. 1, 2 and 4. A brace 300 extends forwardly from the back of the lower part of the forward portion 298. The brace includes a support 302 and a beveled ledge 304, having the configurations shown in FIGS. 1, 2 and 4. The forward portion 298 extends upwardly so as to form a downwardly projecting hook 306 at its termination. A secondary support extends downwardly from the rear of the forward portion 298.

The front cable tray 294 comprises a forward portion 310 which is somewhat of a mirror image of the rear portion 296 of the back cable tray 292. The forward portion 310 is integral with, at its lower end, a rear portion 312 having an arcuate or curved configuration. The rear portion 312 includes a vertically disposed support 314 and a brace 316. The brace 316 comprises a downwardly extending support 318, and an undercut beveled ledge 320. In addition, to the foregoing, and as illustrated in FIG. 4, the front cable tray 294 includes, at its rear portion 312, a series of spaced apart and arcuate slots 322.

In assembly of the cable trays 290 with the primary track 130, the front cable tray 294 can be positioned so that the co-threaded bolts 140 utilized with the primary track 130 are received through the arcuate slots 322. This configuration is primarily shown in FIG. 1. The cable trays 290 are then assembled together as also primarily shown in FIG. 1 . More specifically, the upper end of the rear portion 312 of the front cable tray 294 is releasably secured within the hook 306 of the back cable tray 292. Correspondingly, the beveled ledge 304 of the back cable tray 292 is interlocked with the undercut beveled ledge 320 of the front cable tray 294. The supports 302 of back cable tray 292 and 314, 318 of front cable tray 294 then rest upon the upper member 154 of the back half assembly 148. The cable trays 290 can be utilized for various functions associated with the rail system 100. For example, as illustrated in FIGS. 1 and 2, the cable trays 290 are employed to carry data cables 324 along the lengths of the primary tracks 130. Two other aspects of the cable trays 290 should be mentioned. First, instead of carrying the data cables 324, it would be possible for the cable trays 290 to carry rigid conduit, especially in situations where electrical codes are relatively strict. Further, because the cable trays 290 essentially comprise a two-sided tray, this configuration provides an opportunity for a separation of various cables or the like, where distortion or other harmful effects may occur as a result of various cables being adjacent to each other.

In accordance with the foregoing, the rail system 100 in accordance with the invention, comprising the cable trays 290, provide a means for efficiently and reconfigurably carrying low voltage, electrical, data or communication cables throughout the infrastructure of the rail system 100. As apparent to the reader, the specific structural configuration of the cable trays 290 may be modified, without departing from the spirit and scope of the principal concepts of the invention. The particular structure shown herein for the cable trays 290 provides an efficient and relatively simple means for supporting the cable trays 290 within the infrastructure of the rail system 100.

In addition to the means for carrying and providing electrical power, data and communication signaling as described in prior paragraphs herein, the rail system 100 also includes an additional means for carrying desired power, data or other communications signaling. With reference first to FIG. 6, showing the structure of the primary track 130 comprised by the back half assembly 148, front half assembly 180 and cover assembly 202, an upper chamber or raceway 326 is formed, as also shown in FIG. 6. The upper chamber 326 is enclosed and substantially isolated from the cable trays 290, back bus strip 174 and front bus strip 200. Accordingly, the upper chamber 326 provides an isolated location for carrying cabling or conduit which may be of relatively high voltage. For example, the upper raceway 326 may carry, as illustrated in FIG. 1, 277 volt AC cables 328. Other types of relatively high voltage or other power/communications conduit requiring substantial isolation may also be carried within the upper raceway 326.

An example of "tapping in" to the 277 volt AC cables 328 is illustrated in FIG. 9. The primary elements illustrated in FIG. 9 were previously described herein, and will not be described in any particularly greater detail. As shown in FIG. 9, wires 330 of an electrical cable 218 are tapped into the 277 volt AC cables 328 through the connectors 332. As previously described herein, the electrical cable 218 extends through a knockout 216 within the cover assembly 202. With the knockouts 216 appropriately spaced along the length of the cover assembly 202, power taps can be conveniently provided along the length of the 277 volt AC cables 328 within the upper raceway 326. In accordance with the foregoing, the rail system 100 in accordance with the invention provides a means for safely and efficiently carrying high voltage cabling, while further providing a configuration permitting the user to tap into the cabling at spaced apart intervals along the primary track 130.

In addition to the foregoing elements, the rail system 100 in accordance with the invention can include means for tapping into the back bus strip 174 and front bus strip 200 along a continuum of the bus strips, To provide this function, and as illustrated primarily in FIGS. 1, 2, 8A and 9, the rail system 100 in accordance with the invention can comprise a power connector 340. It should be emphasized that the rail system 100 in accordance with the invention is not limited to the particular power connector 340 described in subsequent paragraphs herein. That is, various structures of power connectors may be utilized to tap into the bus strips 174, 200, without departing from the principal novel concepts of the invention. Turning to the drawings, the power connector 340 can have a structural configuration as primarily shown in FIG. 8A. The power connector 340 comprises an upper chamber 342 having bores 344 projecting outwardly in diametrically opposed directions. Projecting from the bores 344 is a series of AC circuit taps 346. Although not shown in the drawings, the AC circuit taps 346 can be electrically connected within the upper cylinder 342 to AC connectors or wires extending downwardly from the upper cylinder 342. These AC connectors or wires are represented by the AC conduit 348 extending outwardly from the bottom of the power connector 340. The AC circuit taps 346 can be connected in any conventional manner within the upper cylinder 342 to electrical circuits or connectors which, in turn, are connected to wires within the AC conduit 348, as shown in FIG. 9. The AC circuit taps 346 may be connected, again in a conventional manner, to completely separate and distinguishable AC circuits or, alternatively, certain of the AC circuit taps 346 may be connected to the same AC circuit.

Depending downwardly from the upper cylinder 342 is an interconnecting chamber 350. The interconnecting chamber 350 is preferably of a relatively smaller diameter than the diameter of the upper cylinder 342. Depending downwardly from the interconnecting chamber 350 is a lower cylinder 352. The lower cylinder 352 includes two pairs of diametrically opposed bores 354. Extending outwardly from the bores 354 are low voltage, DC/communications taps 356. The taps 356 are interconnected, within the lower cylinder 352, to low voltage, DC/communication connectors or wiring (not shown). The interconnections within the lower cylinder 352 can be made in a conventional and well-known manner, and resultant low voltage, DC or communication signals can be represented by the cable 358, as shown in FIG. 9. As apparent to those skilled in the art, the AC conduit 348 and the cable 358 may actually comprise multiple conduits and cables. Further, the taps 356 may be each connected to separate circuits or communication signaling apparatus or, alternatively, certain ones of the taps 356 may be connected to the same power circuits or communication paths.

The lower portion of the power connector 340 may terminate in an externally threaded sleeve 360. The AC conduit 348 and DC/communications cable 358 are received through the externally threaded sleeve 360, which is open to the lower cylinder 352, interconnecting chamber 350 and upper cylinder 342. The sleeve 360 may be externally threaded as illustrated in the drawings, for purposes of securing the power connector 340 to other desired electrical components such as junction boxes and the like.

The releasable interconnection of a power connector 340 with the primary track 130 is primarily shown in FIGS. 1, 2 and 9. More specifically, the power connector 340 can be mounted within the lower portion of the primary track 130 in a manner such that the upper cylinder 342 is positioned adjacent the AC buses 250 associated with the back bus strip 174 and the front bus strip 200. As shown expressly in FIGS. 1 and 9, the upper cylinder 342 is configured so that it is somewhat supported on the supporting pedestals 252 and 268 of the bus strips 174, 200, respectively, and with the AC circuit taps 346 mechanically and electrically abutting the AC buses 250, so as to provide appropriate electrical connections therebetween. For purposes of securing appropriate interconnection, the AC circuit taps 346 may be spring-loaded so as to be biased against the AC buses 250.

With this configuration, the interconnecting chamber 350 is positioned intermediate the supporting pedestals 252 and 268 of bus strips 174, 200, respectively. The lower cylinder 352 is positioned intermediate the buses 256 associated with the back bus strip 174 and the buses 272 associated with the front bus strip 200. The power connector 340 and its lower cylinder 352 are sized and configured so that with the power connector 340 in the position shown in FIGS. 1 and 9, the taps 356 mechanically and electrically abut the buses 256 and 272. Again, for purposes of insuring appropriate electrical interconnection, the taps 356 may be spring-loaded within the lower cylinder 352, so as to be biased against the buses 256 and 272.

With respect to the interconnection of the power connector 340 within the primary track 130, the power connector 340 can be appropriately positioned anywhere along a continuum of the bus strips 174 and 200. However, if the power connectors 340 are to be more fixedly secured to the bus strips 174, 200, the power connectors 340 may include a bore (not shown) through the interconnecting chamber 350 of the power connector 340. The power connector 340 may then be positioned so that the bore within the interconnecting chamber 350 is concentric with apertures (not shown) extending through the supporting pedestals 172, 252, 268 and 198 of the supporting brackets and bus strips, as illustrated in FIG. 2. As an example, the bolt 284 may be received through all of the apertures and through the bore within the interconnecting chamber 350 of the power connector 340. In this manner, the power connector 340 may be more rigidly secured to the primary track 130.

As set forth in prior paragraphs, the power connector 340 provides a means for tapping into electrical power, data signals and communication signaling along a continuum of the primary track 130. Further, with the particular configuration of the power connector 340 as illustrated in FIGS. 1 and 9, and with the sizing and configuration of the supporting pedestals 252 and 268 of bus strips 174, 200, respectively, it is difficult to accidentally lower or raise the power connector 340 in a manner such that AC circuit taps would inadvertently abut the low voltage, DC/communication bus strips or, alternatively, the taps 356 would inadvertently touch the AC bus strips 250 and 266. With this particular structure, the power connector 340 provides means for insuring safety and mechanically and electrically isolating AC power from DC power and communications signals.

With an overhead rail system infrastructure as described herein, the present invention is concerned with many principles, including structural integrity, while maintaining an acceptable weight. To accomplish these structural advantages, it has been discovered that "staggering" certain elements of the primary track enhance the structural integrity, without requiring elements such as strengthening ribs or the like, which increase weight. Due to the length of buildings, it is not practical to pre-assemble long lengths of track, and ship them fully assembled. Accordingly, this problem necessitates assembly of the tracks within the commercial interior.

Figures 10, 10A:
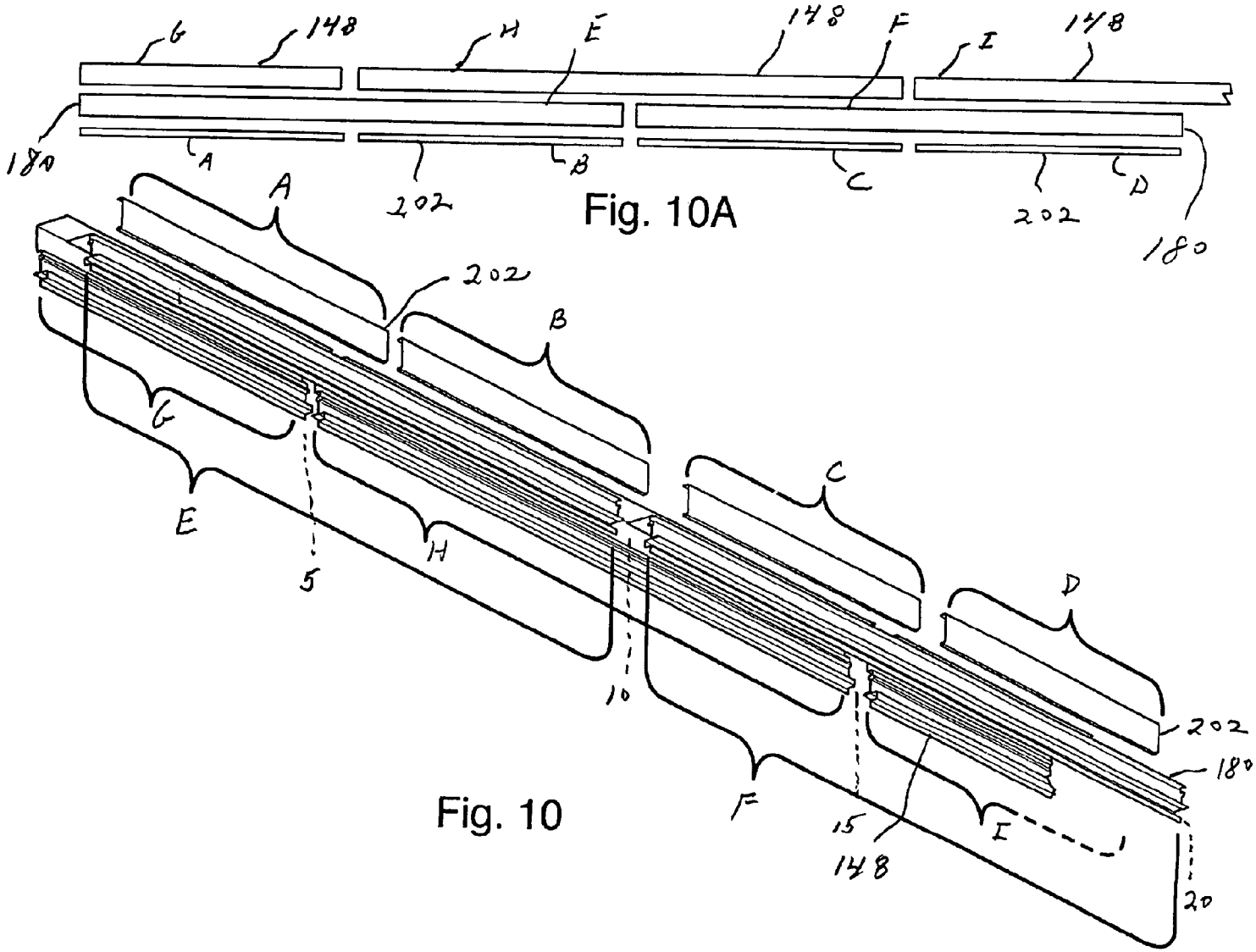
FIG. 10 is a partially perspective and exploded view of the primary track, illustrating the staggering of track elements in accordance with the invention, for purposes of providing relatively greater strength and rigidity.
FIG. 10A is a diagrammatic illustration of the staggered components of the primary track illustrated in FIG. 10, further clarifying the staggering of the components in accordance with the invention.

The principles of this staggering arrangement are illustrated in FIG. 10, and in the diagrammatic illustration of FIG. 10A. The elements within FIGS. 10 and 10A are also illustrated in FIG. 6. Returning to FIG. 10 and referring to the left side of the page on which FIG. 10A is illustrated, a first section of the back half assembly 148 is shown in position and labeled as Section G. Solely for purposes of illustration and description, Section G for the back half assembly 148 may be presumed to have a length of approximately five feet. Although example lengths of sections of the elements of the primary track 130 will be presumed within this description, it should be emphasized that none of these lengths should be considered as limiting elements of the invention. That is, without departing from the spirit and scope of the staggering concept in accordance with the invention, various lengths of sections of portions of the primary track 130 may be utilized.

Referring back to Section G, and presuming that the section is approximately five feet in length, one of the support brackets 152 (not shown in FIG. 10) may be utilized at the left end of Section G for purposes of interconnection of the back half assembly 148. Correspondingly, a second support bracket 152 may be utilized at the opposing end of Section G. This other support bracket 152 may be used, as hereinbefore described, to interconnect Section G of the back half assembly 148 with Section H of the back half assembly 148. However, unlike Section G, which is five feet in length, Section H may be ten feet in length. The support bracket 152 connected to the right side of Section G will interconnect Section H to Section G. Correspondingly, the right side of Section H of the back half assembly 148 will be connected to the left side of Section I of the back half assembly 148. Again, a support bracket 152 will be utilized for this interconnection of adjacent Sections H and I. For purposes of the staggering configuration, Section I of the back half assembly 148 and other sections of back half assembly 148 located to the right of Section I will each be ten feet in length.

Continuing to refer to FIGS. 10 and 10A, the front half assembly 180 located on the left side of the structure illustrated in FIG. 10 is designated as Section E. Section E, in this particular example, will be approximately ten feet in length. Section E of the front half assembly 180 will be interconnected to an adjacent one of the front half assemblies 180 through a support bracket 152. With respect to the sections of the front half assembly 180, each of these sections, including Sections E and F illustrated in FIG. 10, will each be ten feet in length.

With the foregoing example, the effect of the staggering relationship is readily understood as illustrated in diagrammatic form in FIG. 10A. In this configuration, a support bracket 152 is utilized to interconnect adjacent Sections A and B of the cover assembly 202. This same support bracket 152 will also be utilized to interconnect Sections G and H of the back half assembly 148. However, at this interconnection location, the front half assembly includes Section E, which is continuous through the interconnection locations of Sections A, B and Sections G, H of cover assembly 202 and back half assembly 148, respectively. Correspondingly, and continuing to refer to FIG. 10A, Sections B and C of the cover assembly will be interconnected together by a support bracket 152 which will also interconnect adjacent Sections E and F of the front half assembly 180. However, at this interconnection location, Section H of the back half assembly 148 is continuous.

Still further, Section C of the cover assembly 202 and Section D of the cover assembly 202 are also interconnected together at their ends with a support bracket 152. At this same interconnection location, Sections H and I of back half assembly 148 are also interconnected by the same support bracket 152. However, at this interconnection location, Section F of the front half assembly 180 is continuous in structure. In accordance with the foregoing, it is apparent that the longitudinal interconnection locations of sections of the back half assembly 148 will be staggered relative to the longitudinal interconnection locations of sections of the front half assembly 180. This staggered interconnection relationship provides additional strength and rigidity to the entire structure of the primary track 130, without requiring additional strengthening components, which may add weight and expense to the rail system 100. Also, it is evident that specific lengths of the sections of the back half assembly 148 and front half assembly 180 are not expressly required. That is, other lengths of the sections of the back half assembly 148 and front half assembly 180 may be utilized in the staggered relationship, without departing from the spirit and scope of the novel concepts of the invention.

Figure 11:
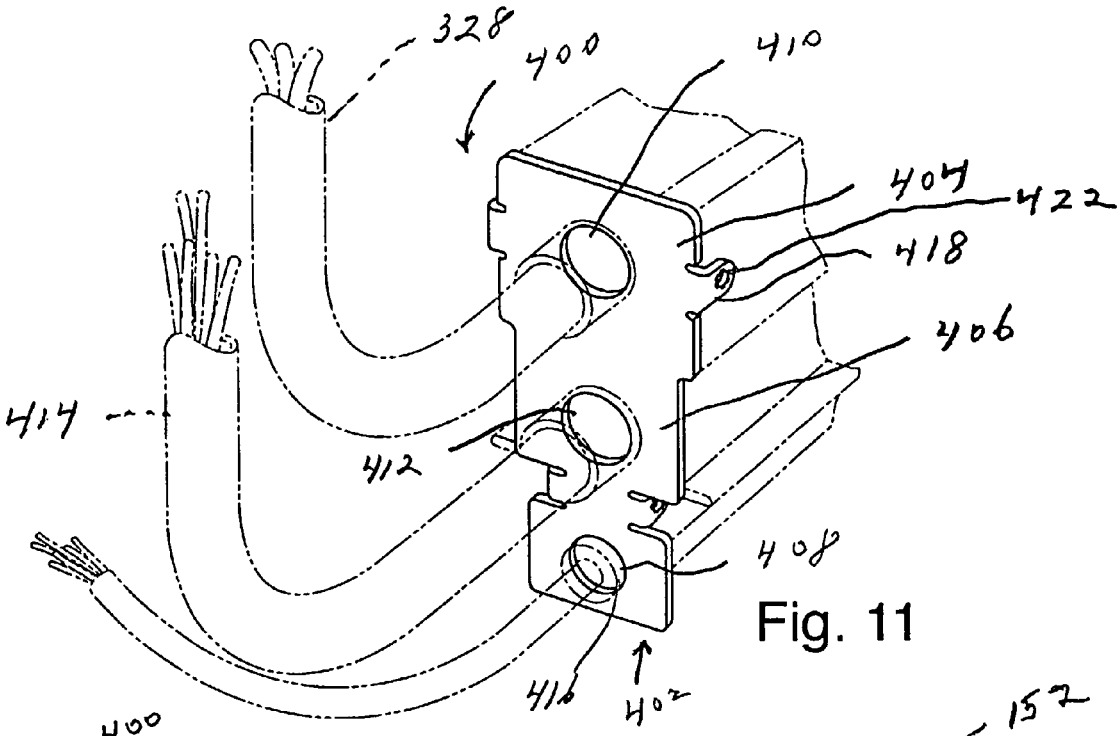
FIG. 11 illustrates an exemplary use of the primary track cap in accordance with the invention, and further illustrating the interconnection of the primary track cap with the primary track and electrical conduit (shown in phantom format)
Figure 12:
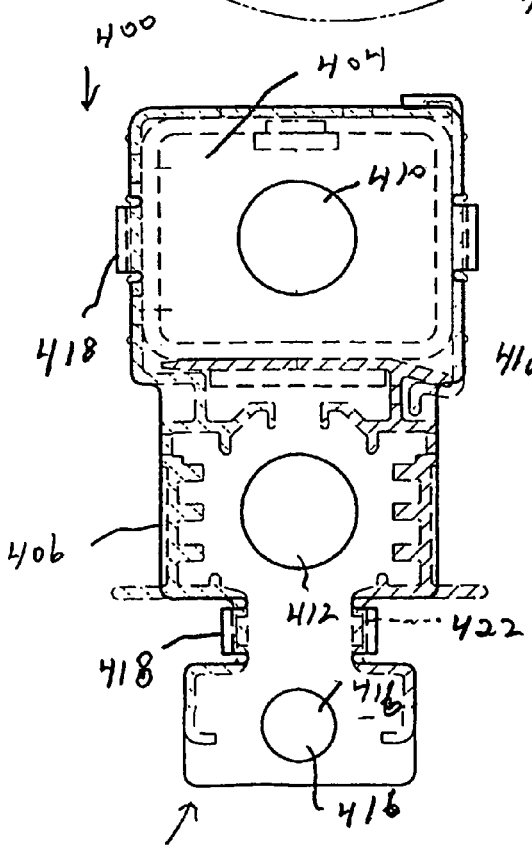
FIG. 12 is an end view of the primary track cap in accordance with the invention.
Figure 13:
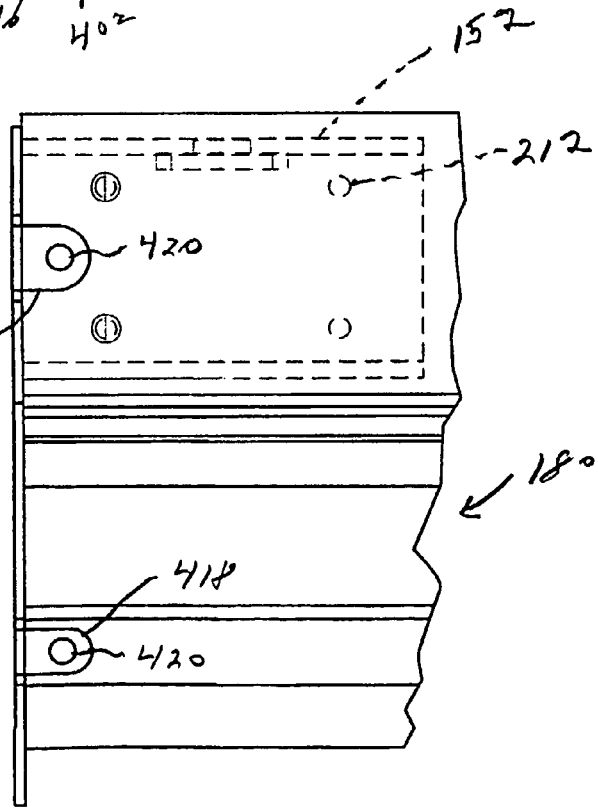
FIG. 13 is a side elevation view of the primary track cap illustrated in FIGS. 11 and 12.

The rail system 100 can also include additional components for purposes of providing appropriate structure and function for its electrical and communication signaling components. As an example, the rail system 100 in accordance with the invention may include primary track caps for purposes of appropriately enclosing ends of the primary track 130, while still permitting access to electrical power and communications. Such a structure is illustrated as primary track cap 400 as shown in FIGS. 11, 12 and 13. In prior description with respect to the power connector 340 and FIG. 9, it was described and illustrated as to how electrical power conduits and communication signaling cables could access the bus strips 174 and 200, and be extended downwardly through the power connector 340. Also, in FIG. 9 and the description associated therewith, explanation was given as to how the electrical cable 218 could be extended to the front of the primary track 130 through the cover assembly 202, and interconnected with the 277-volt AC cables 328. In contrast, the primary track cap 400 provides a means of not only enclosing an end of the primary track 130, but also providing a means for extending power conduits and communications cabling from the ends of the primary track 130.

More specifically, the primary track cap 400 is illustrated in FIGS. 11, 12 and 13 as connected to elements of the primary track 130, but with the elements of the primary track 130 shown in phantom line format. The primary track cap 400 includes an end plate 402 which is secured over the end of elements of the primary track 130. The end plate 402 has an upper portion 404, intermediate portion 406, and lower portion 408. The upper portion 404 has an elevational configuration as illustrated in FIG. 12, and essentially covers the raceway 326 (illustrated in FIG. 6) previously described as being formed by the cover assembly 202, back half assembly 148, and front half assembly 180. As also previously described herein, the raceway 326 acts as to carry high voltage cabling, such as the 277-volt AC cables 328 illustrated in FIG. 9. With the upper portion 404 of the end plate 402 covering the raceway 326, a port 410 is formed in the upper portion 404. The 277-volt AC cables 328 may then be extended through the port 410. In this manner, the primary track 130, with the primary track cap 400, provides a convenient means for extending power cabling through ends of the primary track 130 and in a direction corresponding to the longitudinal elongation of the primary track 130. Further, the port 410 may include appropriate bushings or similar elements so as to provide strain relief support for the cables 328 extending therethrough.

Correspondingly, the intermediate portion 406 of the end plate 402 essentially encloses the area of the primary track that is formed between the back bus strip 174 and the front bus strip 200. Like the upper portion 404, the intermediate portion 406 also includes a port 412. As earlier described, the buses 250 and 266 associated with the bus strips 147 and 200, respectively, may carry conventional 120-volt AC power. Accordingly, as desired by the user, electrical cabling may be interconnected to the buses 250, 266, either in a relatively direct manner or, alternatively, through a modified version of the power connector 340 which would permit the cabling to extend from the power connector along the length of the chamber formed by the bus strips 174, 200. With the port 412 and the intermediate portion 466, this cabling, identified as cabling 414 and shown in phantom line format, can comprise wires carrying 120-volt AC power or the like. As with port 410 and cables 328, port 412 may also include means to provide strain relief for cabling 414.

The lower portion 408 of the end plate 402 essentially covers the area located between the low voltage DC/communication buses 256. As with the intermediate portion 406 and the upper portion 404, a port 416 may be formed in the lower portion 408. Cable 358 (previously described with respect to FIG. 9) may be directly or indirectly interconnected to the buses 256, 272, and extended outwardly through the port 416 in the lower portion 408. Strain relief means may be provided with port 416 and cable 358.

For purposes of removably securing the primary track cap 400 to an end of the primary track 130, rearwardly extending tabs 418 may be formed so that a pair of tabs 418 extend rearwardly from the upper portion 404, and corresponding pairs of tabs 418 extended rearwardly from the intermediate portion 406 and the lower portion 408. The tabs 418 are formed with apertures 420, and metal screws 422 or the like may be received within the apertures 420 and extended through the cover assembly 202 and walls of the back half assembly 148 and front half assembly 180. It is apparent from the foregoing that the primary track cap 400 provides a means for enclosing an end of the primary track 130, while correspondingly providing means for extending power and signaling cables and wires outwardly through the ends of the primary track 130. These power and communication signaling cables and wires may be readily interconnected to power and communication signals on the buses of the bus strips 174 and 200. Further, the rail caps 400 provide strain relief for cables extending therethrough.

Figure 14:
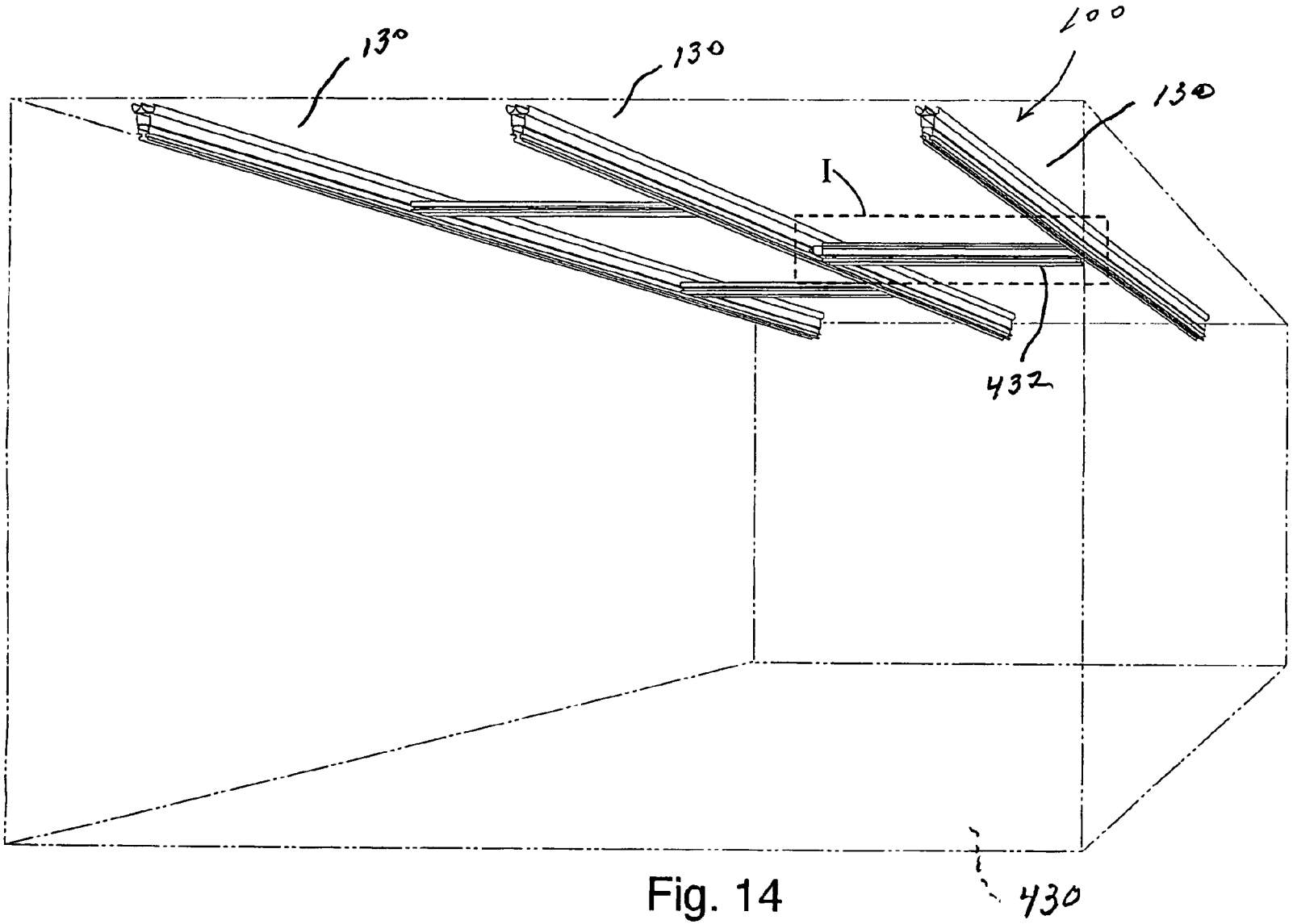
FIG. 14 is an illustration of the assembly of the rail system in accordance with the invention, showing a powered cross rail being coupled between two primary tracks, with the powered cross rail being configured so as to be substantially level with and in the same horizontal plane as the interconnected primary tracks.

The foregoing description has primarily been associated with the primary track 130 and related components. As earlier mentioned, FIG. 14 illustrates a configuration of the rail system 100 within a workspace, identified as workspace 430 and illustrated in phantom line format in FIG. 14. More specifically, the particular configuration of the rail system 100 in FIG. 14 illustrates a set of three primary tracks 130. For purpose of simplicity and clarity in description, the details of the primary tracks 130 are not shown in FIG. 14, nor are elements showing the hanging interconnection of the primary tracks 130 to the workspace 430.

Figure 15:
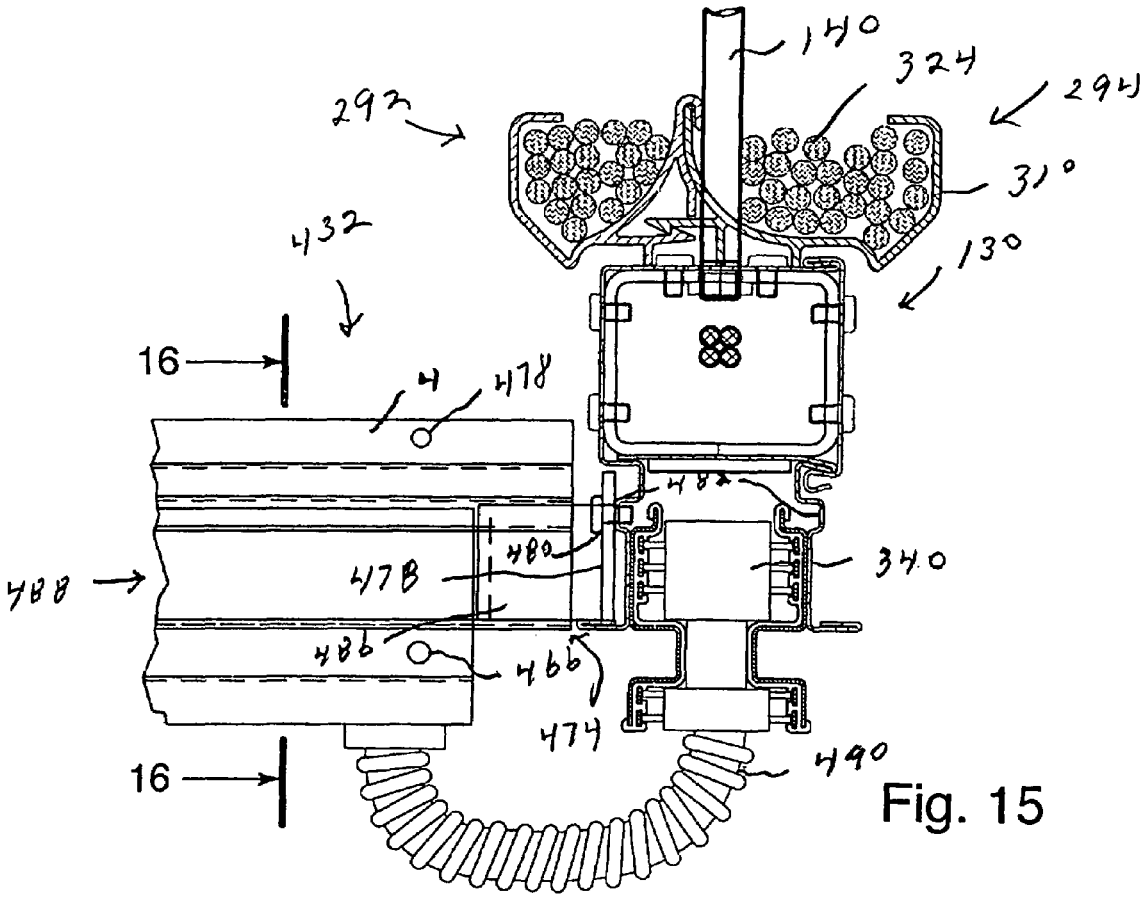
FIG. 15 is an end view of one of the primary tracks illustrated in FIG. 14, and showing in greater detail the interconnection of the powered cross rail to the primary track.
Figure 16:
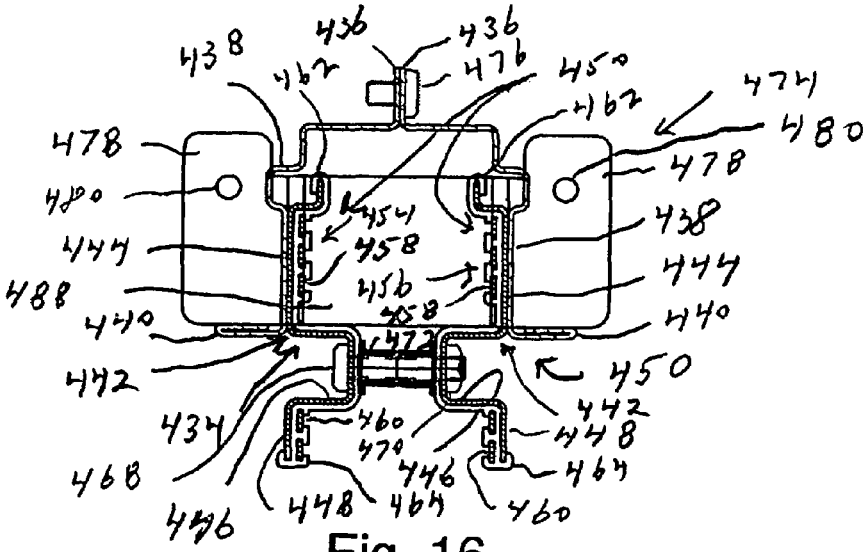
FIG. 16 is a cross sectional view of the powered cross rail illustrated in FIGS. 14 and 15, and taken along section lines 16-16 of FIG. 15.

The primary tracks 130 illustrated in FIG. 14 are preferably arranged in parallel configurations, and may also be preferably spaced apart so that each primary track 130 is equal distant from adjacent others of the primary tracks 130. The primary functions associated with the elements of the primary tracks 130 have been described in prior paragraphs herein. However, to provide even more convenience and flexibility in use and reconfiguration, the rail system 100 in accordance with the invention may also comprise a series of cross rails. The cross rails may be utilized to provide greater flexibility in positioning and reconfiguring positions of functional components to be energized, as well as providing location convenience for communication signals and the like. An example of one such cross rail in accordance with the invention is illustrated in FIG. 14 as cross rail 432. Cross rail 432 is also illustrated in greater detail in FIGS. 15 and 16, and will be described primarily with respect thereto. Further, cross rail 432 is a cross rail which may be characterized as a "powered" cross rail, in that cross rail 432 is adapted to carry electrical power and communication signaling buses longitudinally through the cross rail 432. Further, the particular description of the cross rail 432, as illustrated in FIGS. 15 and 16, represents the cross rail 432 as being interconnected to adjacent primary tracks 132 in a manner so that the cross rail 432 is characterized as being "level" with the adjacent primary tracks 130. That is, the cross rail 432 will be located within the horizontal plane defined by the two adjacent primary tracks 130. Of course, it is assumed that the two adjacent primary tracks 130 each reside in substantially the same horizontal plane.

Returning to FIGS. 15 and 16, the powered cross rail 432 includes a first half assembly 434 as shown primarily in FIG. 16. The first half assembly 434 includes an upper bracket 436 extending vertically upward as shown in FIG. 16. The upper bracket 436 is integral with a downwardly depending portion having a side wall 438. The side wall 438 terminates in a laterally projecting section 440. Connected to the side wall 438 (by weldment or otherwise) is a secondary bracket 442. An upper side wall 444 as illustrated in FIG. 16 is attached to the side wall 438. From the upper side wall 444, the secondary bracket 442 extends downwardly and forms a recessed wall 446. From the recessed wall 446, the secondary bracket 442 forms a vertically disposed and downwardly extending portion 448.

The cross rail 432 is formed by not only the first half assembly 434, but also by means of a second half assembly 450. However, unlike the back and front half assemblies of the primary track 130 as previously described herein, the first half assembly 434, when positioned so as to form the cross rail 432, is essentially a mirror image of the second half assembly 450. In fact, the second half assembly 450 can be formed by taking the first half assembly 434 and rotating the same. Accordingly, for purposes of description, like numerals will refer to like elements of the first half assembly 434 and the second half assembly 450. More specifically, the second half assembly 450 also includes an upper bracket 436, with a side wall 438 extending downwardly therefrom. Integral with and extending from the bottom portion of the side wall 438 of the second half assembly 450 is a laterally projecting section 440. A secondary bracket 442 is connected (by weldment or otherwise) to the side wall 438. More specifically, it is an upper side wall 444 of the secondary bracket 442 which is connected to the side wall 438. Extending downwardly from the upper side wall 444 is a recessed wall 446. Vertically disposed and extending downwardly from the lower portion of recessed wall 446 is a downward portion 448, integral with the recessed wall 446.

As earlier mentioned, the cross rail 432 is characterized as a "powered" cross rail. Accordingly, and with reference again primarily to FIG. 16, the cross rail 432 includes a pair of bus strips 452, comprising a first bus strip 454 associated with the first half assembly 430 and a second bus strip 456 associated with the second half assembly 450. Advantageously, the bus strips 454, 456 may have a spatial configuration similar to the bus strips 174, 200 previously described herein primarily with respect to FIG. 2. That is, each of the bus strips 452 can include a plurality (such as three shown in FIG. 16) of AC buses 458 and of low voltage, DC/communication buses 460.

For purposes of interconnection of the bus strips 452 to the first half assembly 430 and the second half assembly 450, the secondary brackets 442 have a cross sectional configuration as illustrated in FIG. 16. In a manner similar to the connection of the bus strips within the primary track 130, the bus strips 452 can be secured to the secondary brackets 442 at their upper ends through the use of hooks 462 capturing upper ends of the secondary brackets 442. Correspondingly, lower hooks 464 can be positioned below the low voltage, DC/communication buses 460, so as to capture the downward portions 448 of the secondary brackets 442. For purposes of further attachment, the recessed walls 446 of the secondary brackets 442, along with "mating" recessed walls of the bus strips 452, may include spaced apart apertures 466. The apertures 456 may be adapted to receive a bolt 468 with an attachment nut 470. So as to ensure that the first and second half assemblies 434, 450, respectively, are not damaged by over-tightening, a sleeve 472 can be received on the shaft of the bolt 468, as illustrated in FIG. 16. In addition to interconnection through the use of the bolt 468 and nut 470, pop rivets 476 or similar connecting means may be used to interconnect the first half assembly 434 and the second half assembly 450 extending through apertures 478. It is evident that other types of connecting means may also be utilized for securing together the first half and second half assemblies 434, 450, respectively.

For purposes of appropriately securing each end of the cross rail 432 to an adjacent one of the primary tracks 130, a cross rail support bracket 474 may be employed. The cross rail support bracket 474 includes a pair of opposing wing sections 478. The wing sections 478 are on opposing sides of the support bracket 474 and include apertures 480 which line up concentric with apertures 482 within a back half assembly or front half assembly of the primary track 130. The apertures 480, 482 are adapted to receive screws 484 or comparable connecting means for purposes of securing together the cross rail support bracket 474 with an adjacent primary track 130.

The cross rail support bracket 474 also includes a central section 486 which has an open box-like configuration and extends into the raceway 488 formed by the first half and second half assemblies 434, 450, respectively, of the cross rail 432. Although not expressly shown in FIGS. 15 and 16, for purposes of clarity, the sides of the central section 486 may be appropriately secured to corresponding sides of the first and second half assemblies 434, 450. Any appropriate connecting means may be utilized for this interconnection.

In accordance with the foregoing, a powered cross rail 432 is provided at a plane substantially corresponding to the plane of interconnected adjacent primary tracks 130. For purposes of transmitting power (or transmitting data or communication signals) from the bus strips associated with the primary track 130 to the corresponding bus strips associated with the cross rail 432, a power connector similar to the power connector 340 as previously described herein may be employed. With reference to FIG. 15, conduit 490 may extend downwardly from the power connector 340 and into appropriate elements (not shown) in the cross rail 432, for purposes of interconnecting the appropriate wires and cables in the conduit 490 to the appropriate buses 458, 460. Although not shown in the drawings, power connectors similar to power connector 340 may be employed within the cross rail 432. Also, it is apparent that other means for transmitting power between a primary track 130 and a cross rail 432 may be employed, without departing from the novel concepts of the invention. As earlier stated, the concept of the powered cross rail 432 provides a structural means for convenient access to power, along with data and communication signals. In addition, and in accordance with certain aspects of the invention and with the communication signals provided along the cross rail 432, means for providing programming and signaling among functional components (such as lights, switches, telecommunications, sound masking devices and the like) are also conveniently provided. In addition, not only is convenience of physical location provided, but relatively simple reconfiguration is also provided.

Figure 18:
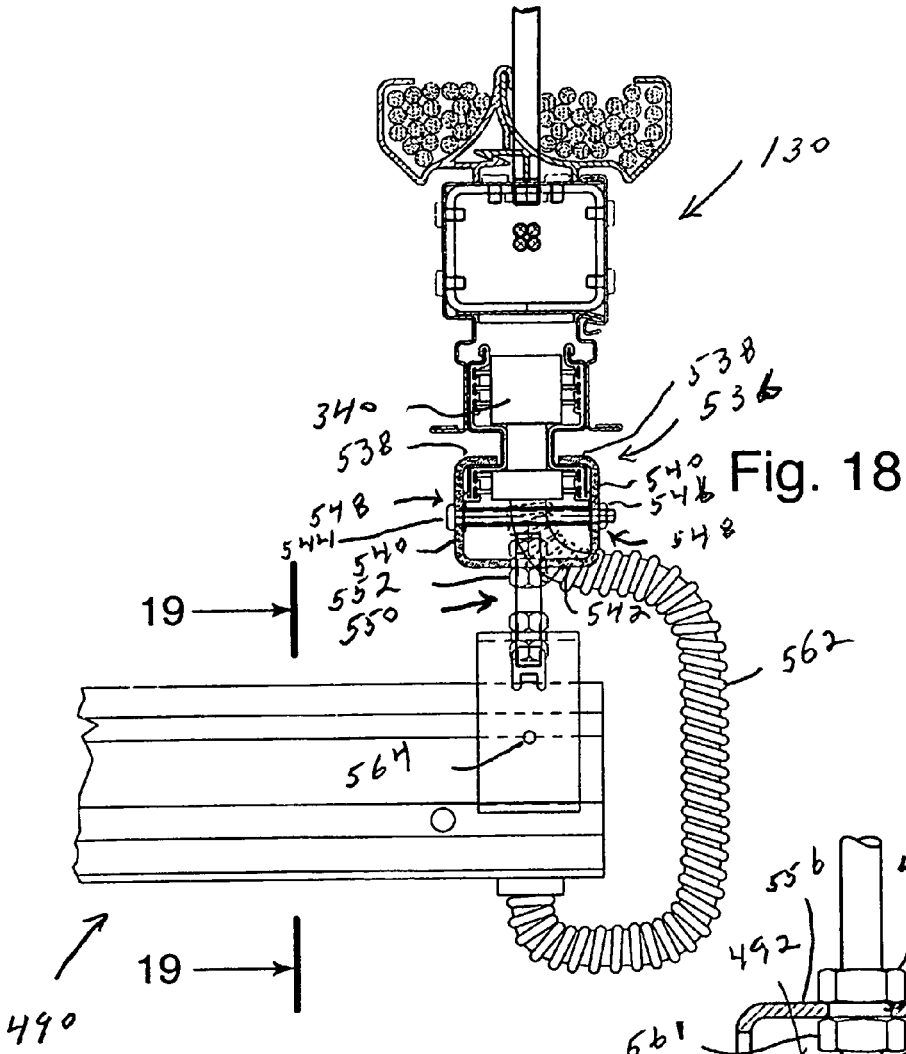
FIG. 18 is somewhat similar to FIG. 15, and comprises a cross sectional view of one of the primary tracks of FIG. 17, and illustrating in greater detail the interconnection of the cross rail to the primary track in a manner such that the cross rail is supported below the primary track.
Figure 19:
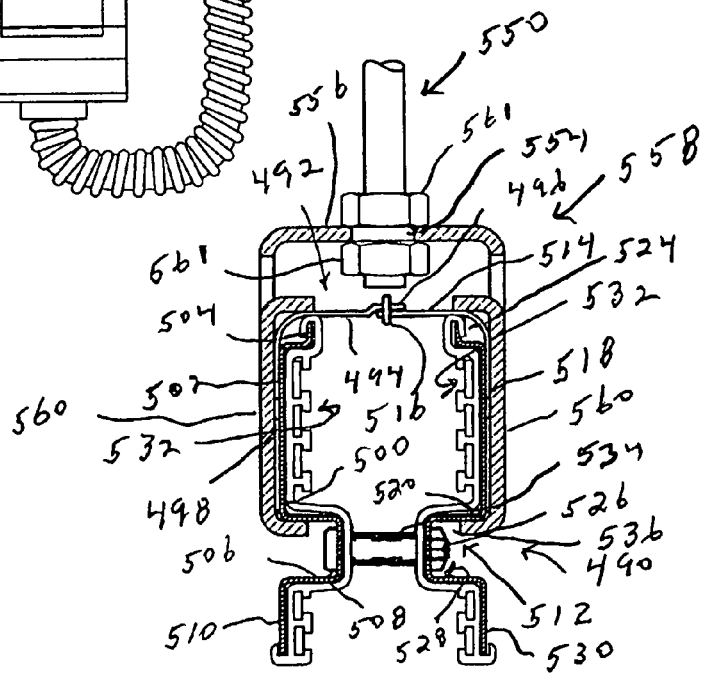
FIG. 19 is a cross sectional view longitudinally along the powered cross rail of FIGS. 17 and 18, and taken along section lines 19-19 of FIG. 18.

With the particular configuration illustrated in FIGS. 14, 15 and 16, the powered cross rail 432, as earlier stated herein, is positioned essentially within the same horizontal plane as the interconnected adjacent primary tracks 130. Accordingly, the powered cross rail 432 can be characterized as being interconnected to the adjacent primary tracks 130 in a manner so that it is "level" with the same. However, in certain situations, it may be advantageous to locate a powered cross rail at a location somewhat below the horizontal plane formed by the two interconnecting adjacent primary tracks 130. An example of such a powered cross rail suspended below the adjacent interconnecting primary tracks 130 is illustrated as the powered cross rail 490 in FIGS. 17, 18 and 19. With reference primarily to FIG. 19, the powered cross rail 490 has a structure which is similar to the previously described powered cross rail 432, but with some structural differences. More specifically, and primarily with reference to FIG. 19, the powered cross rail 490 includes a first half assembly 492. The first half assembly 492 is somewhat similar in structure to the first half assembly 434 of the powered cross rail 432. The first half assembly 492 includes a substantially horizontally disposed upper arm 494 having a hook portion 496 at its terminating end. Integral with and depending downwardly from the upper arm 494 is a side wall 498. Interconnected to the side wall 498 (by weldment or other appropriate securing means) is a secondary bracket 500. The secondary bracket 500 includes a side wall 502 having an upper finger 504 extending integrally therefrom. Integral with and depending downwardly from the side wall 502 is a recessed wall 506 through which an aperture 508 extends. The secondary bracket 500 terminates at its lower end in a vertically disposed downward portion 510.

The powered cross rail 490 also includes a second half assembly 512. As further shown in FIG. 19, the second half assembly 512 is substantially similar in structure to the first half assembly 492. More specifically, the second half assembly 512 includes an upper arm 514 extending inwardly toward the center of the cross rail 490 and terminating in a latch portion 516. The latch portion 516 can be any of a number of conventional means for interconnecting with the hook portion 496 of the first half assembly 492, so as to provide an upper interconnection between the first half and second half assemblies 492, 512, respectively. However, it should be emphasized that various coupling means could be utilized for securing the assemblies together at their upper arms 494, 514. The second half assembly 512 also includes a side wall 518 integral with and depending downwardly from the upper arm 514. Connected to the inner portion of the side wall 518 (by weldment or other appropriate securing means) is a secondary bracket 520. The secondary bracket 520 includes a side wall 522 with an upper finger 524 integral therewith. Extending downward from the side wall 522 is a recessed wall 526 having an aperture 528 extending therethrough. Integral with and depending downwardly from the recessed wall 526 is a downward portion 530.

As with the powered cross rail 432, the powered cross rail 490 can also include a pair of bus strips, identified as bus strips 532 in FIG. 19. The configuration of the bus strips 532 substantially conforms to the configuration of the bus strips 452. Accordingly, details regarding the bus strips 532 will not be repeated herein. The upper end of the bus strip 532 associated with the first half assembly 492 is interconnected to the first half assembly 492 by capturing the upper finger 504. Correspondingly, the bus strip 532 associated with the second half assembly 512 is coupled at its upper end to the second half assembly 532 by capturing the upper finger 524. At their lower ends, the bus strips 532 capture the downward portions 510 and 530 of the first half assembly 492 and the second half assembly 512, respectively. The bus strips 532 and the first and second half assemblies 492, 512, respectively, are secured together through the use of the bolt 534 and nut 536 through the apertures 508, 528. Corresponding apertures are also located within the bus strips 532 for receiving the bolt 534.

For purposes of suspending the powered cross rail 490 below the plane of the interconnected primary tracks 130, a convenient type of hanger arrangement is preferably employed. One such type of hanger arrangement is illustrated in FIGS. 18 and 19. Specifically, FIG. 19 illustrates a primary track hanger bracket 536. The main hanger bracket 536 includes inwardly extending legs 538 which essentially sit atop the supporting pedestals 172 and 198 of the primary track 130 as previously described herein with respect to FIG. 2. Integral with and depending downwardly from the legs 538 are opposing side walls 540. The side walls 540 are integral with opposing sides of a horizontally disposed bracket floor 542. After the primary track hanger bracket 536 is essentially "slipped on" to the primary track 130, a bolt 545 can be received through apertures 548 of the side walls 540, and secured with a nut 546. In this manner, the primary track hanger bracket 536 can be secured to the corresponding primary track 130, at any of a continuum of locations longitudinally along the length of the primary track 130.

For purposes of interconnecting the primary track hanger bracket 536 to the powered cross rail 490, a bolt 550, threaded at least at its upper and lower ends, is secured through an aperture in the bracket floor 542 of the primary track hanger bracket 536. The head of the bolt 550 is positioned above the bolt bracket floor 542, and the bolt extends downwardly therefrom. For purposes of rigidly securing the bolt 550 to the primary track hanger bracket 536, an upper nut 552 may be threadably received on the bolt 550. The bolt 550 depends downwardly and, at the lower end thereof, is received through an aperture 554 extending through an upper brace 556 of a cross rail securing bracket 558. The bolt 550 is rigidly secured to the cross rail securing bracket 558 by means of threadably receiving a pair of nuts 560 on opposing upper and lower sides of the upper brace 556.

Depending downwardly from the upper brace 556 are a pair of opposed clamping arms 560. The clamping arms 560 can be capable of sufficient movement so as to open the arms 560 in opposing directions, and then securing the clamping arms 560 around the outer perimeter of the powered cross rail 490. Correspondingly, each of the clamping arms 560 may include an aperture 562 (as shown in FIG. 18) through which screws or other connecting means may be utilized to more rigidly secure the clamping arms 560 to the first half and second half assemblies 492, 512, respectively, of the powered cross rail 490.

The inventors have found that the primary track holding bracket 536 and the cross rail securing bracket 558, as described with FIGS. 18 and 19, are currently ones which they believe to be somewhat preferable to certain other securing arrangements. However, it is evident that other types of bracket and securing arrangements may be utilized to releasably interconnect the powered cross rail 490 to the primary track 130, without departing from the spirit and scope of the principal concepts of the invention.

In addition to the mechanical interconnection of the powered cross rail 490 to the primary track 130, as set forth in the prior description, a conduit 562 may extend from a power connector 340 appropriately positioned in the primary track 130, and project into the powered cross rail 490 from the bottom thereof, as also shown in FIG. 18. The conduit 562 illustrates an example of how electrical power, data or communication signals may be transmitted from the cables and bus strips associated with the primary track 130 to the cables (if any) and bus strips associated with the powered cross rail 490. As earlier described with respect to the powered cross rail 432, and as illustrated in FIGS. 15 and 16, various conventional arrangements may be utilized to electrically interconnect cables and wires within conduit 562 to appropriate electrical components within the powered cross rail 490.

It is apparent from the foregoing that a powered cross rail such as powered cross rail 490 in accordance with the invention, in addition to the connecting components previously described herein with respect to FIGS. 18 and 19, provides a means for transmitting power, data and communications signaling from the primary track 130 to physical locations located below the plane of a pair of adjacent primary tracks 130, and laterally from such primary tracks 130. Still further, and as with the powered cross rail 432, the powered cross rail 490 provides a means for supplying electrical power, data and communications signaling along a continuum of the length of the powered cross rail 490.

Figure 20:
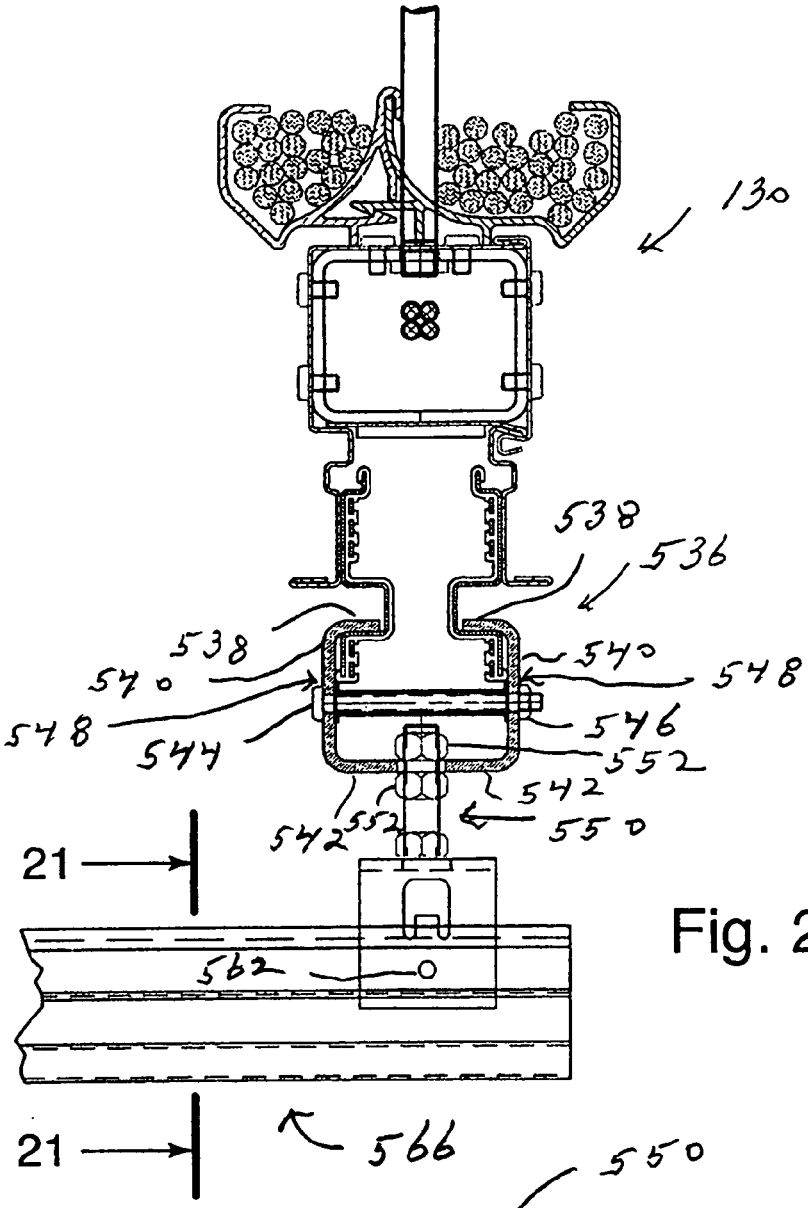
FIG. 20 is a cross sectional end view of a primary track, and illustrating the interconnection of a non-powered cross rail in a manner such that the non-powered cross rail is supported below the general plane of the primary track.
Figure 21:
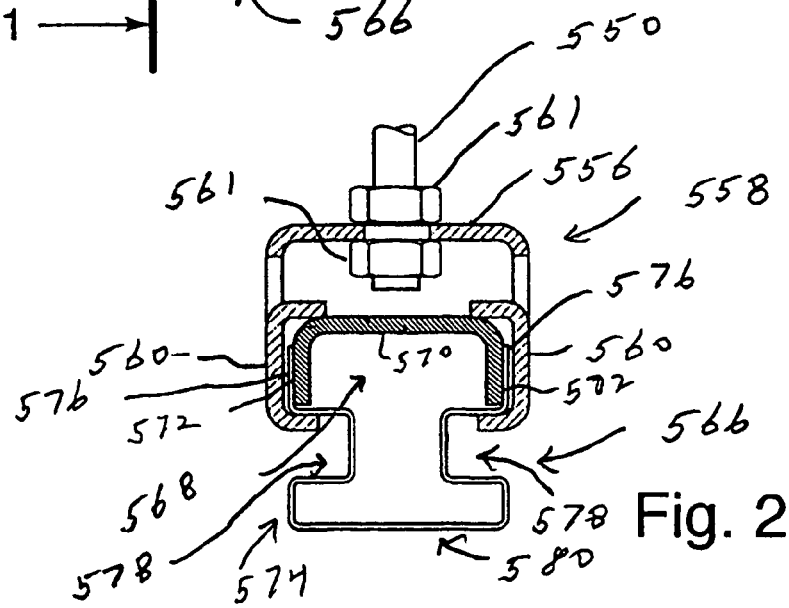
FIG. 21 is a cross sectional view taken longitudinally along the non-powered cross rail illustrated in FIG. 20, and taken along section lines 21-21 of FIG. 20.

In addition to the use of powered cross rails, such as the cross rails 432 and 490 previously described herein, the rail system 100 in accordance with the invention may also employ non-powered cross rails. Such non-powered cross rails would be utilized in situations where it is unnecessary to supply power, data or communication signals to functional components located in relatively close proximity to the cross rail. An example of such a non-powered cross rail is illustrated in FIGS. 20 and 21. With reference to these drawings, a non-powered cross rail 566 is releasably secured below a primary track 130. For purposes of supporting the cross rail 556, a primary track hanger bracket 536 (substantially corresponding to the primary track hanger bracket 536 previously described with respect to FIGS. 18 and 19), and a cross rail securing bracket 558 (substantially corresponding to the cross rail securing bracket 558 previously described with respect to FIGS. 18 and 19) are employed. In view of the substantial similarity of the primary track hanger bracket and cross rail securing bracket employed with the non-powered cross rail 556, to the primary track hanger bracket and cross rail securing bracket 536, 558, respectively, described with respect to FIGS. 18 and 19, like elements of these brackets are referenced with identical numerals, and will not be again described in detail.

Primarily referring to FIG. 21, the non-powered cross rail 566 includes an upper bracket 568 having an upper wall 570 at opposing side walls 572. A lower bracket 574 comprises the remainder of the non-powered cross rail 566. As illustrated in FIGS. 20 and 21, the lower bracket 574 includes a pair of opposing side walls 576 located externally of the side walls 572 of the upper bracket 568. The side walls 576 are attached to the side walls 572 and the upper bracket 568 by appropriate securing means, such as weldment or the like. Also, bolt/nut combinations, connecting screws or the like may also be utilized through apertures extending through portions of the clamping arms 560, side walls 572, and side walls 576. Integral with and projecting downwardly from the side walls 576 are opposing recessed portions 578 which project inwardly of the non-powered cross rail 566. Extending downwardly from and integral with the recessed portions 578 is a lower foot 580 having the cross structural configuration illustrated in FIG. 21. With this structural configuration, the upper bracket 568 is in the form of an inverted U-shaped configuration, with the lower bracket 574 attached to and projecting downwardly from the upper bracket 568.

In accordance with the foregoing, the non-powered cross rail 566 in accordance with the invention provides a means for facilitating connection of non-powered functional components to the rail system 100, at locations intermediate adjacent ones of the primary tracks 130. Although a specific structural configuration has been described as an exemplary embodiment in FIGS. 20 and 21, in the form of non-powered cross rail 566, it is evident that other structures could be employed for providing the non-powered cross rail 566, without departing from the primary novel concepts of the invention.

Figure 17:
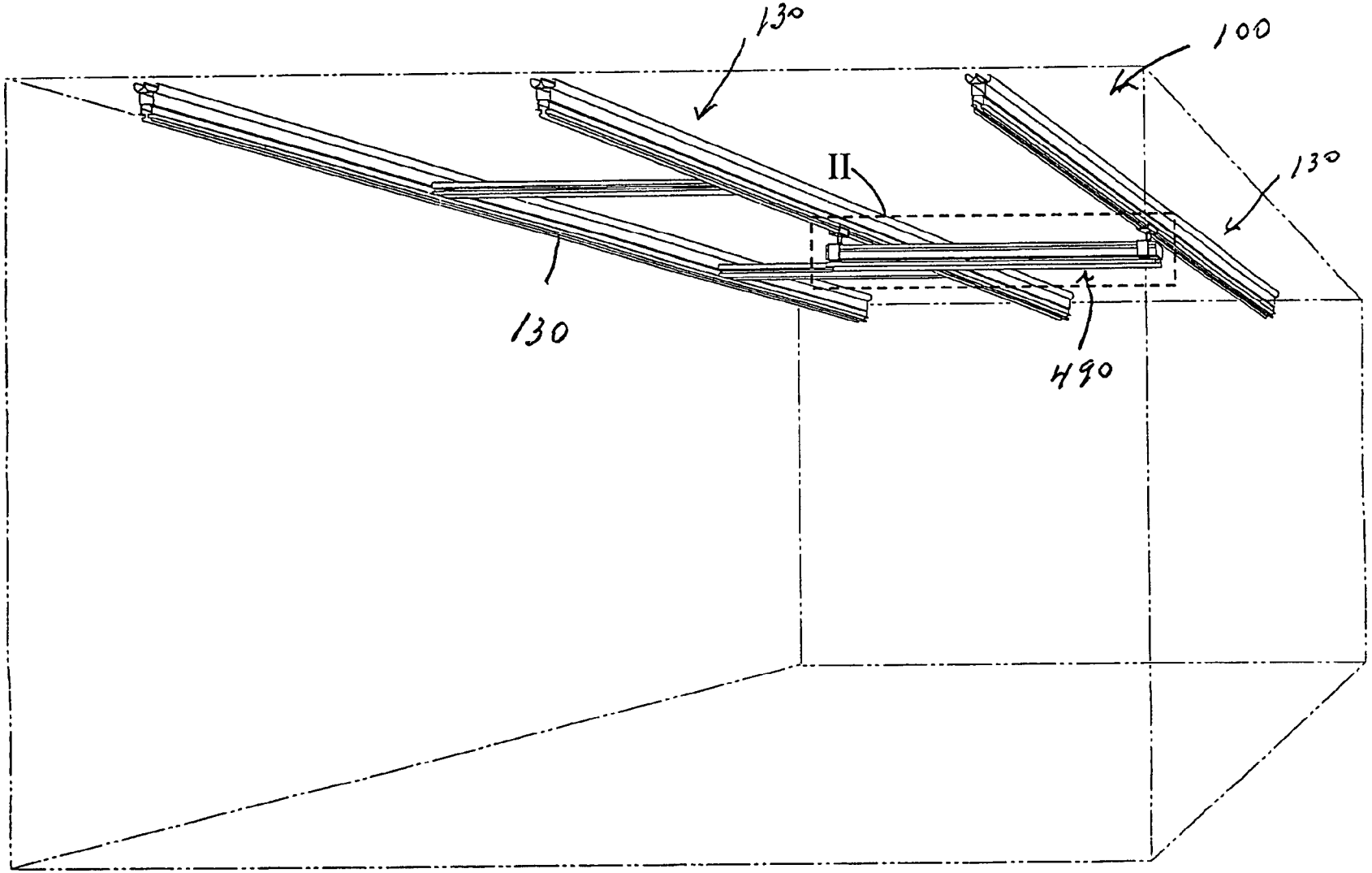
FIG. 17 is a perspective view of a rail system in accordance with the invention, and showing the system assembled and in use within a commercial interior, and further showing a powered cross rail interconnected between two primary tracks, in a manner so as to be located below the plane formed by the two interconnected primary tracks.
Figure 21A:
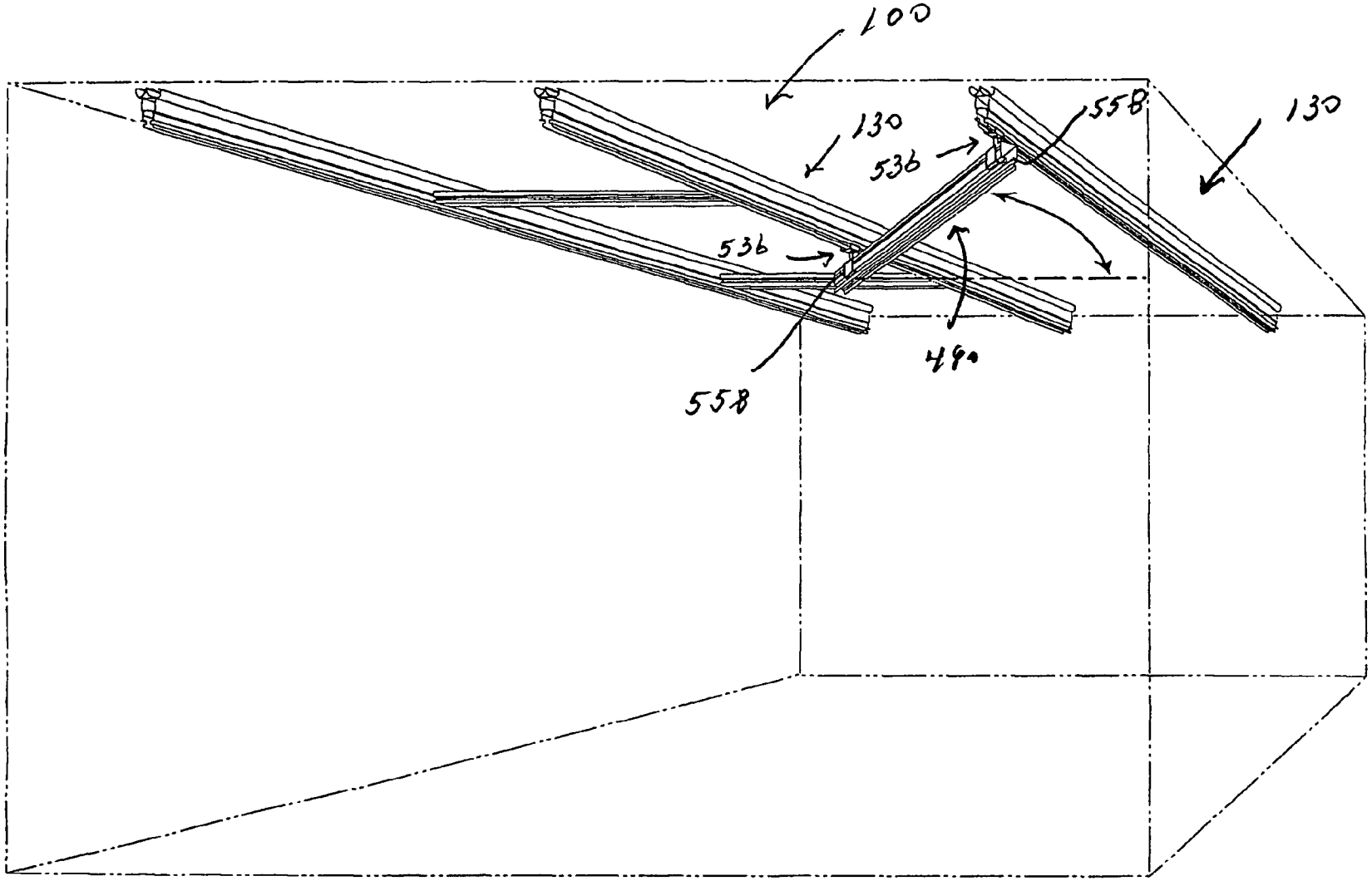

In the foregoing description, and as particularly shown in FIGS. 14 and 17, the cross rails illustrated therein are positioned so as to be substantially perpendicular to the longitudinal axes of the interconnected, adjacent primary tracks 130. In accordance with one aspect of the invention, the rail system 100 comprises means for positioning a cross rail at non-perpendicular angles relative to the interconnecting, adjacent primary tracks 130. An example of such a configuration is illustrated in FIG. 21A. FIG. 21A illustrates the powered cross rail 490 (previously described with respect to FIGS. 17, 18 and 19) as being suspended below a pair of adjacent primary tracks 130. However, unlike the suspension shown in FIG. 17, the cross rail 490 as illustrated in FIG. 21 A is positioned at non-perpendicular angles, relative to the interconnecting primary tracks 130. With reference back to FIGS. 18 and 19, it is apparent that this capability of having an angled configuration for the cross rail 490 is permitted by the capability of locating the primary track hanger brackets 536 at various locations along the length of the primary track 130. Also, this angled configuration is provided by the use of the cross rail securing bracket 558 and the manner of interconnecting the securing bracket 558 to the primary track hanger bracket 536 through the use of the bolt 550. With the use of the bolt 550, the cross rail securing bracket 558 can be positioned at a continuum of radial angles relative to the axis of the bolt 550. In accordance with the foregoing, the cross rail 490 can be readily angled relative to the interconnected primary tracks 130. Further, this angled configuration can be provided not only with the powered cross rail 490, but also with the non-powered cross rail 566.

As previously described herein, the rail system 100 in accordance with the invention provides means for selectively interconnecting functional components to electrical power supported within or around primary tracks 130 of the rail system 100. In addition, the elements of the primary track 130 provide means for supplying data and communication signals to interconnected functional components, as well as between interconnected functional components.

Figure 22:
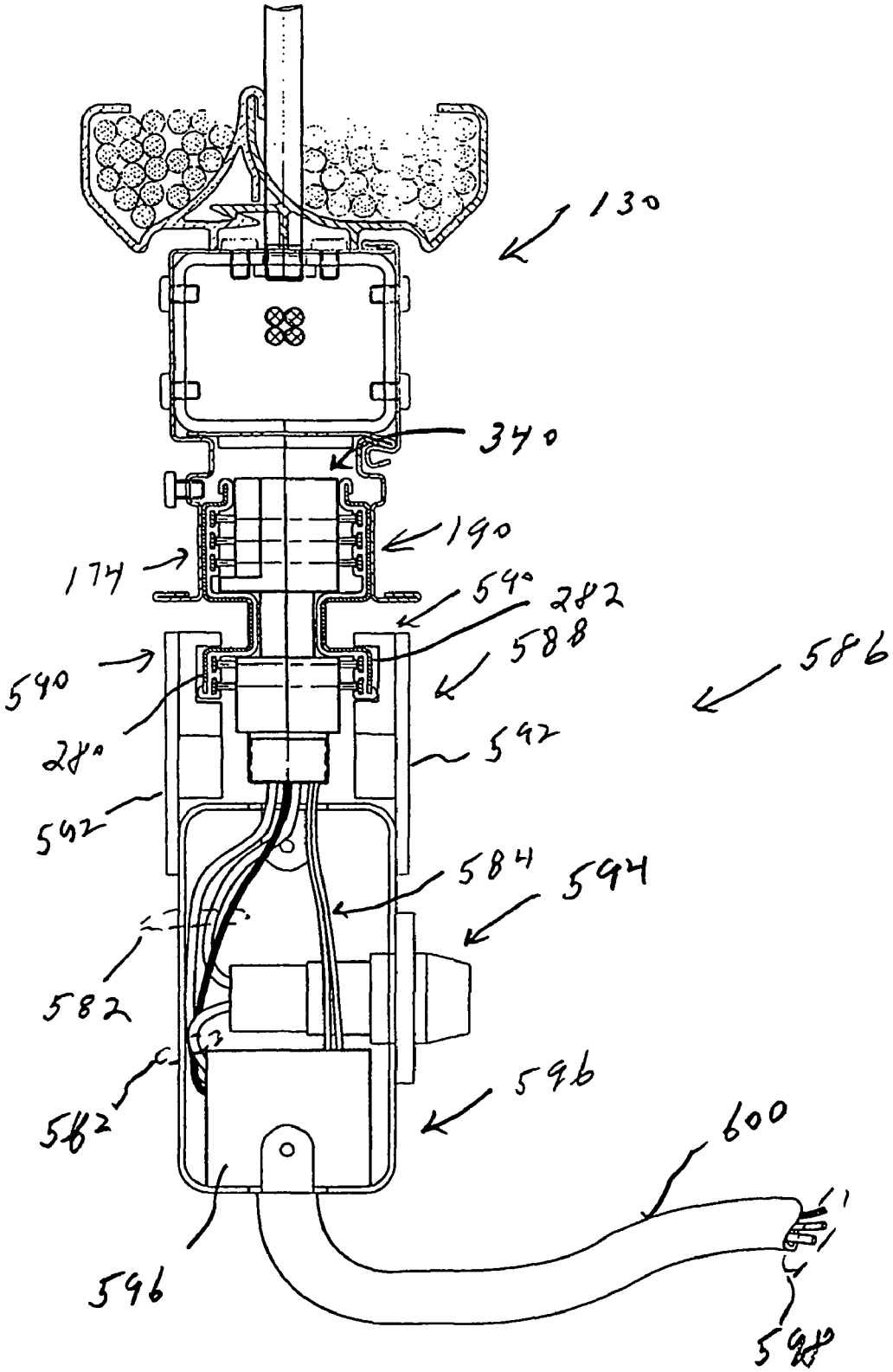
FIG. 22 is a cross sectional end view of a primary track and primary connector, with a hanging electrical power box coupled to the primary track, and further illustrating the use of electrical conduit projecting laterally from the longitudinal axis of the primary track.

FIG. 22 illustrates a cross-sectional configuration of various electrical components which may be utilized to interface the primary track 130 to electrical conduit to be interconnected directly to functional components to be energized.

Referring to FIG. 22, a primary track 130 is illustrated, with a power connector 340 coupled thereto. The power connector 340, as previously described herein, provides electrical, data and communications connections to the bus strips 174, 190. Connections to appropriate ones of buses of the bus strips 174, 190 are made to cables and wires, such as those shown in FIG. 22 as electrical wires 582. Correspondingly, cables 584 may also project downwardly from the power connector 340, after being appropriately coupled to buses of the bus strips 174, 190, which may carry data and/or communication signals. The electrical wires 582 and cables 584 extend downwardly into a junction box 586, as illustrated in FIG. 22. The junction box 586 can be relatively conventional in design, and secured to the primary track 130 by means of a junction box hanger 588. The junction box hanger 588 may have, as further illustrated in FIG. 22, a pair of opposing clamping arms 590 which are secured around the lower members 280, 282, of the primary track 130. The junction box hanger 588 may also have its clamping arms 590 more tightly secured to the primary track 130, by means of connecting screws (not shown) or other appropriate securing means. The junction box hanger 588 includes a pair of side walls 592 which are secured to the junction box 586 by appropriate securing means (not shown), such as connecting bolts, screws or the like.

The electrical wires 582, as previously described herein, may be interconnected to the AC buses of the bus strips 174, 190. These electrical wires 582 (or a sub-set of the same) may be applied through a fuse 594, for purposes of providing appropriate fusing between the AC buses of the bus strips 174, 190, and the electrical devices to be powered.

Following appropriate fusing, the electrical wires 582 may apply input power to a control module 596. In addition to the electrical wires 586, the data/communication cables 584 may also be interconnected to the control module 596. These data/communication cables will provide signals to and from the module 596.

The control module 596, although not described in great detail herein, provides a means for transmitting and receiving data and communication signals for purposes of controlling the functional components or devices to be interconnected to the junction box 586. The control module 596 may include memory, microcode, instruction registers and the like for purposes of control of a device to be interconnected to the junction box 586. For example, the control module 596 may be associated with an interconnected lighting element, whereby control signals may be utilized within the control module 596 for purposes of determining when AC power from the electrical wires 586 is to be applied to the lighting element.

In accordance with the rail system 100 in accordance with the invention and further in accordance with the use of the control module 596 and associated components, control signals can be transmitted to the control module 596 or data can be transmitted to control module 596, and the control module 596 programmed so as to determine an outcome, such that AC power applied on the electrical output wires 598 within conduit 600 can be selectively controlled through appropriate switching or the like within the control module 596. Further, signals indicating the status of a lighting element or other device electrically connected to the junction box 586 may be generated by the control module 596. Greater detail retarding controlling of the relationships between controlled and controlling devices (such as switches and lights) can be found in commonly-assigned U.S. Provisional Patent Application Ser. No. 60/374,012, filed Apr. 19, 2002.

Figure 23:
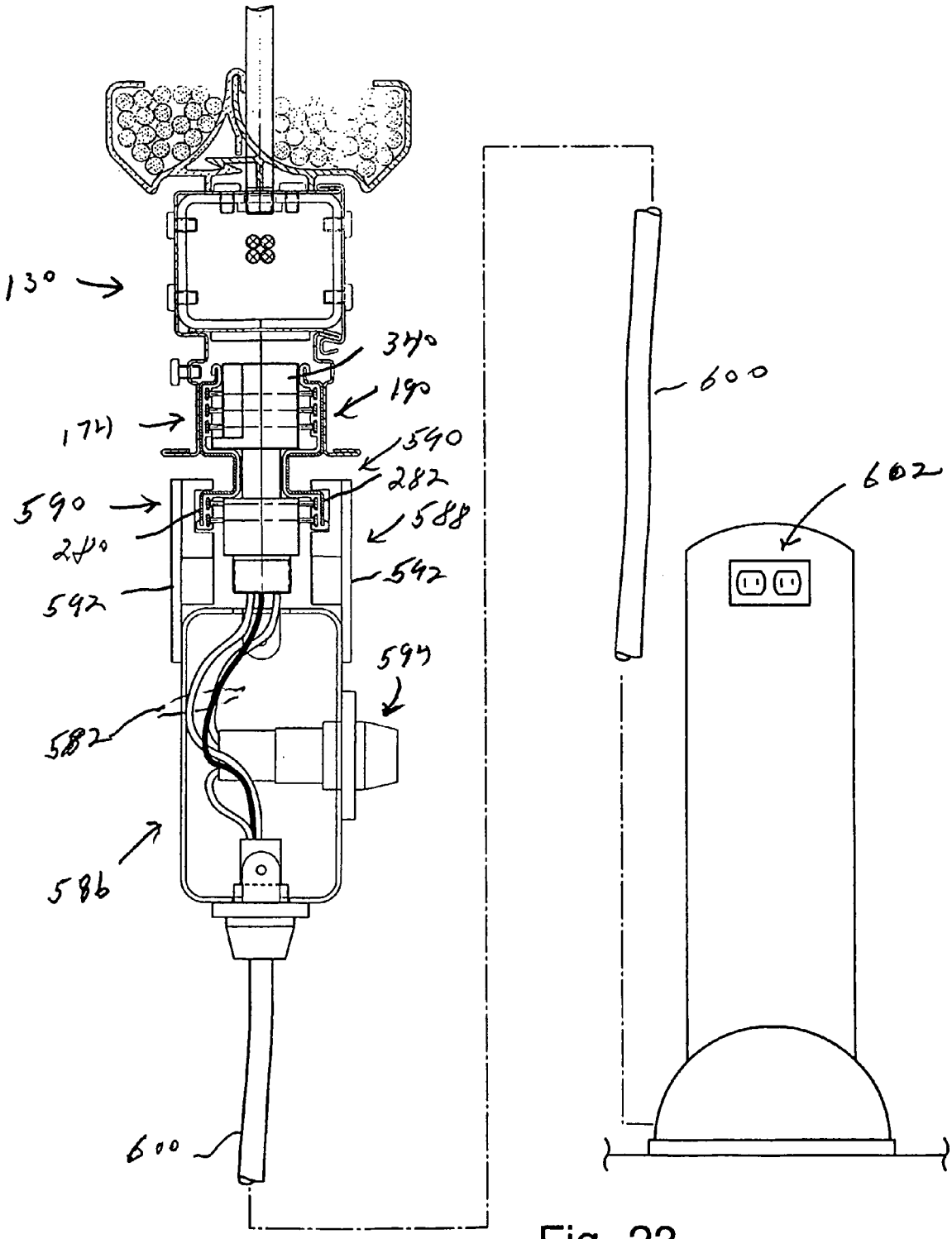
FIG. 23 includes a number of the components illustrated in FIG. 22, but illustrates the use of electrical conduit projecting downwardly from the electrical power box, and further illustrates, as an example, the interconnection of the electrical cord to components for energizing electrical receptacles.

Another example of the use of the junction box 586 is illustrated in FIG. 23. In this particular example, a junction box 586 is electrically coupled to the buses 574, 190, again through the power connector 340. The junction box hanger 588 is again used, for purposes of mechanically connecting the junction box 586 to the primary track 130. However, unlike the example illustrated in FIG. 22, the junction box 586 does not include a control module 596. Instead, electrical wires extend directly (after going through the fuse 594) from the power connector 340 downwardly into the conduit 600 as electrical power connections to a pair of outlet receptacles 602. The particular circuits to which the outlet receptacles 602 are electrically interconnected will be determined by the connections within the power connector 304 and the specific connections to the AC buses of the bus strips 174, 190.

Figure 25:
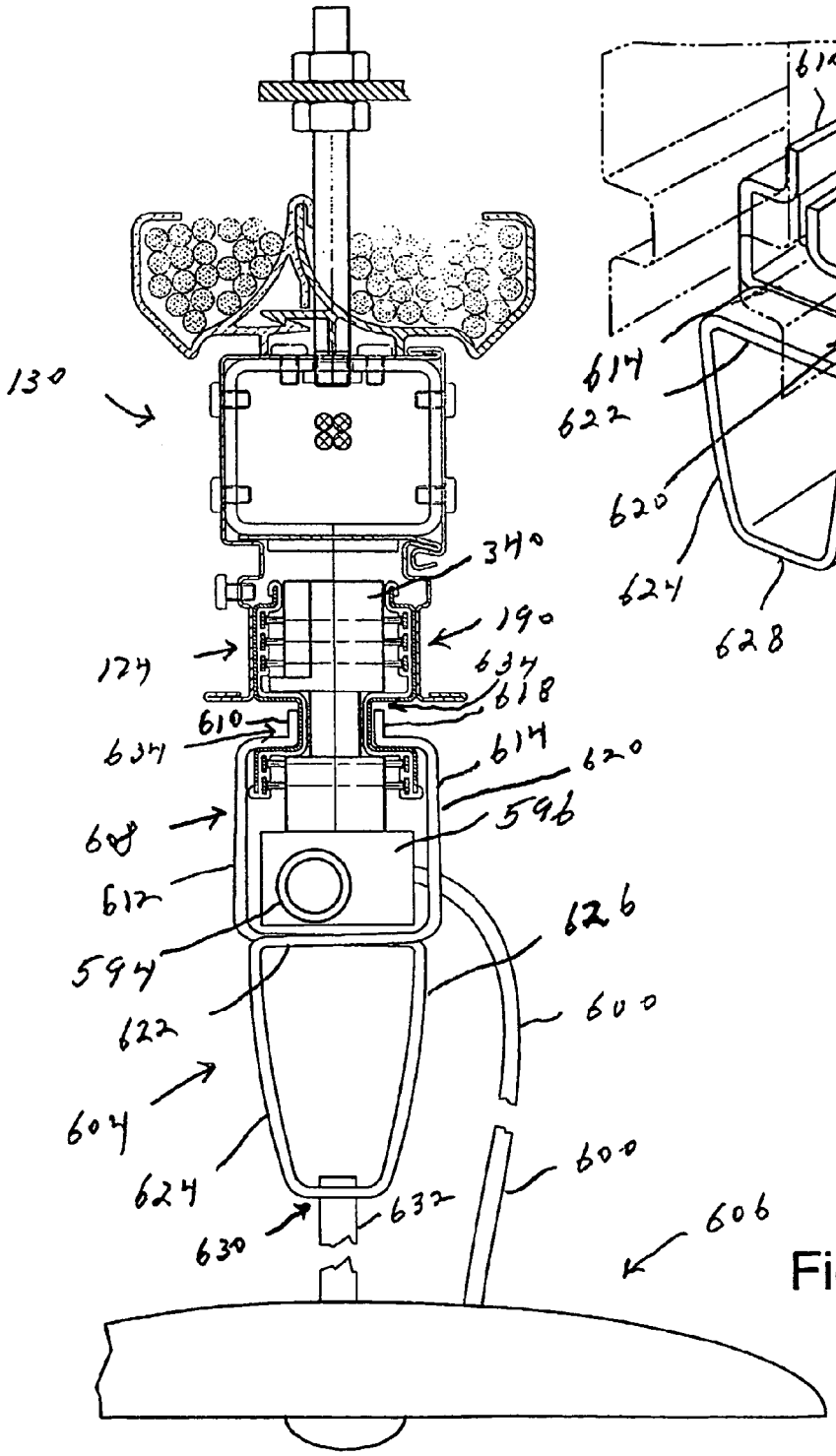
FIG. 25 is a cross sectional end view of the use of a primary track, power connector and the hanging clip illustrated in FIG. 24, for purposes of supporting and energizing a light fixture.
Figure 24:
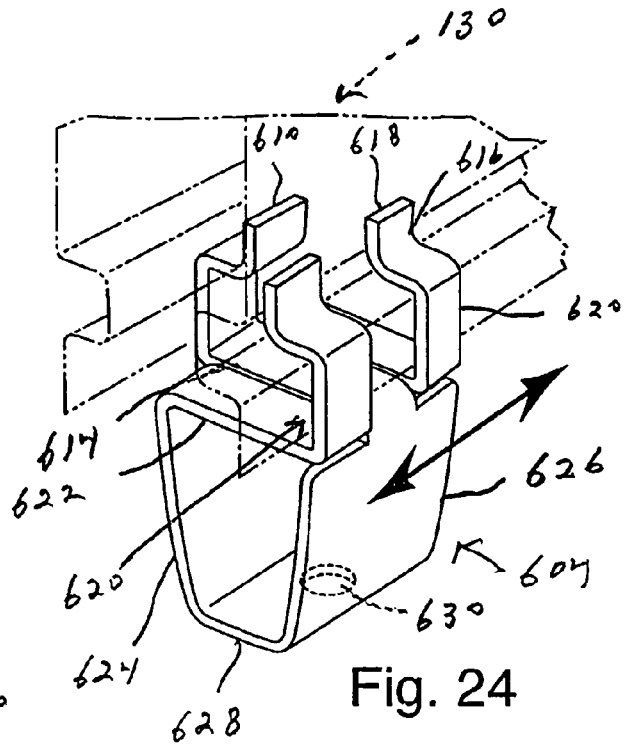
FIG. 24 is a perspective view of a hanging clip which may be utilized in accordance with the invention with the rail system, for purposes of supporting various accessories.

The configurations in accordance with the invention, as illustrated in FIGS. 22 and 23, utilize a particular junction box 588, where the only connection between the junction box 588 and the functional device or accessory is an electrical connection through the conduit 600 and the electrical output wires 598. However, in certain instances, it is desirable to have mechanical means for more directly connecting functional accessories to the primary track 130. For this purpose and in accordance with one aspect of the invention, a universal hanging clip 604 may be utilized as illustrated in FIGS. 24 and 25. The universal hanging clip 604 may be employed for suspending, from the primary track 130, functional components and accessories, such as the lighting fixture 606 illustrated in FIG. 25. More specifically, the hanging clip 604 includes an upper left-side bracket 608. The left-side bracket 608 consists of a single upwardly depending finger 610. The finger 610 is integral with an arcuate section integral with a downwardly depending side wall 612. As illustrated primarily in FIG. 24, the side wall 612 is integral with a substantially horizontally disposed member 614, which extends to the right side of the hanging clip 604 (the terms "left side" and "right side" being chosen solely for convenience, and in accordance with the illustration of FIG. 25). With reference to the right side of the hanging clip 604, the clip 604 includes a pair of right-side brackets 616 having a substantially parallel configuration. Each of the right-side brackets 616, in a manner similar to the left-side bracket 608, includes an upwardly depending finger 618 which is integral with an arcuate section and, in turn, integral with a downwardly depending side wall 620. Each of the side walls 620 of the right-side brackets 616 is integral with, at their lower ends, a left-extending member 622.

Depending downwardly from the left-extending members 622, and integral therewith, is a left-side lower flange 624. The left-side lower flange 624, as primarily illustrated in FIG. 25, is downwardly depending and somewhat angled inwardly. Correspondingly, the member 614 integral with the side wall 612 is, in turn, integral with a downwardly depending right-side lower flange 626. The right-side lower flange 626 is also angled inwardly. At their lower ends, the left-side lower flange 624 and the right-side lower flange 626 are integral with a floor section 628 having the configuration as substantially shown in FIG. 24. A bore 630 or similar aperture extends substantially through the center of the floor section 628. For purposes of interconnecting the lighting fixture 606 to the universal hanging bracket 604, a rod 632 or other similar connecting arrangement may be secured at its upper end through the bore 630, with the lower portion of the rod 632 mechanically interconnected to the lighting fixture 606.

As with other elements of the primary track 130 as previously described herein, the configuration illustrated in FIG. 25 may also utilize a power connector 340. In this particular instance, the power connector 340 is shown as being more directly connected to the control module 596, with an attendant fuse 594 also associated therewith. AC power for the lighting fixture 606 may be applied from the control module 596 through conduit 600.

The universal hanging clip 604 in accordance with the invention provides significant advantage, with respect to its structure and removable interconnection to the primary track 130. More specifically, the universal hanging clip 604 is structured so that if manual pressure is exerted inwardly against the left-side lower flange 624 and right-side lower flange 626, and with the hanging bracket 604 being integrally constructed and having appropriate flexibility and resiliency, the fingers 610, 618 and side walls 612, 620 will move outwardly, so as to increase the distance between fingers 610 and 618. With this distance appropriately increased, the fingers 610, 618 can be appropriately positioned within the lower recesses 634 of the primary track 130. When manual pressure is released from the left-side lower flange 624 and right-side lower flange 626, the fingers 610, 618 and side walls 612, 620 will be biased inwardly so as to firmly "grasp" the lower portion of the primary track 130. In this manner, the universal hanging clip 604 provides a convenient means for firmly being coupled to the primary track 130, but with the coupling being in a removable manner. Further, the universal hanging clip 604 is advantageous in that with its configuration along the primary track 130 not requiring a specific connecting means (such as screws or the like) which would require interconnection at specific positions along the primary track 130, the universal hanging clip 604 can be positioned at any of a number of locations along a continuum of the length of the primary track 130. Further, although the universal hanging clip 604 is illustrated with a lighting fixture 606 in FIG. 25, it is evident that the hanging clip 604 could be utilized for a number of various functional components and accessories.

Although the rail system 100 has been described herein with respect to individual components of the rail system itself, and individually interconnected functional components and accessories, the significant advantages of the rail system 100 in accordance with the invention, reside in part with its "universal" aspect in providing a convenient and reconfigurable means for locating and "controlling" various accessories. An example, although simplified, of a configuration which may employ the rail system 100 is illustrated as configuration 636 in FIG. 26. In this particular configuration, a rail system 100 is shown which employs three primary tracks 130. For purposes of description, and in view of details of the prior description, reference numerals with respect to detailed components of the rail system 100 will not be illustrated in FIG. 26.

Figure 26:
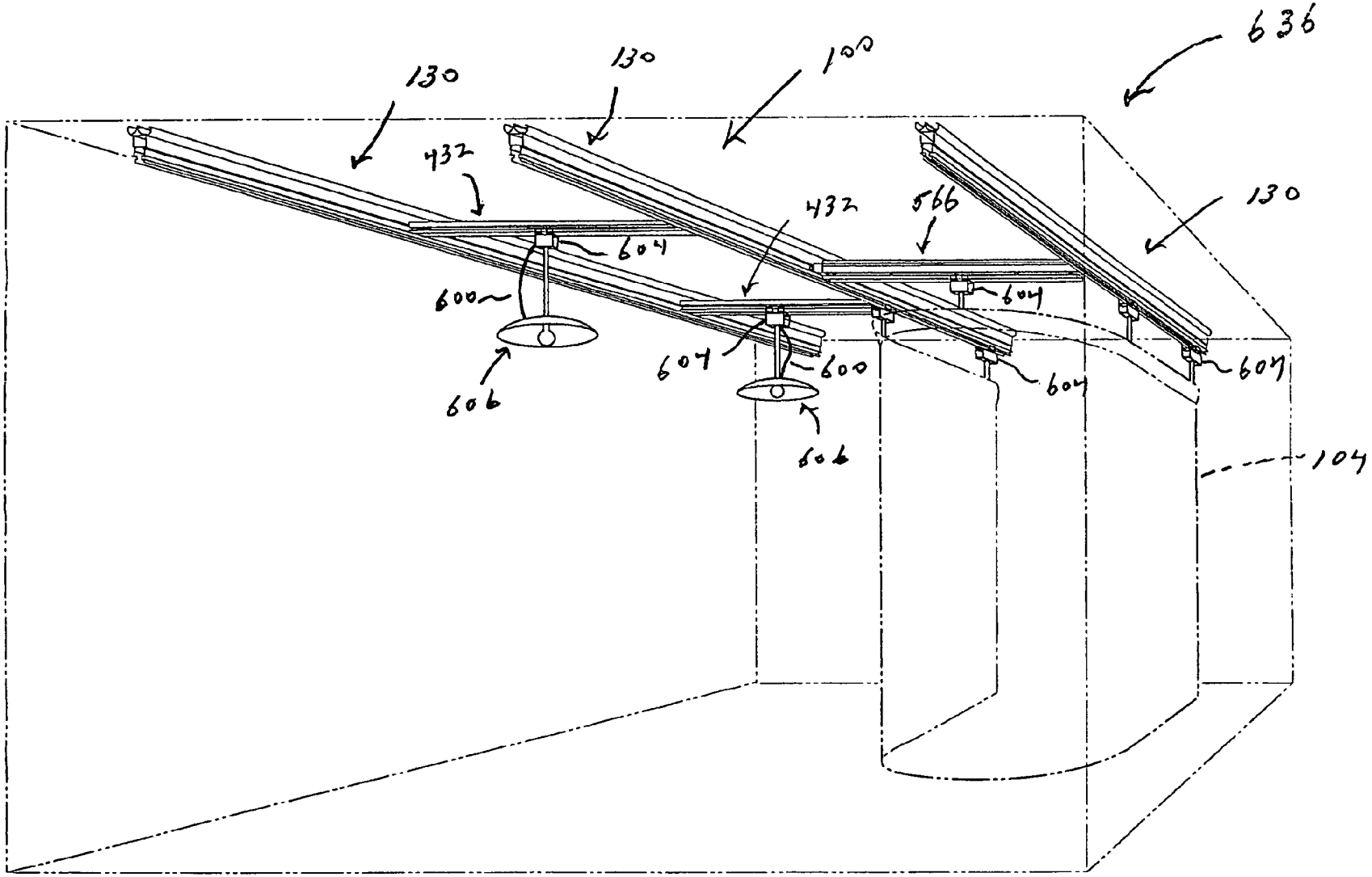
FIG. 26 is a perspective view of the use of the rail system in accordance with the invention, in a particular commercial interior, and showing the use of the rail system with primary tracks, powered and non-powered cross rails, and accessories including light fixtures and vertically disposed partitions.

Also, for purposes of clarity and simplicity, the structural interconnections between the primary tracks 130 and ceiling beams or the like are also not illustrated in FIG. 26. FIG. 26 does illustrate, however, a series of powered cross rails 432 which, in the particular configuration 636, are connected in a manner so as to be level with interconnecting, adjacent primary tracks 130. Accordingly, these cross rails 432 may be interconnected to the adjacent primary tracks 130 in a manner as previously illustrated and described with respect to FIGS. 16 and 17.

As further illustrated in FIG. 26, the powered cross rails 432 may be utilized with the previously described universal hanging clips 604 to support lighting fixtures 606 therefrom. In addition to the use of the hanging clips 604 with the lighting fixtures 606, FIG. 26 also illustrates the use of the universal hanging clips 604 within a primary track 130 and also within a nonpowered cross rail 566. In the particular configuration illustrated in FIG. 26, the nonpowered cross rail 566 is also positioned level with its adjacent, interconnecting primary tracks 130. The nonpowered cross rail 566 and the associated hanging clip 604 are illustrated in FIG. 26 as being utilized to support a downwardly depending and vertically disposed partition 104. The use of such a partition is more specifically described in commonly assigned U.S. Provisional Patent Application entitled "Partition System with Technology" and filed Sep. 4, 2002. The vertical partition 104 may be relatively opaque, so as to provide an area of relative privacy. Alternatively, the vertical partition 104 may instead be constructed of a material which permits relatively significant light transmission, while providing diffusion or "color wash" so as to provide a relatively aesthetically pleasing commercial interior. Further, such vertical partitions 104 may, by necessity, have to be connected not only to the rail system 100, but also to floor supports and the like. This may occur where there is a necessity for a more structural vertical element, and where support solely by the rail system 100 would cause undue stress.

Figure 27:
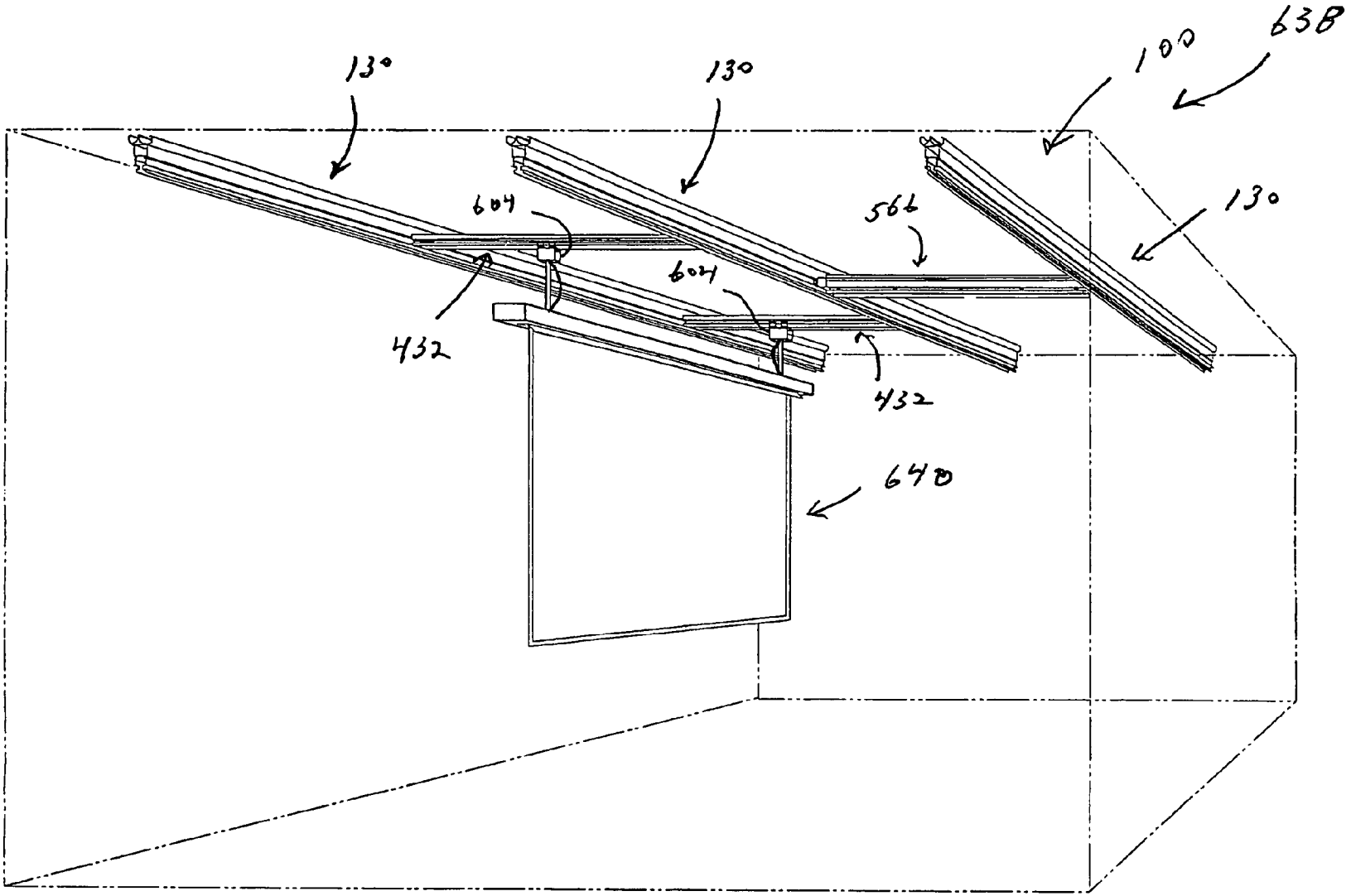
FIG. 27 illustrates a perspective view of a rail system similar in structure to the rail system in FIG. 26, and further showing the use of the rail system with a supported electronic marker board or teleconferencing screen.

Another illustration of a commercial interior which may be configured utilizing the rail system 100 in accordance with the invention is illustrated as configuration 638 in FIG. 27. Referring specifically to FIG. 27, the configuration 638 includes a rail system 100 having a series of three, parallel primary tracks 130. A pair of powered cross rails 432 are each interconnected between a pair of adjacent primary tracks 130. In this particular instance, the powered cross rails 432 are illustrated as being perpendicular to the interconnecting cross rails 130, and parallel to each other. The powered cross rails 432 are also illustrated as being level with the interconnected primary tracks 130. FIG. 27 further illustrates a nonpowered cross rail 566, level with the interconnected primary track 130.

Further, in the particular configuration 638, the powered cross rails 432 are illustrated as each having a universal hanging clip 604 supporting a functional accessory 640. As illustrated in FIG. 27, the functional accessory 640 may be one of a number of different accessories, further illustrating the relatively wide and reconfigurable use of the rail system 100 in accordance with the invention. For example, the functional accessory 640 could be a plain "whiteboard," requiring no interconnection with electrical power or data or communication signals. In contrast, however, the functional accessory 640 could be an electronic whiteboard, whereby the whiteboard 640, through the data and communication components of the primary track 130, may be utilized to transmit and receive signals representing writings and graphics on the whiteboard 640 and remotely located whiteboards. Still further, the functional accessory 640 could represent a flat screen teleconferencing device. Such a device would again use the electrical power and data and communication signals associated with the primary tracks 130 and the powered cross rails 432. In summary, a number of different types of accessories may be utilized with the rail system 100 in accordance with the invention.

Figure 28:
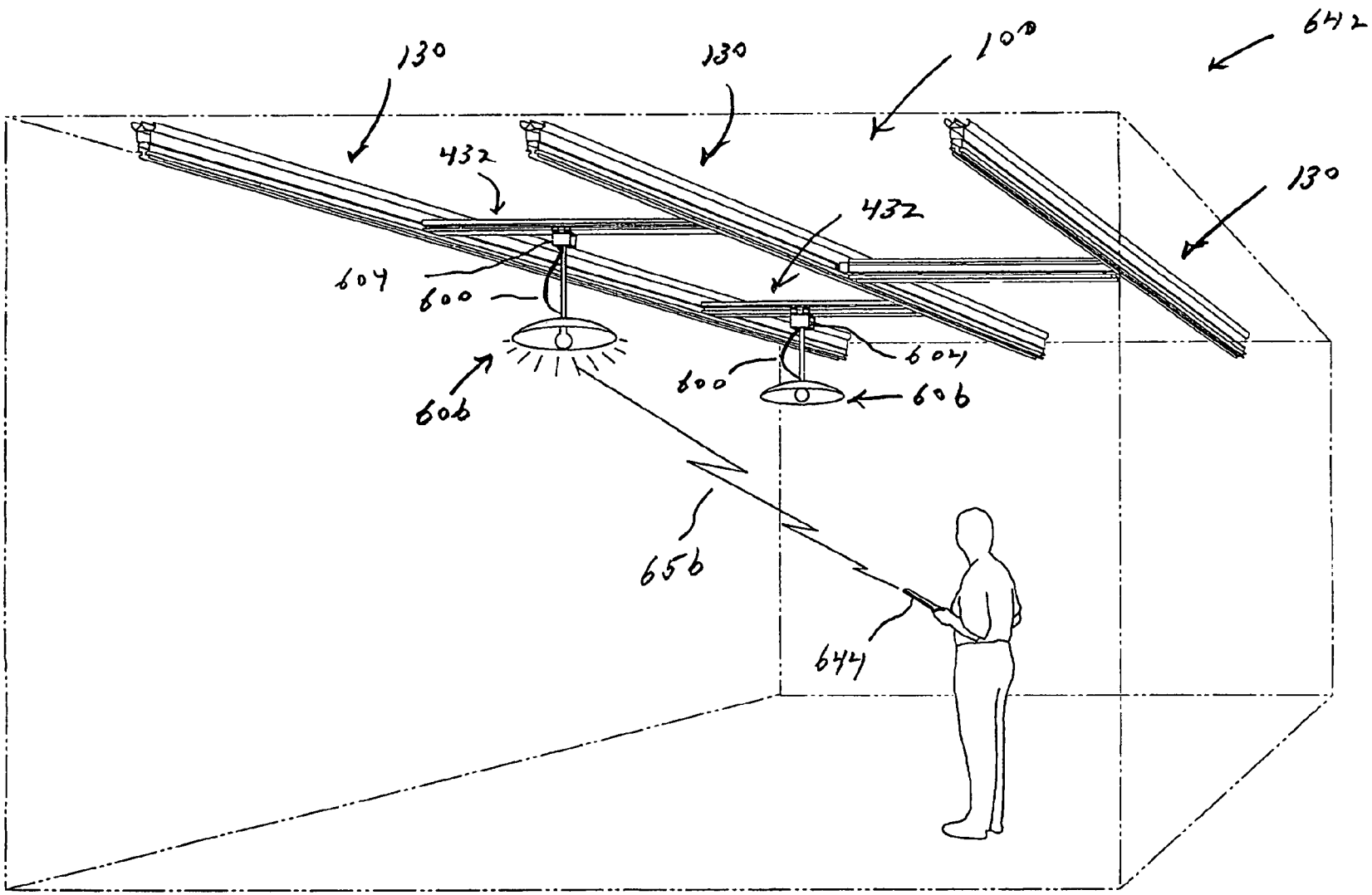
Figure 30:
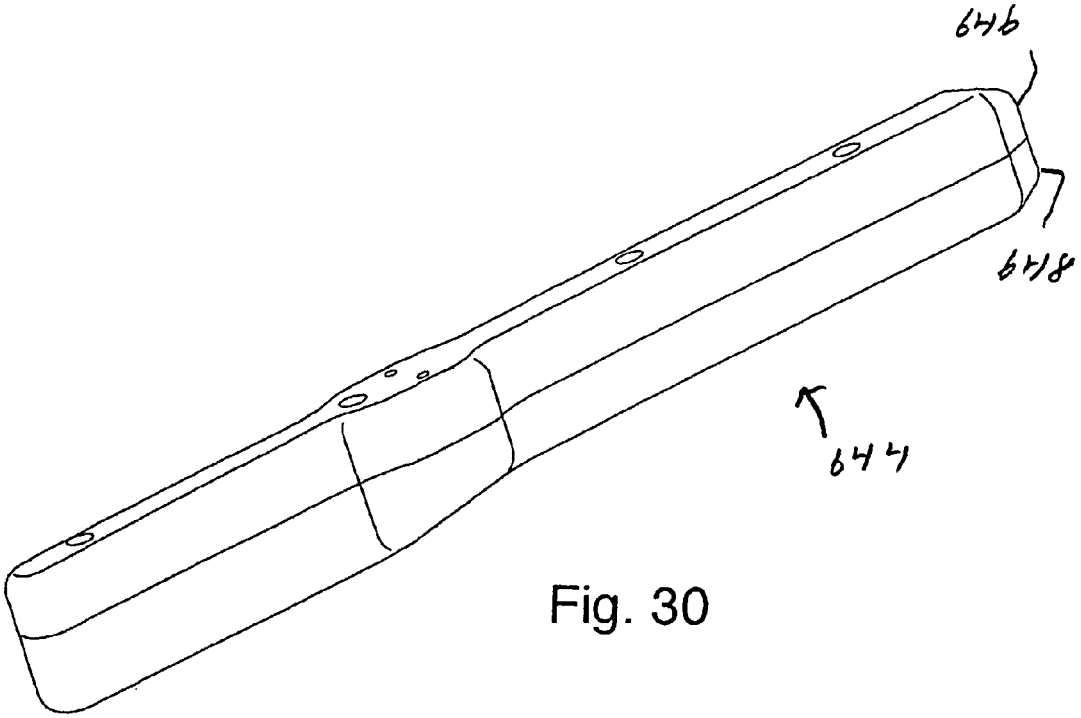
FIG. 30 is a perspective view of a wand which may be utilized for the purposes illustrated in FIGS. 28, 29 and 29A.
Figure 31:
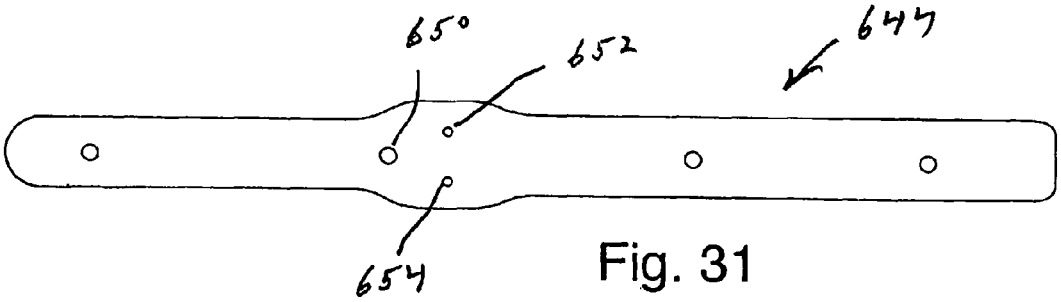
FIG. 31 is an elevation view of the wand illustrated in FIG. 30.
Figure 32:
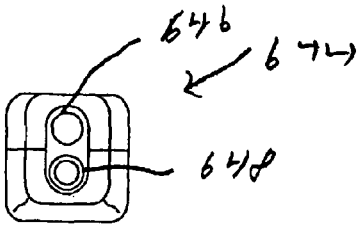
FIG. 32 is an end view of one end of the wand illustrated in FIGS. 30 and 31.

As earlier described in part, the rail system 100 provides a means for facilitating control and reconfiguration of controlled relationships among various functional components which may be utilized with the rail system 100. Reference has been previously made herein to the concept of establishing control relationships among switches and lights, and reconfiguring the same as required. FIG. 28 illustrates a configuration 642, employing a series of three primary tracks 130, two powered cross rails 432 and two lighting fixtures 606. Also illustrated in FIG. 28 is a user employing a control device, which may be characterized as a control wand 644. An example of the control wand 644 is illustrated in FIGS. 30, 31 and 32. With reference thereto, the control wand 644 may be of an elongated configuration. At one end of the control wand 644 is a light source 646 which, preferably, would generate a substantially collimated beam of light. In addition to the light source 646, the control wand 644 may also include an infrared (IR) emitter 648, for transmitting infrared transmission signals to corresponding IR receivers associated with the rail system 100 and the functional accessories.

The control wand 644 may also include a trigger 650, for purposes of initiating transmission of IR signals. Still further, the wand 644 may include mode select switches, such as mode select switch 652 and mode select switch 654. These mode select switches would be utilized to allow manual selection of particular commands which may be generated using the wand 644. The control wand 644 would also utilize a controller (not shown) or similar computerized devices for purposes of providing requisite electronics within the wand 644 for use with the trigger 650, mode select switches 652, 654 and the light source 646 and IR emitter 648. An example of the use of such a wand, along with attendant commands which may be generated using the same, is described in a commonly assigned U.S. Provisional Patent Application Ser. No. 60/374,012 filed Apr. 19, 2002. The contents of the aforedescribed patent application are hereby incorporated by reference herein.

Returning back to FIG. 28, the user could employ the wand 644 to transmit signals to the controller (not shown) associated with either of the lighting fixtures 606. Although the user is shown as transmitting an IR signal 656 specifically to the lighting fixture 606, the actual IR transmission signal would be picked up by an IR receiver or the like which may be associated with a controller or the like located adjacent the hanging clip 604. However, this IR signal 656 would, in fact, be utilized in association with functionality or control associated with the lighting fixture 606.

Figure 29A:
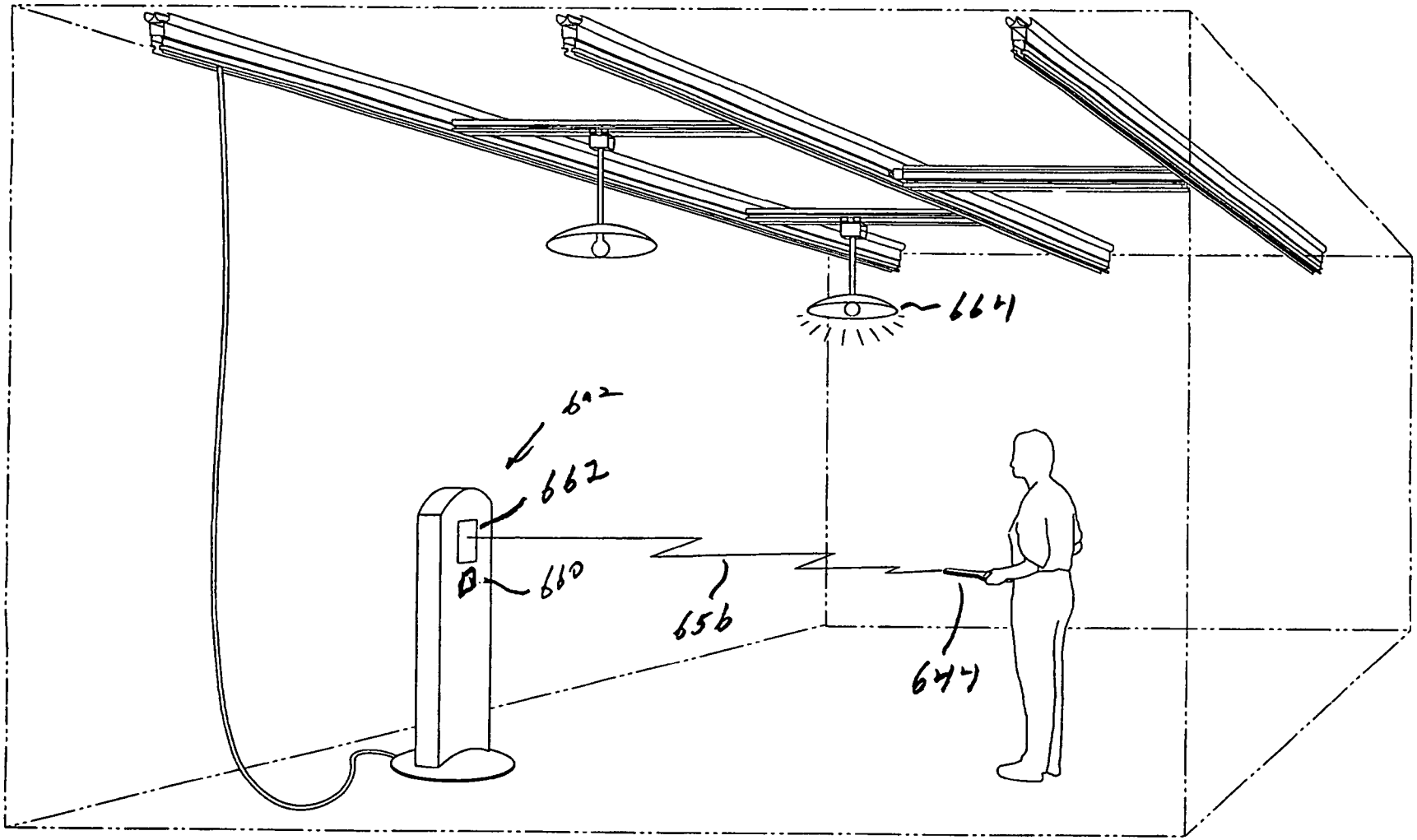
FIG. 29A further illustrates manual manipulation of the wand so as to generate appropriate signals (which will be carried through the rail system) for purposes of programming relationships between the light fixtures and the switch unit illustrated in FIG. 29A.

This control concept is further shown in FIGS. 29 and 29A. More specifically, each of FIGS. 29 and 29A illustrate a configuration 658, which substantially corresponds to the configuration 642 illustrated in FIG. 28. However, the configuration 658 further shows the concept of a pair of electrical receptacles 602 (such as those shown in FIG. 23) being electrically interconnected to one of the primary tracks 130. FIG. 29 illustrates the user employing the control wand 644 to transmit IR signals to one of the particular lighting fixtures 606 (or an IR sensor associated with a control module which is further associated with the lighting fixture 606). Correspondingly, FIG. 29A illustrates the user transmitting IR signals to the structure housing the electrical outlet receptacles 602. In this particular example, the structure housing the electrical outlet receptacles 602 is further illustrated as having an IR sensor 660 directly associated therewith.

For purposes of illustrating a relatively simple control sequence, it can be assumed that the user wishes to have the light switch 660 control the particular lighting fixture shown in FIGS. 29 and 29A as lighting fixture 664. The user could first configure the mode selector switches associated with the wand 644 so as to enable a "control set" sequence. The wand 644 could then be pointed to the IR sensor (not shown) associated with the lighting fixture 664. When the wand 654 is appropriately pointed (indicated by the light source 646), the user may activate the trigger 650 on the wand 644.

The user could then "point" the wand 644 to the IR sensor 662 associated with the light switch 660. When the wand 644 again has an appropriate directional configuration as indicated by the location of the light source 646, the trigger 650 could again be activated, thereby transmitting the appropriate IR signals 656. Additional signals could then be transmitted through the wand 644, so as to indicate that the control sequence is complete and the lighting fixture 664 is to be controlled by the light switch 660. As apparent from the foregoing, the capability of essentially "programming" controlled relationships among the various accessories associated with the rail system 100 require the capability of transmitting and receiving communication signals among the various functional accessories. In accordance with the invention, and the features provided by the aforedescribed rail system 100 in accordance with the invention, the rail system 100 conveniently provides proximity of not only electrical power, but also data and communication signals. Still further, these signals are provided in association with the use of control modules or the like for purposes of providing programmability to various functional accessories. Again, detailed examples of this programmability among functional components is described in the commonly assigned application Ser. No. 60/374,012.

In addition to the foregoing, it is possible that there may be a potential use of RF signaling for purposes of changing the on and off states of various elements. For example, with this type of RF signaling, an individual could possibly turn on all of the elements in an office or other commercial interior, with a general signal rather than with a specific switch.

As described in the foregoing, the rail system 100 in accordance with the invention facilitates flexibility and reconfiguration in the location of various functional or utilitarian elements which may be supported and mounted in a releasable and reconfigurable manner with the rail system. The rail system 100 also facilitates access to locations where a commercial interior designer may wish to locate various functional or utilitarian elements, including electrical power receptacles and the like. The rail system 100 may carry not only AC electrical power (of varying voltages), but may also carry DC or communication signals. The communication signals can be used for purposes of relatively well-known communication functions. Further, however, the rail system 100 in accordance with the invention may include a communications bus structure permitting the "programming" of controlled relationships among various commercial interior components. The programming (or "reprogramming") may be accomplished at the location of the controlled and controlling elements, and may be accomplished by a lay-person without significant training or expertise.

The rail system 100 in accordance with the invention facilitates the reconfiguration of the commercial interior in "real time." Not only may various functional elements be quickly relocated from a "physical" sense, but relationships among functional or utilitarian elements can also be altered, in accordance with the prior description relating to programming of control relationships. The rail system 100 in accordance with the invention presents a "totality" of concepts which provide a commercial interior readily adapted for use with various utilitarian elements, and with the capability of reconfiguration without necessarily requiring additional physical wiring or substantial rewiring. With this capability of relatively rapid reconfiguration, change can be provided in a building's infrastructure quickly, insuring that the attendant commercial interior does not require costly disassembly and reassembly, and is not "down" for any substantial period of time. Further, the rail system 100 in accordance with the invention, with attendant utilitarian elements, permit occupants to allow their needs to "drive" the structure and function of the infrastructure layout.

It will be apparent to those skilled in the pertinent arts that other embodiments of rail systems in accordance with the invention may be designed. That it, the principles of a rail system for configuring control among functional accessories and for the physical connection of functional accessories through a rail system are not limited to the specific embodiment described herein. For example, various configurations of certain components of the rail system 100 may be utilized, without departing from the spirit of the invention. Accordingly, it will be apparent to those skilled in the art that modifications and other variations of the above-described illustrative embodiment of the invention may be effected without departing from the spirit and scope of the novel concepts of the invention.

What is claimed is:

1. An overhead rail system for supporting and/or energizing a plurality of utilitarian elements which cooperate so as to form a commercial interior primarily depending downwardly from a plane of said rail system, said rail system comprising:

at least one primary track having an elongated configuration;

electrical energizing means located within said primary track, for providing electrical power signals along said elongated configuration;

communication means located within said primary track, for receiving and transmitting communication signals along said elongated configuration;

said utilitarian elements comprise a set of vertically disposed partitions;

partition connecting means positioned along said track for removably and vertically supporting said partitions along said elongated configuration;

said utilitarian elements further comprise a set of electrically energized devices;

electrical connection means positioned along said track for interconnecting said electrically energized devices to said electrical energizing means; and said partition connecting means and said electrical connection means are coupled to said track, and to said vertically disposed partitions and electrically energized devices, respectively, so as to facilitate reconfiguration and relocation of said utilitarian elements as required by users of said commercial interior;

said electrical energizing means and said communication means are integral with said primary track and physically and electrically isolated from one another.

2. An overhead rail system in accordance with claim 1, characterized in that said electrical energizing means is structured so as to provide said electrical power signals substantially along a continuum of said elongated configuration.

3. An overhead rail system in accordance with claim 1, characterized in that said communication means is structured so as to provide reception and transmission of said communication signals substantially along a continuum of said elongated configuration.

4. An overhead rail system in accordance with claim 1, characterized in that said partition connection means and said electrical connection means are structured so that at least certain of said utilitarian elements are manually releasable from said partition connection means and said electrical connection means.

5. An overhead rail system in accordance with claim 1, characterized in that said electrical energizing means comprises a set of electrical buses, positioned within said primary track, and extending along said elongated configuration.

6. An overhead rail system in accordance with claim 1, characterized in that said rail system further comprises low voltage/DC means coupled to said primary track, for generating relatively low voltage or DC electrical signals along said elongated configuration.

7. An overhead rail system in accordance with claim 1, characterized in that said rail system further comprises low voltage/communication means coupled to said primary track, for providing low voltage or DC signals along said elongate configuration, and/or receiving and transmitting communication signals along said elongated configuration.

8. An overhead rail system in accordance with claim 1, characterized in that said rail system further comprises an enclosed raceway electrically isolated from said electrical energizing means and adapted to carry high voltage electrical cables or wires along said elongated configuration.

9. An overhead rail system in accordance with claim 1, characterized in that said rail system further comprises a cable tray removably mounted at an upper portion of said primary track, and adapted to carry power cables or communication cables.

10. An overhead rail system in accordance with claim 1, characterized in that:

said primary track comprises a back half assembly forming a part of said elongated configuration;

said primary track further comprises a front half assembly forming a part of said elongated configuration, said front and back half assemblies being manufactured as physically separate elements, and when mated together form a part of said primary track with a lower spacial area therewithin;

said rail system further comprise elongated low voltage, DC or communication buses adapted to be mounted within said lower spacial area formed by said back half and said front half assemblies; and said manufacture of said front and said back half assemblies as physically separate elements functions so as permit positioning of said low voltage, DC or communication buses within said lower spacial area prior to said back and said front half assemblies being coupled together, thereby permitting said elongated low voltage, DC or communication buses to be positioned within said spacial area without requiring said elongated buses to be slid through an end of said primary track into said lower spacial area.

11. An overhead rail system in accordance with claim 1, characterized in that:

said primary track comprises a spacial area forming an upper raceway through which electrical cables or wires are extended;

said rail system further comprises at least one rail cap for enclosing an end of said primary track, while still permitting access to electrical power signals; and said rail cap further comprises means for providing train relief for wires or cables extending through apertures of said rail cap.

12. An overhead rail system in accordance with claim 1, characterized in that:

said primary track comprises first and second sets of elongated sections adapted to be interconnected together so as to form a part of said elongated configuration of said primary track;

said elongated sections are staggered so that ends of each of said first set of elongated sections are positioned intermediate ends of said second set of elongated sections, when said first set of elongated sections are interconnected to said second set of elongated sections; and said staggered relationship is such that ends of each of said second set of elongated sections are positioned intermediate ends of said first set of elongated sections when said first and second sets of elongated sections are interconnected together.

13. An overhead rail system in accordance with claim 1, characterized in that:

said primary track comprises an elongated back half assembly having a plurality of back half sections, each of said sections having a length X;

said primary track further comprises an elongated front half assembly having a plurality of front half sections, each of said front half sections having a length X;

said back half sections and said front half sections are interconnected together, so as to form a substantial portion of said primary track;

said interconnection of said back half sections and said front half sections occurs with an end of each of said back half sections positioned substantially equidistant opposing ends of a corresponding one of said front half sections, and an opposing end of each of said back half sections being positioned substantially equidistant opposing ends of an adjacent one of said front half sections; and said back and front sections are further interconnected together so that an end of each of said front half sections is positioned substantially equidistant opposing ends of a corresponding one of said back half sections, and an opposing end of each of said front half sections is positioned substantially equidistant opposing ends of an adjacent one of said back half sections.

14. An overhead rail system in accordance with claim 1, characterized in that:

said primary track forms a substantially enclosed upper raceway through which high voltage electrical cables may be extended; and said primary track comprises a cover assembly having knock-out apertures spaced along the length of said cover assembly, so that power taps provided along the length of said high voltage cables within said upper raceway.

15. An overhead rail system in accordance with claim 1, characterized in that:

said electrical connection means comprises a power connector adapted to be releasably and electrically coupled to said electrical energizing means along a plurality of positions of said primary track; and said power connector comprises communication connection means for releasably and electrically coupling to said communication means, for providing said communication signals to certain of said utilitarian elements.

16. An overhead rail system in accordance with claim 1, characterized in that:

said rail system further comprises low voltage energizing means coupled to said primary track, for providing low voltage or DC signals along said elongated configuration; and said electrical connection means comprises at least one power connector adapted to be electrically coupled to said electrical energizing means for interconnecting at least certain of said utilitarian elements to said electrical energizing means so as to provide said low voltage or DC signals to certain of said utilitarian elements.

17. An overhead rail system in accordance with claim 1, characterized in that said rail system further comprises:

a plurality of said primary tracks;

a plurality of cross-rails, with said cross-rails mechanically coupled to adjacent ones of said primary tracks, and carrying cross-rail electrical energizing means coupled to said cross-rails, for providing electrical power signals along elongated configurations of said cross-rails; and connector means for electrically coupling said electrical energizing means of said primary tracks to said cross-rail electrical energizing means.

18. An overhead rail system in accordance with claim 1, characterized in that said rail system further comprises:

a plurality of said primary tracks;

hanging means for supporting certain of said utilitarian elements, and where said certain of said utilitarian elements comprise whiteboards requiring no interconnection with electrical power or data or communication signals.

19. An overhead rail system in accordance with claim 1, characterized in that said rail system further comprises:

a plurality of primary tracks;

mechanical means for releasably supporting certain of said utilitarian elements from said primary tracks;

said certain of said utilitarian elements comprise an electronic whiteboard;

communication means coupled to said primary tracks, for receiving and transmitting communication signals along said elongated configuration; and connection means for electrically coupling said communication means to said electronic whiteboard.

20. An overhead rail system in accordance with claim 1, characterized in that said rail system further comprises:

a plurality of primary tracks;

mechanical connection means for supporting certain of said utilitarian elements from said primary tracks;

said certain of said utilitarian elements comprise a teleconferencing device;

communication means coupled to said primary tracks, for receiving and transmitting communication signals along said elongated configuration; and connection means for electrically connecting said teleconferencing device to said electrical energizing means and to said communication means.

21. An overhead rail system in accordance with claim 1, characterized in that:

said utilitarian elements further comprise at least one controlling device;

said utilitarian elements further comprise at least one controlled device, said controlled device having at least first and second states; and said communication signals are utilized to effect a logical control relationship between said controlling device and said controlled device.

22. An overhead rail system in accordance with claim 21, characterized in that said logical control relationship between said controlling device and said controlled device is reconfigured at least in part with said communication signals, in the absence of any physical relocation of any physical wiring associated with said controlling device and said controlled device.

23. An overhead rail system in accordance with claim 21, characterized in that said rail system comprises at least one manually operable programming means for transmitting programming signals so as to effect said logical control relationship.

24. An overhead rail system in accordance with claim 23, characterized in that said programming means comprises a hand-held wand.

25. An overhead rail system in accordance with claim 21, characterized in that said rail system further comprises control means coupled to said communication means and to said controlled device, and responsive to said communication signals so as to effect said logical control relationship.

26. An overhead rail system in accordance with claim 25, characterized in that:

said rail system further comprises at least one manually operable programming means for transmitting programming signals so as to effect said logical control relationship; and said control means comprises sensor means responsive to said programming signals for generating control signals and effecting said logical control relationship.

27. An overhead rail system in accordance with claim 26, characterized in that said control means is coupled to said communication means so that said control signals are generated at least partially in response to said communication signals.

28. An overhead rail system in accordance with claim 1, characterized in that said rail system further comprises:

a plurality of primary tracks; and support means coupled to upper portions of said primary tracks and to a building structure of said commercial interior, for releasably supporting said primary tracks from said building structure.

29. An overhead rail system in accordance with claim 28, characterized in that said support means comprises means for adjusting the distance of a plane of said primary tracks from a floor of said building structure.

30. An overhead rail system in accordance with claim 1, characterized in that:

said primary track comprises a back half assembly forming a part of said elongated configuration;

said primary track further comprises a front half assembly forming a part of said elongated configuration, said front and back half assemblies being manufactured as physically separate elements, and when mated together form a part of said primary track with a lower spacial area therewithin;

said electrical energizing means comprises elongated electrical power buses adapted to be mounted within said lower spacial area formed by said back half and said front half assemblies; and said manufacture of said front and said back half assemblies as physically separate elements functions so as to permit positioning of said elongated electrical power buses within said lower spacial area prior to said back and said front half assemblies being coupled together, thereby permitting said elongated buses to be positioned within said spacial area without requiring said elongated buses to be slid through an end of said primary track into said lower spacial area.

31. An overhead rail system in accordance with claim 30, characterized in that said primary track further comprises an elongated cover, said cover being adapted to be coupled to said back half assembly and said front half assembly, so as to form an upper raceway within said primary track.

32. An overhead rail system in accordance with claim 31, characterized in that said cover comprises apertures through which electrical means may be extended so as to electrically interconnect said electrical means to electrical cables or wires extending through said upper raceway.

33. An overhead rail system in accordance with claim 1, characterized in that said rail system further comprises a plurality of primary tracks, with at least a first set of said plurality of primary tracks extending along a single axis, with each of said first set of primary tracks interconnected to adjacent ones of said first set of said primary tracks.

34. An overhead rail system in accordance with claim 33, characterized in that said rail system further comprises connector means for releasably interconnecting adjacent ones, of said primary tracks, so that said connected primary tracks are maintained in a longitudinal configuration.

35. An overhead rail system in accordance with claim 33, characterized in that at least certain of said primary tracks are spaced apart in parallel relationships, and form a substantially horizontal primary track plane.

36. An overhead rail system in accordance with claim 35, characterized in that said rail system comprises at least one cross-rail, adapted to be coupled between adjacent ones of said primary tracks.

37. An overhead rail system in accordance with claim 36, characterized in that said rail system comprises means for interconnecting said cross-rail to adjacent ones of said primary tracks, with such connection being substantially within said primary track plane of said primary tracks.

38. An overhead rail system in accordance with claim 36, characterized in that said overhead rail system comprises means for interconnecting said cross rail to parallel and adjacent ones of said primary tracks, so that said cross rail is positioned in a plane located below said primary track plane of said adjacent ones of said primary tracks.

39. An overhead rail system in accordance with claim 36, characterized in that said rail system comprises means for interconnecting said cross-rail to adjacent and parallel ones of said primary tracks, so that said cross-rail is positioned in a perpendicular configuration relative to said adjacent ones of said primary tracks.

40. An overhead rail system in accordance with claim 36, characterized in that said rail system comprises means for interconnecting said cross-rail to parallel and adjacent ones of said primary tracks, in a manner so that said cross-rail is in a non-perpendicular configuration, relative to said adjacent ones of said primary tracks.

41. An overhead rail system in accordance with claim 36, characterized in that said rail system further comprises:

electrical energizing means coupled to said cross-rail, for providing electrical power signals along an elongated configuration of said cross-rail;

a second set of vertically disposed partitions;

partition connecting means positioned along said cross-rail for removably and vertically supporting said second set of vertically disposed partitions along said elongated configuration of said cross-rail;

a second set of electrically energized devices;

electrical connection means positioned along said cross-rail for interconnecting said second set of electrically energized devices to said cross-rail electrical energizing means; and said partition connecting means and said electrical connection means are coupled to said cross-rail, and to said vertically disposed partitions and electrically energized devices, respectfully, so as to facilitate reconfiguration and relocation of said vertically disposed partitions and said electrically energized devices as required by users of spacial areas containing said cross-rail.

42. An overhead rail system in accordance with claim 36, characterized in that said cross-rail is releasably interconnectable to adjacent ones of said primary tracks.

43. An overhead rail system in accordance with claim 36, characterized in that said rail system comprises means for supporting ceiling panels on said primary tracks and a plurality of said cross rails.

44. An overhead rail system in accordance with claim 1, characterized in that said rail system comprises a universal clip for attaching utilitarian elements to the rail system, and where said universal clip facilitates reconfiguration.

* * * * *